US012459703B2

(12) United States Patent
Rogers et al.

(10) Patent No.: US 12,459,703 B2
(45) Date of Patent: Nov. 4, 2025

(54) PORTABLE CONTAINER, CONTAINER ASSEMBLY, AND ACCESSORIES

(71) Applicant: YETI Coolers, LLC, Austin, TX (US)

(72) Inventors: Kyle Edward Rogers, Austin, TX (US); Andrew M. Bosway, Austin, TX (US); Scott Barbieri, Austin, TX (US); Steve Charles Nichols, Austin, TX (US); Mark Carlson Rane, Austin, TX (US); Donald Edward Desroches, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 18/522,877

(22) Filed: Nov. 29, 2023

(65) Prior Publication Data

US 2024/0092534 A1 Mar. 21, 2024

Related U.S. Application Data

(60) Continuation of application No. 18/061,981, filed on Dec. 5, 2022, now Pat. No. 11,952,172, which is a (Continued)

(51) Int. Cl.
*B65D 25/20* (2006.01)
*A45C 13/00* (2006.01)

(Continued)

(52) U.S. Cl.
CPC ..... *B65D 25/20* (2013.01); *A45C 13/002* (2013.01); *B65D 21/0201* (2013.01);

(Continued)

(58) Field of Classification Search
CPC ..... B65D 25/20; B65D 81/3876; B65D 81/3881; B65D 81/3886; B65D 81/18; B65D 90/06; A45C 13/002

(Continued)

(56) References Cited

U.S. PATENT DOCUMENTS 143,959 A 10/1873 Brown
1,486,676 A 3/1924 Nilssen (Continued)

FOREIGN PATENT DOCUMENTS

CN 102849303 A 1/2013
CN 203186671 U 9/2013

(Continued)

OTHER PUBLICATIONS

"Custom Leathercraft 1118 30-Pocket Outside Bucket-Pockets," published prior to Mar. 23, 2017, retrieved from https://www.walmart.com/ip/Custom-Leathercraft-1118-30-Pocket-Outside-Bucket-Pockets/19656756?action=product_interest&action_type=title&beacon_version=1.0.2&bucket_id=irsbucketdefault&client_guid=62111ea2-f303-4793-8529-5a53e4d809c9&config_id=2&cu#about-item on Jun. 5, 2017.

(Continued)

*Primary Examiner* — James N Smalley
*Assistant Examiner* — Jennifer Castriotta
(74) *Attorney, Agent, or Firm* — Banner & Witcoff, Ltd.

(57) ABSTRACT

An accessory for use with a portable container includes a jacket configured to extend around at least a portion of the sidewall of the container, the jacket including a plurality of modular sections formed separately and connected together around the at least a portion of the sidewall of the container. The modular sections include a first modular section having extending around a first portion of the sidewall of the container, a second modular section connected to the first modular section and extending around a second portion of the sidewall of the container, and at least one additional modular section extending around a third portion of the sidewall of the container. The first and second modular sections have different structural configurations. The accessory also includes a first connection member connected to (Continued)

the jacket and configured to support the jacket in connection with the container.

13 Claims, 36 Drawing Sheets

Related U.S. Application Data division of application No. 16/987,588, filed on Aug. 7, 2020, now Pat. No. 11,584,566.

(51) Int. Cl.
*B65D 21/02* (2006.01)
*B65D 25/28* (2006.01)
*B65D 81/18* (2006.01)
*B65D 81/38* (2006.01)

(52) U.S. Cl.
CPC ..... *B65D 25/2858* (2013.01); *B65D 81/18* (2013.01); *B65D 81/3876* (2013.01); *B65D 21/0204* (2013.01); *B65D 21/0205* (2013.01)

(58) Field of Classification Search
USPC ..... 220/739
See application file for complete search history.

(56) References Cited

U.S. PATENT DOCUMENTS 1,611,567 A 12/1926 Sonen
1,781,583 A 11/1930 Hodgson
2,018,271 A 10/1935 Samuel
2,448,894 A 9/1948 Laus
D165,621 S 1/1952 West
2,757,405 A 8/1956 Edwards
2,954,891 A * 10/1960 Imber ..... B65D 81/3834 220/592.2
3,387,650 A 6/1968 Hoffman et al.
3,425,471 A 2/1969 Yates
3,471,186 A 10/1969 Luebbert et al.
3,504,817 A 4/1970 Heider
3,586,200 A 6/1971 Kramer et al.
3,635,382 A 1/1972 Wilson
4,091,953 A 5/1978 Daenen
4,293,073 A 10/1981 Yates, Jr.
4,356,930 A 11/1982 Roper
4,494,674 A 1/1985 Roof
4,524,882 A 6/1985 Buc
4,541,540 A 9/1985 Gretz et al.
D289,455 S 4/1987 Freiler
4,667,843 A 5/1987 Galer
D296,525 S 7/1988 Siegel
4,765,472 A 8/1988 Dent
4,767,015 A 8/1988 Ho
4,887,735 A 12/1989 Illingworth
4,890,355 A 1/1990 Schulten
D306,272 S 2/1990 Kruger
4,911,295 A 3/1990 Venegoni
D307,342 S 4/1990 Giallourakis
4,993,551 A 2/1991 Lindsay
5,048,996 A 9/1991 DuBois et al.
5,152,555 A 10/1992 Szabo
5,158,193 A 10/1992 Chen
5,174,447 A 12/1992 Fleming
5,238,135 A 8/1993 Landis
5,251,460 A * 10/1993 DeMarco ..... B65D 81/3886 62/400
5,255,816 A 10/1993 Trepp
D345,237 S 3/1994 Stein
D352,143 S 11/1994 Arshinoff
5,364,148 A 11/1994 Bartocci
D354,596 S 1/1995 Dancyger
D355,062 S 1/1995 Maire et al.
D355,735 S 2/1995 Shaffer et al.
5,411,307 A 5/1995 Roberts
5,429,265 A 7/1995 Maire et al.
D362,181 S 9/1995 Meyers et al.
5,447,252 A 9/1995 Ward
D365,506 S 12/1995 Spitere
D371,185 S 6/1996 Mullins
D376,454 S 12/1996 Fierek et al.
D386,341 S 11/1997 Walker
D389,058 S 1/1998 Landis
5,704,496 A 1/1998 Latta
5,730,309 A 3/1998 Jiradejnunt et al.
5,738,401 A 4/1998 Fan
5,772,066 A 6/1998 Reynolds
D396,912 S 8/1998 Maire et al.
5,816,439 A 10/1998 Lovell et al.
5,833,095 A 11/1998 Russell et al.
5,833,096 A 11/1998 Ohu
D402,986 S 12/1998 Doak
5,860,559 A 1/1999 Wang
5,873,482 A 2/1999 Conti
5,883,095 A 3/1999 Granstrom et al.
5,921,017 A 7/1999 Clark et al.
5,944,214 A 8/1999 Conti et al.
D414,337 S 9/1999 Hubert
5,971,200 A 10/1999 Reynolds
6,035,769 A 3/2000 Nomura et al.
D425,600 S 5/2000 Pas et al.
6,059,109 A 5/2000 Stein
6,085,902 A 7/2000 Fang
6,151,910 A 11/2000 Hazen
6,189,697 B1 2/2001 Davis
6,257,440 B1 7/2001 Perkins et al.
D446,617 S 8/2001 Urbanski
6,315,310 B1 11/2001 Hurt
6,336,255 B1 1/2002 Gallup
D454,812 S 3/2002 Luk
6,533,227 B1 3/2003 Rom
6,536,590 B1 3/2003 Godshaw et al.
D475,851 S 6/2003 Leighton
6,688,483 B2 2/2004 Davis
6,823,562 B1 11/2004 Smith et al.
6,926,165 B2 8/2005 Conti
6,938,761 B2 9/2005 Nish
6,964,348 B2 11/2005 Breimon et al.
7,073,205 B2 7/2006 Finn
7,090,088 B2 8/2006 von Holdt, Jr.
7,195,119 B2 3/2007 Lungo
7,207,457 B2 4/2007 Schwarz
7,232,169 B2 6/2007 Porter
7,305,793 B1 12/2007 Macdonald
7,380,796 B1 6/2008 Hinton
D590,561 S 4/2009 Baltz
7,805,813 B1 10/2010 Bunyard
7,913,446 B1 3/2011 Aldridge, III
7,980,415 B2 7/2011 Crawley
D649,726 S 11/2011 Manuel
8,079,768 B1 12/2011 McLaughlin
8,162,165 B2 4/2012 Reed
8,181,819 B2 5/2012 Burney et al.
8,210,391 B2 7/2012 Luburic
8,251,269 B2 8/2012 Winneur
8,308,010 B2 11/2012 Letica et al.
8,342,350 B2 1/2013 Jain
D677,895 S 3/2013 Camp, III
D683,510 S 5/2013 Schick
8,459,486 B2 6/2013 Luburic et al.
D688,592 S 8/2013 Placencia
8,615,921 B1 12/2013 Weems
D698,939 S 2/2014 Wainwright et al.
8,662,300 B1 3/2014 Arena
8,714,403 B2 5/2014 Amprimo
8,806,803 B1 8/2014 Mitchell et al.
8,844,717 B1 9/2014 Ross
8,863,982 B2 10/2014 Baltz et al.
8,863,983 B2 10/2014 Meers et al.
8,869,985 B2 10/2014 Schick
8,887,940 B2 11/2014 Kiceniuk, Jr. et al.
8,899,443 B2 12/2014 Soibel et al.
D722,833 S 2/2015 Miller

(56) References Cited

U.S. PATENT DOCUMENTS

| | | | | |
|---|---|---|---|---|
| 8,978,194 | B1 | 3/2015 | Lentine | |
| D728,882 | S | 5/2015 | Tsai | |
| 9,067,462 | B1 | 6/2015 | Pressler et al. | |
| D739,510 | S | 9/2015 | Bullock | |
| 9,475,607 | B2 | 10/2016 | Apps | |
| D772,561 | S | 11/2016 | Polunsky et al. | |
| 9,533,789 | B2 | 1/2017 | Selina et al. | |
| 10,098,335 | B2 * | 10/2018 | Cooper | A01K 97/04 |
| 2002/0003098 | A1 | 1/2002 | Bell | |
| 2002/0088729 | A1 | 7/2002 | Urbanski | |
| 2004/0045084 | A1 | 3/2004 | Klosterman | |
| 2005/0051441 | A1 | 3/2005 | Lamar | |
| 2005/0056557 | A1 | 3/2005 | Jennings et al. | |
| 2005/0133521 | A1 | 6/2005 | Schwarz | |
| 2005/0145284 | A1 | 7/2005 | Sarajian et al. | |
| 2005/0211586 | A1 | 9/2005 | Fierek | |
| 2005/0279654 | A1 | 12/2005 | Robles | |
| 2006/0011686 | A1 | 1/2006 | Latham | |
| 2006/0163894 | A1 | 7/2006 | Mishek et al. | |
| 2006/0231562 | A1 * | 10/2006 | Carroll | B65D 81/3879 220/737 |
| 2007/0246959 | A1 | 10/2007 | Arcaro et al. | |
| 2008/0105694 | A1 | 5/2008 | Chen | |
| 2009/0301912 | A1 | 12/2009 | Cornell | |
| 2010/0072215 | A1 | 3/2010 | Coon | |
| 2011/0000919 | A1 | 1/2011 | Whalen | |
| 2012/0085774 | A1 | 4/2012 | Luburic et al. | |
| 2012/0279976 | A1 | 11/2012 | DeSanti et al. | |
| 2013/0037559 | A1 | 2/2013 | Fierek | |
| 2013/0048657 | A1 | 2/2013 | Heiser, Jr. et al. | |
| 2013/0119078 | A1 | 5/2013 | Cygan | |
| 2013/0248284 | A1 | 9/2013 | Nichols, Jr. | |
| 2014/0102925 | A1 | 4/2014 | Jacobson et al. | |
| 2014/0124520 | A1 | 5/2014 | Allan | |
| 2014/0217095 | A1 | 8/2014 | Scivoletto | |
| 2014/0261933 | A1 | 9/2014 | Jones | |
| 2014/0305955 | A1 * | 10/2014 | Lee | A47J 36/36 220/739 |
| 2014/0326189 | A1 | 11/2014 | Jain | |
| 2015/0001121 | A1 | 1/2015 | Pietruch et al. | |
| 2015/0053705 | A1 | 2/2015 | Wilson et al. | |
| 2015/0107149 | A1 | 4/2015 | Garrett | |
| 2015/0217903 | A1 | 8/2015 | Mazyck, III | |
| 2015/0225125 | A1 | 8/2015 | Martinisko | |
| 2016/0120162 | A1 | 5/2016 | Copper | |
| 2016/0228756 | A1 | 8/2016 | Siscoe | |
| 2016/0280423 | A1 | 9/2016 | Luburic | |
| 2016/0311584 | A1 | 10/2016 | Van Oosten | |
| 2016/0368133 | A1 | 12/2016 | Welfel et al. | |
| 2016/0368665 | A1 | 12/2016 | Leeming | |
| 2017/0229687 | A1 | 8/2017 | Elison et al. | |
| 2017/0259424 | A1 | 9/2017 | Vetter et al. | |
| 2018/0079555 | A1 | 3/2018 | Lee, Jr. | |
| 2018/0229897 | A1 | 8/2018 | Abed | |
| 2018/0244432 | A1 | 8/2018 | Seiders et al. | |
| 2021/0122527 | A1 * | 4/2021 | Williams | B65D 47/06 |

FOREIGN PATENT DOCUMENTS

| | | | |
|---|---|---|---|
| CN | 103662246 | A | 3/2014 |
| CN | 303149621 | | 4/2015 |
| CN | 303214602 | | 5/2015 |
| CN | 303245878 | | 6/2015 |
| CN | 303263716 | | 7/2015 |
| CN | 303284668 | | 7/2015 |
| CN | 303284683 | | 7/2015 |
| CN | 303295744 | | 7/2015 |
| CN | 303295746 | | 7/2015 |
| CN | 303316701 | | 8/2015 |
| CN | 303316702 | | 8/2015 |
| CN | 303316749 | | 8/2015 |
| CN | 303316750 | | 8/2015 |
| CN | 303316751 | | 8/2015 |
| CN | 303336476 | | 8/2015 |
| CN | 303345543 | | 8/2015 |
| CN | 303517355 | | 12/2015 |
| CN | 303899235 | | 10/2016 |
| CN | 303910969 | | 11/2016 |
| DE | 202009009198 | U1 | 11/2009 |
| DE | 20201320100609 | U1 | 11/2013 |
| EP | 779018 | A | 7/1957 |
| EP | 2130777 | A2 | 12/2009 |
| GB | 201689 | A | 8/1923 |
| GB | 2499688 | A | 8/2013 |
| JP | 3113954 | U | 9/2005 |
| JP | 3116035 | U | 11/2005 |
| JP | 3221898 | U | 6/2019 |
| KR | 200472092 | Y1 | 4/2014 |
| WO | 2006 009537 | A1 | 1/2006 |

OTHER PUBLICATIONS

"Fiskars Garden Bucket Caddy, Bucket Not Included (9424)," published prior to Mar. 23, 17, retrieved from https://www.amazon.com/Fiskars-Garden-Bucket-Caddy-Included/dp/B00005YX30 on Jun. 5, 2017.

"Walmart Bucket Organizers" published prior to Mar. 23, 2017, retrieved from <https://www.walmart.com/search/?query=Bucket%20Organizers&u1=&oid=223073.1&wmlspartner=TQiP6m79tRs&sourceid=0658685856162311 8499&affillinktype=10&veh=aff> on Apr. 7, 2017.

"Utility Pail 5 Gallon By Seachoice Products," published prior to Feb. 27, 2017, retrieved from https://www.amazon.com/Utility-Pail-Gallon-Seachoice-Products/dp/B002IZFOGK/ref=sr_1_79?ie=UTF8&qid=1483581180&sr=8-79&keywords=utility+pail on Jun. 8, 2017.

"United Solutions PN0020 White Five Gallon Plastic Industrial Pail—5 Gallon Plastic Bucket for Industrial in White," published prior to Feb. 27, 2017, retrieved from https://www.amazon.com/United-Solutions-PN0020-Plastic-Industrial/dp/B005SB1ORY/ref=sr_1_88?ie=UTF8&qid=1483581247&sr=8-88&keywords=utility+pail on Jun. 8, 2017.

"Bucket Stacker Tool Organize with 4 Compartments, 3" Deep," published prior to Feb. 27, 2017, retrieved from http://www.all-spec.com/Catalog/Hand-Power-Tools/Pneumatic-Tools/Tool-Arms-Holders/15051-65685?gclid=CIrk0-n0qtECFUhWDQod6w4JOg on Jun. 8, 2017.

"Built-in Bottom Handle 5 Gallon Buckets & Covers," published prior to Feb. 27, 17, retrieved from http://www.usplastic.com/catalog/item.aspx?itemid=118844&catid=752 on Jun. 8, 2017.

"The Ultimate Bucket," published prior to Feb. 27, 2017, retrieved from https://web.archive.org/web/20111027180918/http://ultimatebucket.com:80/index.html on Jun. 21, 2017.

"61—Pocket In and Out Bucket Organizer," published prior to this application's filing date on Mar. 23, 2017, retrieved from https://www.walmart.com/ip/Custom-Leathercraft-4122-61-Pocket-Bucket-Tool-Bag-61-Pocket-In-Out-Each/21659694 on Jun. 5, 2017.

"Apollo Tools Bucket Organizer, Pink," published prior to this application's filing date on Mar. 23, 2017, retrieved from https://www.walmart.com/ip/Apollo-Tools-Bucket-Organizer/22848213 on Jun. 5, 2017.

"Apollo Tools Bucket Organizer," published prior to this application's filing date on Mar. 23, 2017, retrieved from https://www.walmart.com/ip/Apollo-Tools-Bucket-Organizer/22848212 on Jun. 5, 2017.

"Bucket Organizer Wrap Milwaukee Tool Holders 48-22-8175045242479580," published prior to this application's filing date on Mar. 23, 2017, retrieved from https://www.walmart.com/ip/Bucket-Organizer-Wrap-Milwaukee-Tool-Holders-48-22-8175-045242479580/120876362 on Jun. 5, 2017.

"Fiskars Garden Bucket Caddy, Bucket Not Included (9424)," published prior to this application's filing date on Mar. 23, 2017, retrieved from https://www.amazon.com/Fiskars-Garden-Bucket-Caddy-Included/dp/B00005YX30 on Jun. 5, 2017.

Jan. 20, 2022—(WO) International Search Report & Written Opinion—PCT/US21/044477.

(56) References Cited

OTHER PUBLICATIONS

Aug. 28, 2024—(NZ) First Examination Report—App. No. 796420.
Jul. 31, 2024—(JP) Second Office Action—App. No. 2023-507786.
Dec. 18, 2024—(JP) Decision of Rejection—App. No. 2023-507786.
Jan. 16, 2024—(AU) Examination Report 1—App. No. 2021320756.
Dec. 28, 2023—(JP) First Office Action—App. No. 2023-507786.
May 29, 2025—(AU) First Examination Report—App. No. 2024205241.

* cited by examiner

PORTABLE CONTAINER, CONTAINER ASSEMBLY, AND ACCESSORIES

CROSS-REFERENCE TO RELATED APPLICATIONS

This application is a continuation of U.S. application Ser. No. 18/061,981 filed on Dec. 5, 2022, which is a divisional application of U.S. application Ser. No. 16/987,588 filed on Aug. 7, 2020, now U.S. Pat. No. 11,584,566 that issued on Feb. 21, 2023. The above referenced applications are incorporated by reference in their entirety for any and all non-limiting purposes.

TECHNICAL FIELD

Aspects of the disclosure herein are related to accessories for portable containers and container assemblies, such as a five-gallon bucket or pail, and in particular, to a jacket, wrap, or other accessory configured to be mounted on such a portable container.

BACKGROUND

Accessories such as bags or organizers are often used in connection with portable containers to provide additional functionality to the container. In particular, such accessories are frequently used in connection with plastic buckets, e.g., the ubiquitous five-gallon bucket, but may be used in connection with other containers. Additionally, such accessories frequently contain multiple storage compartments to provide storage for tools, parts, supplies, or other articles that are used in conjunction with the bucket. Such accessories are typically mounted on the bucket by either draping the accessory over the rim of the bucket or constricting the accessory around the outer sidewall of the bucket. Both of these mounting techniques suffer from drawbacks. Accessories that are draped over the top of the bucket prevent the use of a lid in connection with the bucket and may fall off of the bucket if the bucket is inverted or partially inverted, among other drawbacks. Accessories that are constricted around the outer sidewall of the bucket can tend to slip, among other drawbacks. Further, there is a lack of articles that can provide for directly mounting accessories other than the aforementioned bags and organizers on a plastic bucket or other container. The articles and methods described herein can address these and other problems with existing container accessories.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the disclosure relate to an accessory for use with a portable container having a bottom and a sidewall extending upward from the bottom to define an internal cavity with a top opening. According to such aspects, the accessory includes a jacket configured to extend around at least a portion of the sidewall of the container, the jacket including a plurality of modular sections formed separately and connected together around the at least a portion of the sidewall of the container. The modular sections include a first modular section having a first end and a second end opposite the first end and extending around a first portion of the sidewall of the container, a second modular section having a third end connected to the first end of the first modular section and a fourth end opposite the third end, the second modular section extending around a second portion of the sidewall of the container, and at least one additional modular section connected between the second end of the first modular section and the fourth end of the second modular section and extending around a third portion of the sidewall of the container. The first modular section has a first structural configuration, and the second modular section has a second structural configuration that is different from the first structural configuration. The accessory also includes a first connection member connected to the jacket and configured to support the jacket in connection with the container.

According to one aspect, the first structural configuration includes a first functional attachment, and the second structural configuration includes a second functional attachment that is different from the first functional attachment. In one configuration, the first functional attachment includes a first storage member, and the second functional attachment includes a second storage member that is configured differently from the first storage member.

According to another aspect, the second structural configuration is different from the first structural configuration by having at least one of different peripheral sizes and different peripheral shapes.

According to a further aspect, the first and second modular sections are arranged such that the first end of the first modular section overlaps or underlaps the third end of the second modular section.

According to yet another aspect, the plurality of modular sections are releasably connected together by releasable connecting structures, including a first releasable connecting structure between the first end of the first modular section and the third end of the second modular section.

According to a still further aspect, the jacket further includes a base configured to extend around the at least a portion of the sidewall of the container, where the plurality of modular sections are further connected to the base. In one configuration, the base includes a first annular band and a second annular band spaced below the first annular band, where the first and second annular bands are configured to extend around an entirety of the sidewall of the container, and each of the plurality of modular sections is connected to the first and second annular bands. In another configuration the base includes a tubular wrap configured to extend around an entirety of the sidewall of the container and having a height measured between a top peripheral edge and a bottom peripheral edge thereof, where the plurality of modular sections have heights that are equal to or less than the height of the base, and the plurality of modular sections all have top and bottom edges that are contiguous with each other around an entire periphery of the base. In a further configuration, the first connection member is connected to the base.

According to another aspect, the accessory includes a plurality of connection members, including the first connection member, connected to the jacket and configured to support the jacket in connection with the container.

According to an additional aspect, the first connection member includes a connector configured to engage a port on the container such that a portion of the connector is received through the port.

Additional aspects of the disclosure relate to an accessory for use with a portable container having a bottom and a sidewall extending upward from the bottom to define an internal cavity with a top opening. The accessory includes a jacket having a base configured to extend around at least a portion of the sidewall of the container and a plurality of modular sections formed separately and connected to the base. The plurality of modular sections include a first modular section connected to the base and extending around a first portion of the sidewall of the container, a second modular section connected to the base and extending around a second portion of the sidewall of the container, and at least one additional modular section connected to the base and extending around a third portion of the sidewall of the container. The first modular section has a first structural configuration, and the second modular section has a second structural configuration that is different from the first structural configuration. A connection member is connected to the base and configured to support the base in connection with the container, and the base supports the plurality of modular sections.

According to one aspect, the first structural configuration includes a first functional attachment, and the second structural configuration includes a second functional attachment that is different from the first functional attachment. In one configuration, the first functional attachment includes a first storage member, and the second functional attachment includes a second storage member that is configured differently from the first storage member.

According to another aspect, the second structural configuration is different from the first structural configuration by having at least one of different peripheral sizes and different peripheral shapes.

According to a further aspect, the plurality of modular sections are arranged such that a left edge of each modular section overlaps or underlaps a right edge of an adjacent one of the modular sections.

According to yet another aspect, the first and second modular sections are positioned adjacent to each other, and a left edge of the second modular section overlaps or underlaps a right edge of the first modular section.

According to a still further aspect, the base is annular and is configured to extend around an entirety of the sidewall of the container, and the plurality of modular sections together extend around the entirety of the sidewall of the container.

According to another aspect, the plurality of modular sections are releasably connected to the base by releasable connecting structures.

According to an additional aspect, the base includes a first annular band and a second annular band spaced below the first annular band, where the first and second annular bands are configured to extend around an entirety of the sidewall of the container, and where each of the plurality of modular sections is connected to the first and second annular bands.

According to another aspect, the base includes a tubular wrap configured to extend around an entirety of the sidewall of the container and having a height measured between a top peripheral edge and a bottom peripheral edge thereof, and the plurality of modular sections have heights that are equal to or less than the height of the base. In this configuration, the plurality of modular sections all have top and bottom edges that are contiguous with each other around an entire periphery of the base.

Further aspects of the disclosure relate to a method that uses a plurality of separate modular sections each having a top edge, a bottom edge, and opposed left and right side edges, where at least two of the modular sections have different structural characteristics. The plurality of modular sections are connected together to form an annular jacket extending around a periphery defining a passage, where each of the modular sections extends around a portion of the periphery of the jacket, and where the plurality of modular sections are arranged so that the left edge of each modular section is proximate the right edge of an adjacent one of the modular sections. The jacket is configured to be engaged with a portable container having a bottom and a sidewall extending upward from the bottom to define an internal cavity with a top opening, such that a portion of the portable container is received within the passage of the jacket.

According to one aspect, the plurality of modular sections are provided as part of a larger plurality of separate modular sections having a plurality of different structural characteristics, and the method further includes selecting the plurality of modular sections from the larger plurality of modular sections.

According to another aspect, the different structural characteristics include at least one of different functional attachments, different peripheral sizes, and different peripheral shapes.

According to a further aspect, the plurality of modular sections are arranged such that the left edge of each modular section overlaps or underlaps the right edge of the respective adjacent one of the modular sections.

According to yet another aspect, an annular base is configured to extend around the periphery of the jacket, and connecting the plurality of modular sections together includes connecting the modular sections separately to the base.

According to a still further aspect, the plurality of modular sections are releasably connected together by engaging releasable connecting structures.

According to an additional aspect, a plurality of connection members are connected to the jacket, where the plurality of connection members are configured for connection to the portable container. In one configuration, the jacket is engaged with the portable container, such that the portion of the portable container is received within the passage of the jacket by connecting the plurality of connection members to a plurality of ports on the portable container.

Still further aspects of the disclosure relate to a container assembly that includes a portable container having a bottom and a sidewall extending upward from the bottom to define an internal cavity with a top opening, the container including a port, and an insulating member connected to the container. The insulating member includes an insulating body having a bottom wall and an insulating sidewall defining a cavity, wherein the portable container is received within the cavity of the insulating body such that the bottom of the container confronts the bottom wall of the insulating body, and the sidewall of the portable container confronts the insulating sidewall of the insulating body, and a connection member including a connector connected to the port, where the connection member is connected to the insulating body and supports the insulating body in connection with the container. The insulating body has a thermal conductivity through the insulating sidewall that is lower than a thermal conductivity through the sidewall of the container.

According to one aspect, the container further includes a skirt having a horizontal portion extending outward from the sidewall around a periphery of the sidewall, and the insulating body is positioned beneath the horizontal portion of the skirt, and wherein the port is positioned on the skirt.

According to another aspect, the container further includes a skirt extending outward from the sidewall around a periphery of the sidewall, and the skirt is received in the cavity such that the insulating body extends above the skirt. The port is positioned on the skirt.

Other features and advantages of the invention will be apparent from the following description taken in conjunction with the attached drawings.

BRIEF DESCRIPTION OF THE DRAWINGS

A more complete understanding of aspects described herein and the advantages thereof may be acquired by referring to the following description in consideration of the accompanying drawings, in which like reference numbers indicate like features, and wherein.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Figure 1:
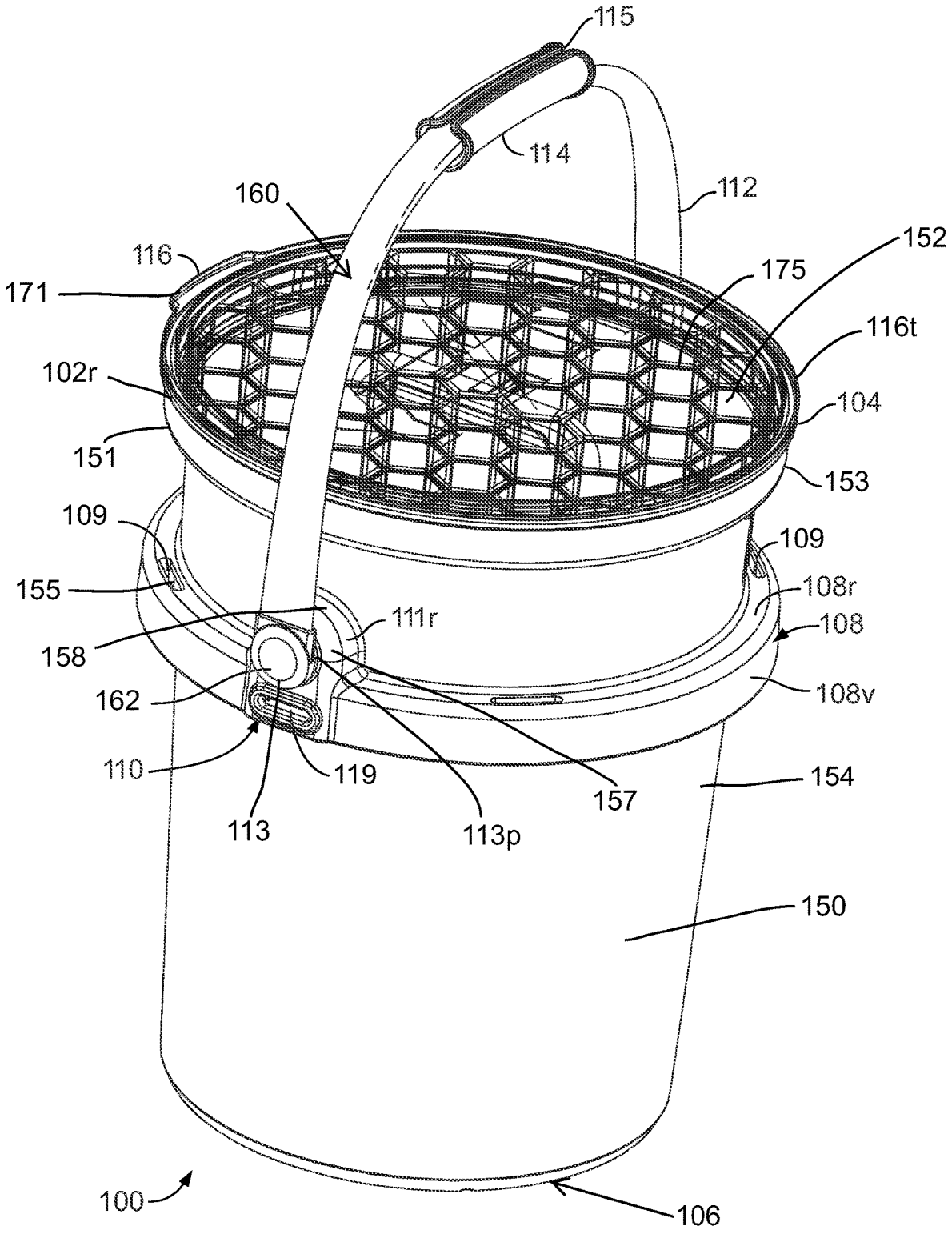
FIG. 1 is a perspective view of one embodiment of a portable container assembly in accordance with aspects of the disclosure.
Figure 2:
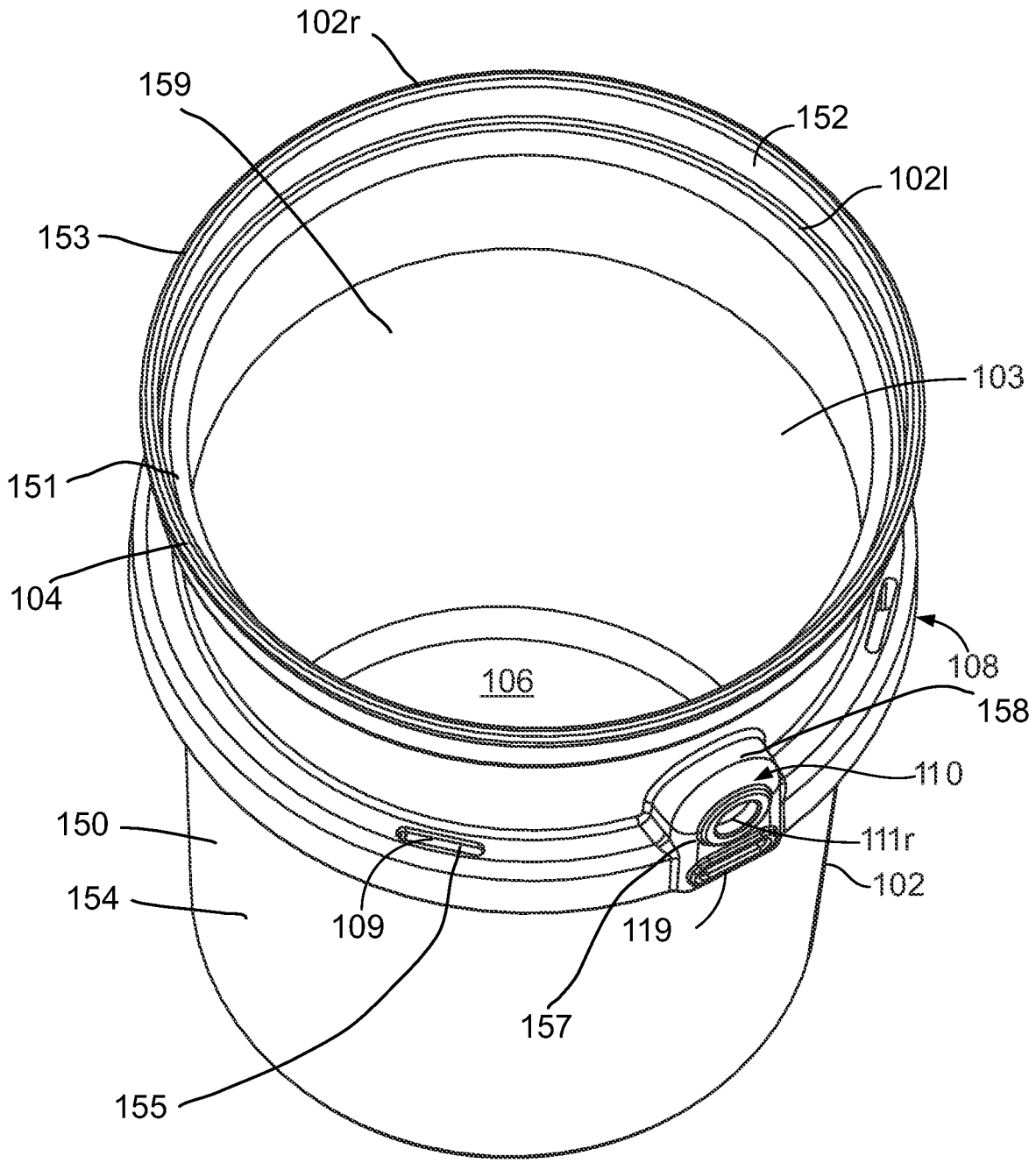
FIG. 2 is an upper perspective view of the assembly of FIG. 1 with a lid and a removable handle removed.
Figure 56:
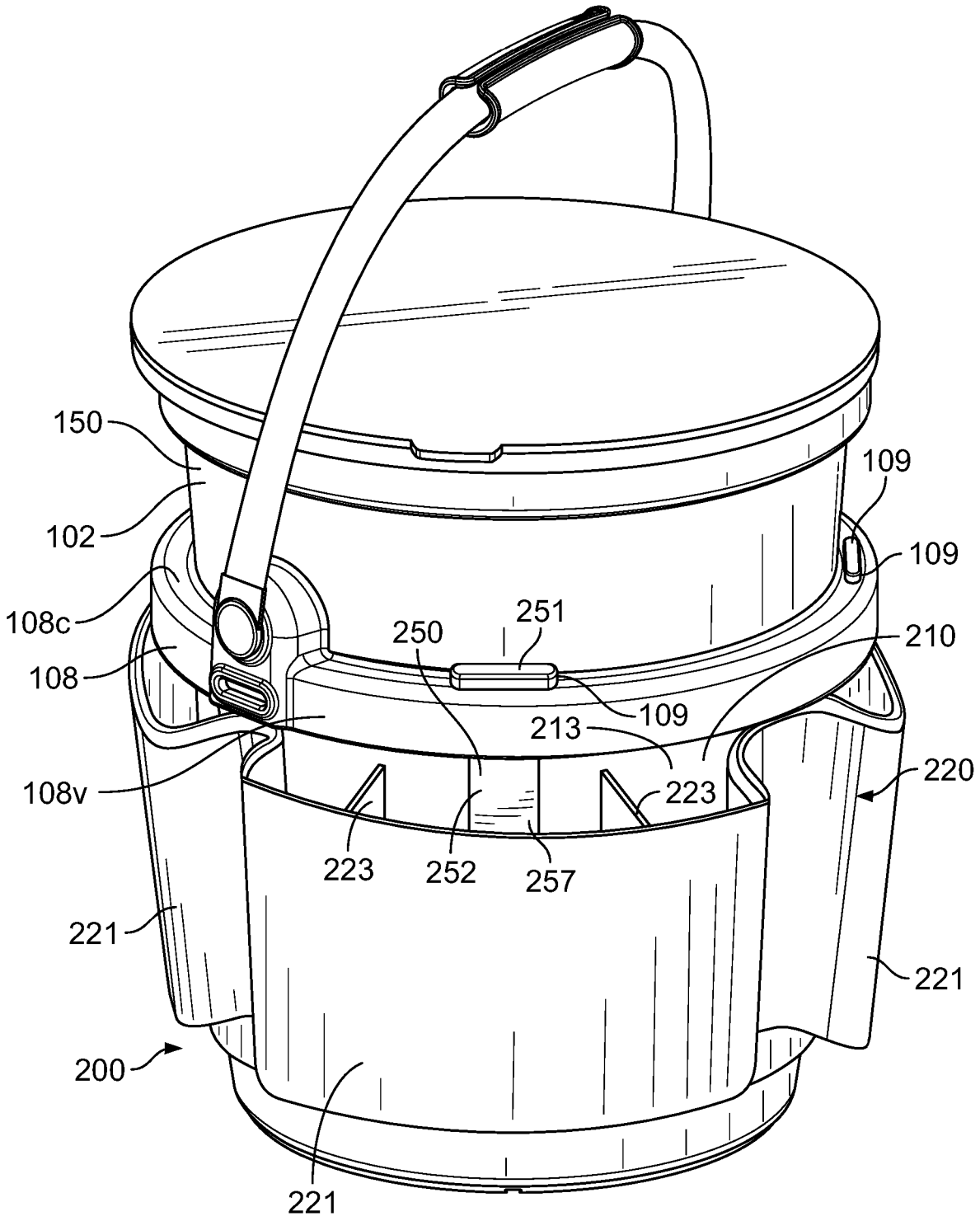
FIG. 56 is a perspective view of the container of FIG. 1 with another embodiment of an accessory in accordance with aspects of the disclosure connected to the container.
Figure 57:
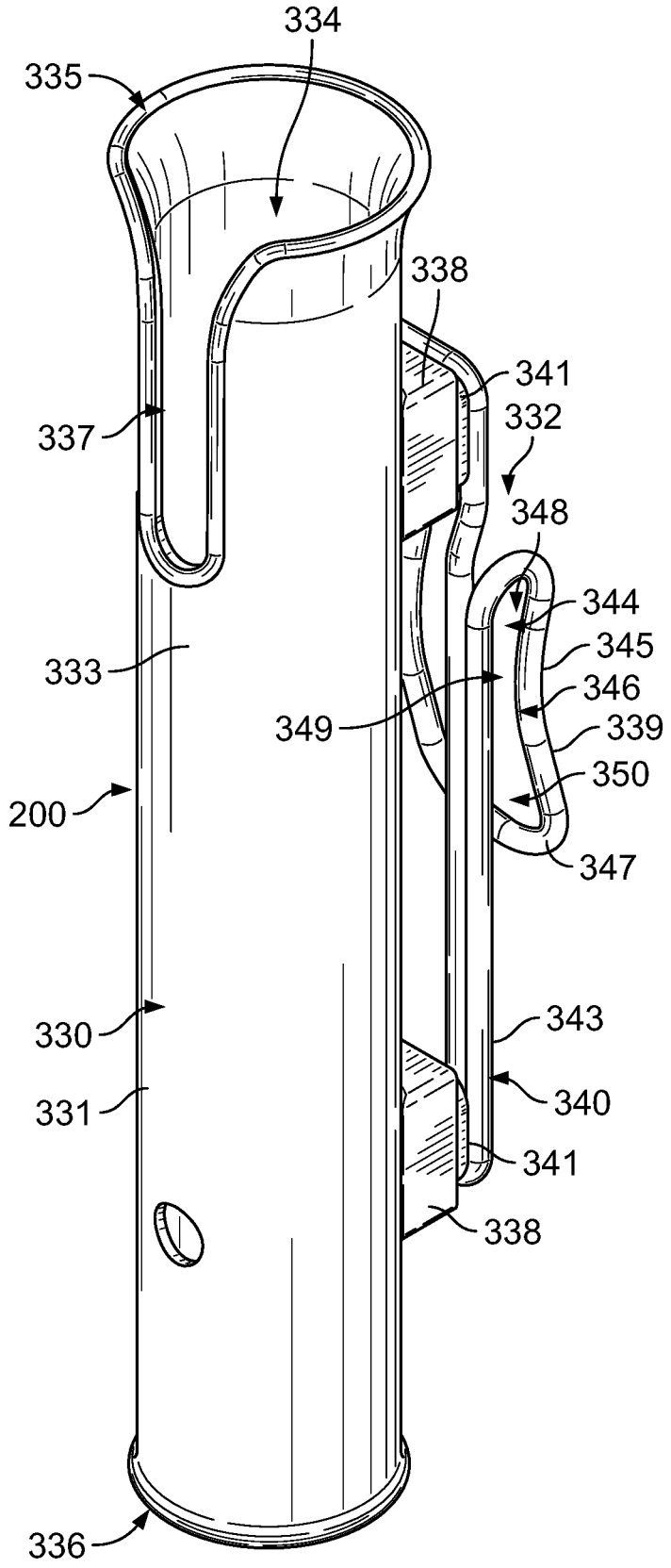
FIG. 57 is a perspective view of another embodiment of an accessory configured for connection to the container, in accordance with aspects of the disclosure.
Figure 58:
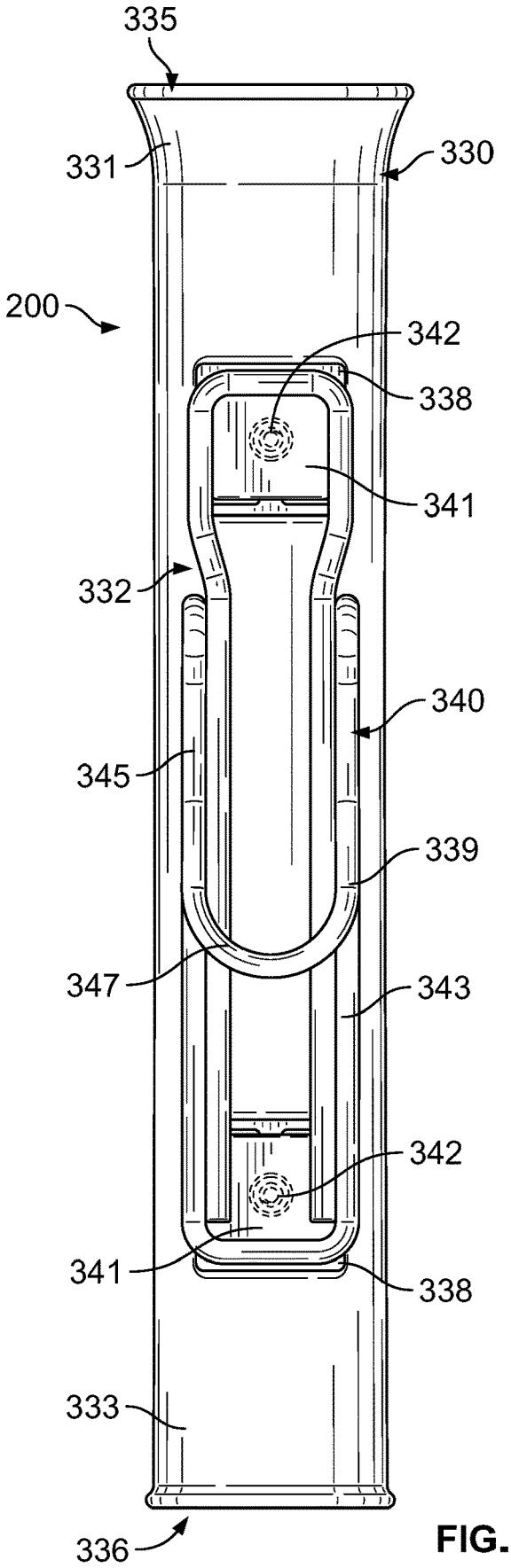
FIG. 58 is a front view of the accessory of FIG. 57.
Figure 59:
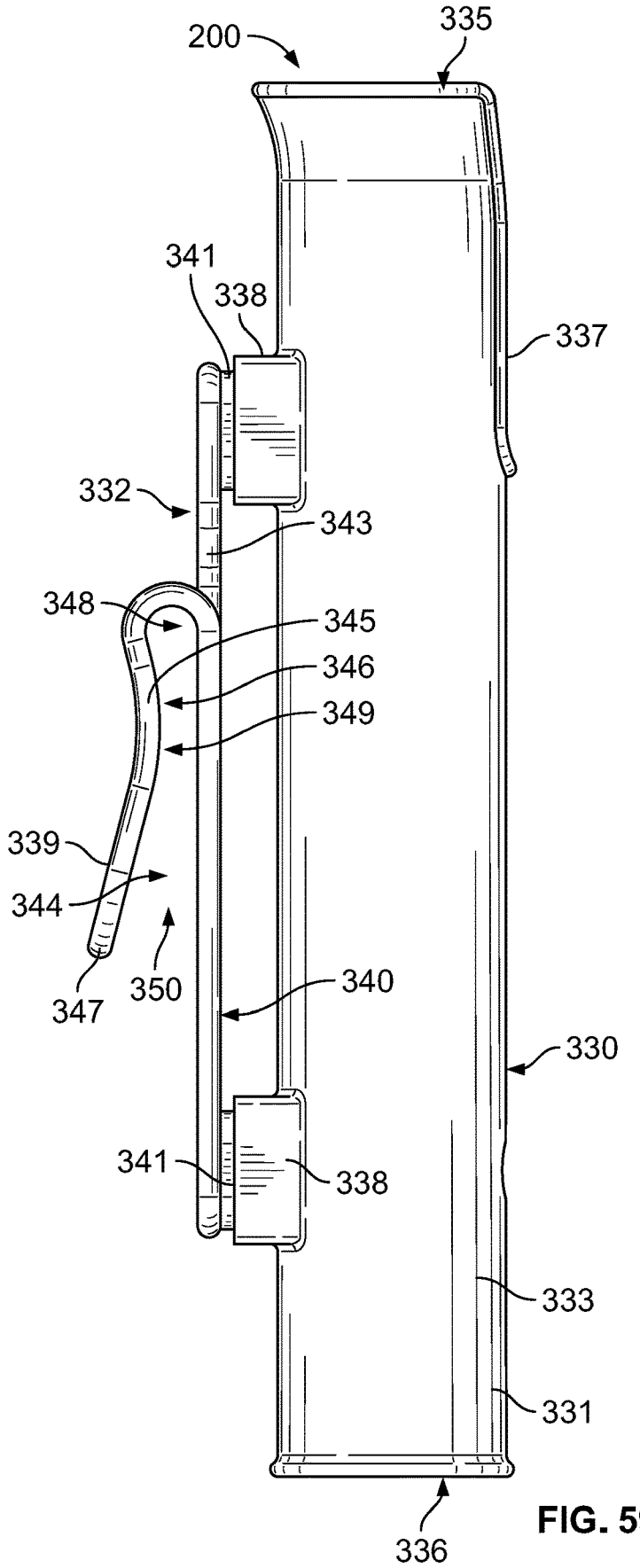
FIG. 59 is a side view of the accessory of FIG. 57.

In general, aspects of the disclosure relate to an accessory for use with a portable container assembly, such that the accessory is configured to be mounted on the container assembly. FIGS. 6-36 and 45-56 illustrate various embodiments of such an accessory 200 in the form of a holder or organizer configured for holding various articles, including parts, supplies, tools, and other articles. FIGS. 37-44 illustrate embodiments of an accessory 200 in the form of an insulating cover. FIGS. 57-59 illustrate an embodiment of an accessory 200 in the form of a fishing rod holder. FIGS. 1-10 illustrate an example embodiment of a portable container assembly 100 that can be used in accordance with exemplary embodiments of the accessory 200 described herein, as well as the use of the container assembly 100 in connection with the accessory 200. Referring to FIG. 1, the container assembly 100 may include a container 102, which can be in the form of a substantially cylindrical structure, such as a tapered cylinder, which is closed at the bottom and open at the top. Also, so as to enable storage and transportation of provisions, such as food items for human consumption, this structure 102 can be formed of a food grade plastic. The container assembly 100 may include any or all features described in U.S. patent application Ser. No. 15/616,675, filed on Jun. 7, 2017, and U.S. Provisional Application No. 62/464,890, filed on Feb. 28, 2017, both of which applications are fully incorporated herein by reference.

The container 102 includes a bottom 106 that includes a base 141 having a central recess 142, and a pad 120 connected to a bottom side 140 of the base 141. The central recess 142 may include one or more bracing structures 145 for increased strength. In the embodiment shown in FIGS. 1-10, the pad 120 extends around the central recess 142, and the recess 142 is circular, while the pad 120 is annular in shape. The container 102 also includes a sidewall 150 connected to the bottom 106 and/or the base 141 and extending upward from the base 141 to define an internal cavity 103 with an opening 152 at a top 153 of the sidewall 150. The bottom 106 of the container 102 is circular and defined by a circular base 141 and a circular sidewall 150, with other circular, cylindrical, or annular components as shown in FIGS. 1-10, although the container 102 and the components thereof may be shaped differently in other embodiments, including oval/elliptical or various polygonal shapes.

Figure 3:
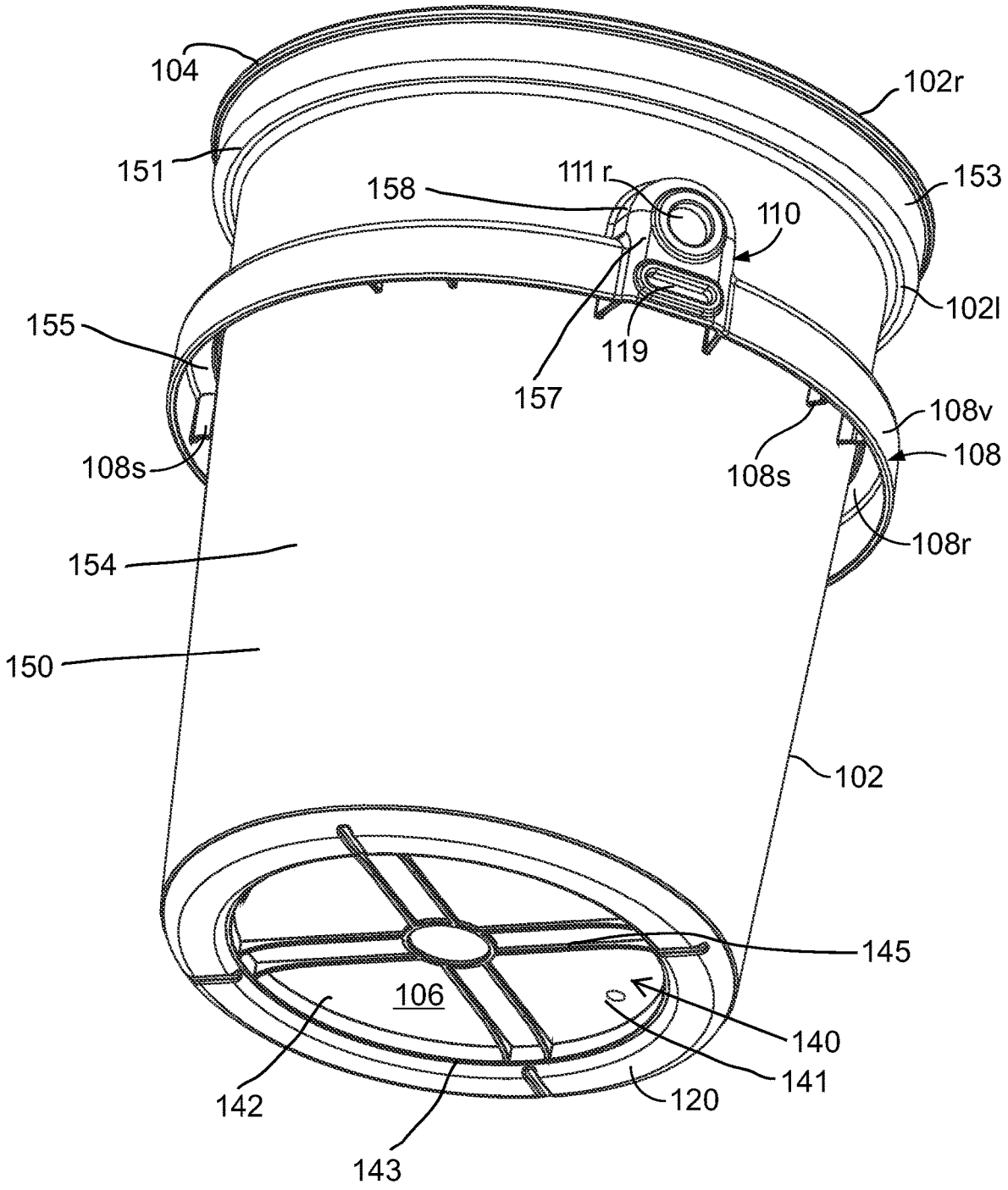
FIG. 3 is a lower perspective view of the assembly of FIG. 1 with the removable handle removed.
Figure 4:
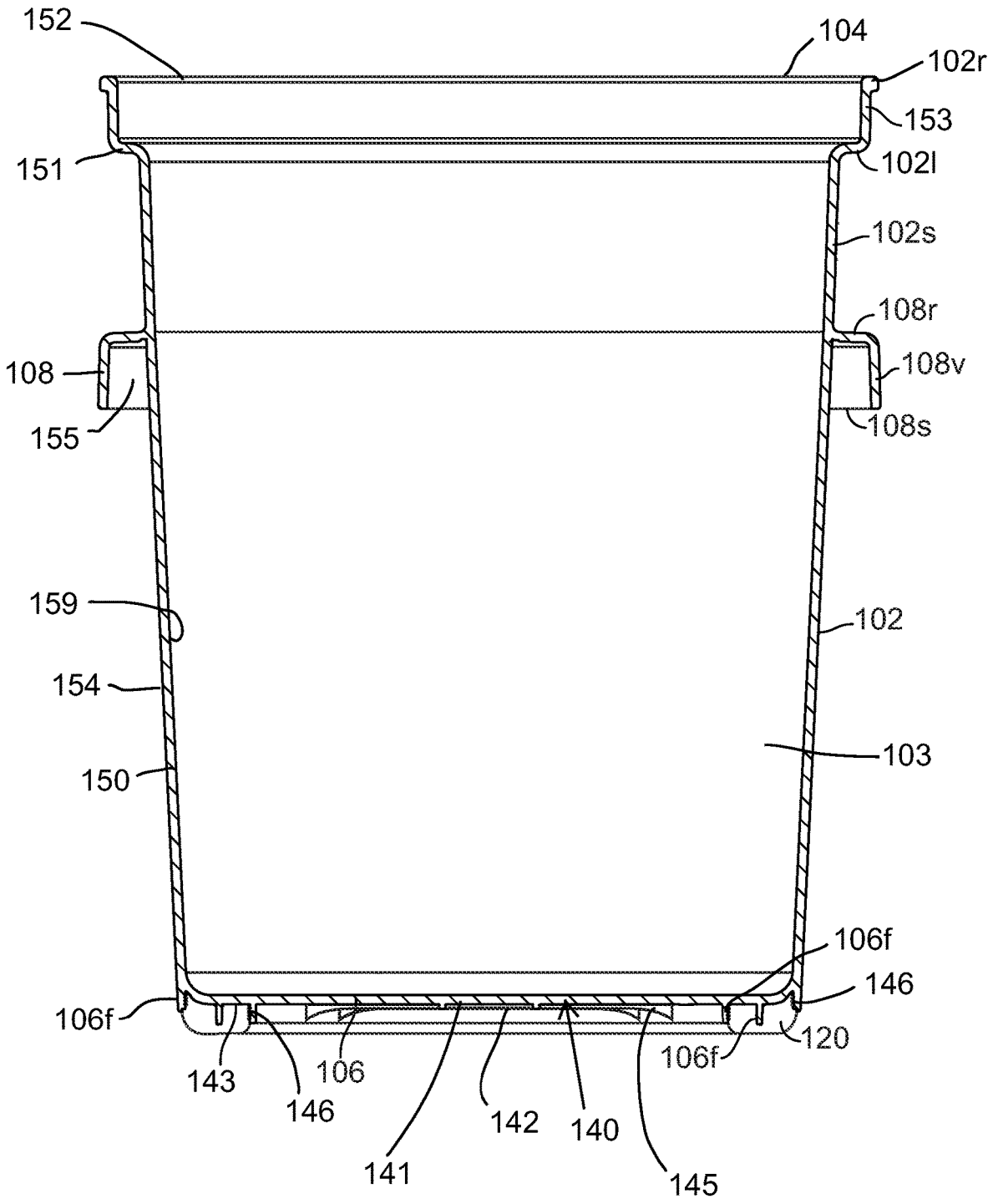
FIG. 4 is a cross-sectional view of the assembly of FIG. 1 with the lid and removable handle removed.
Figure 5:
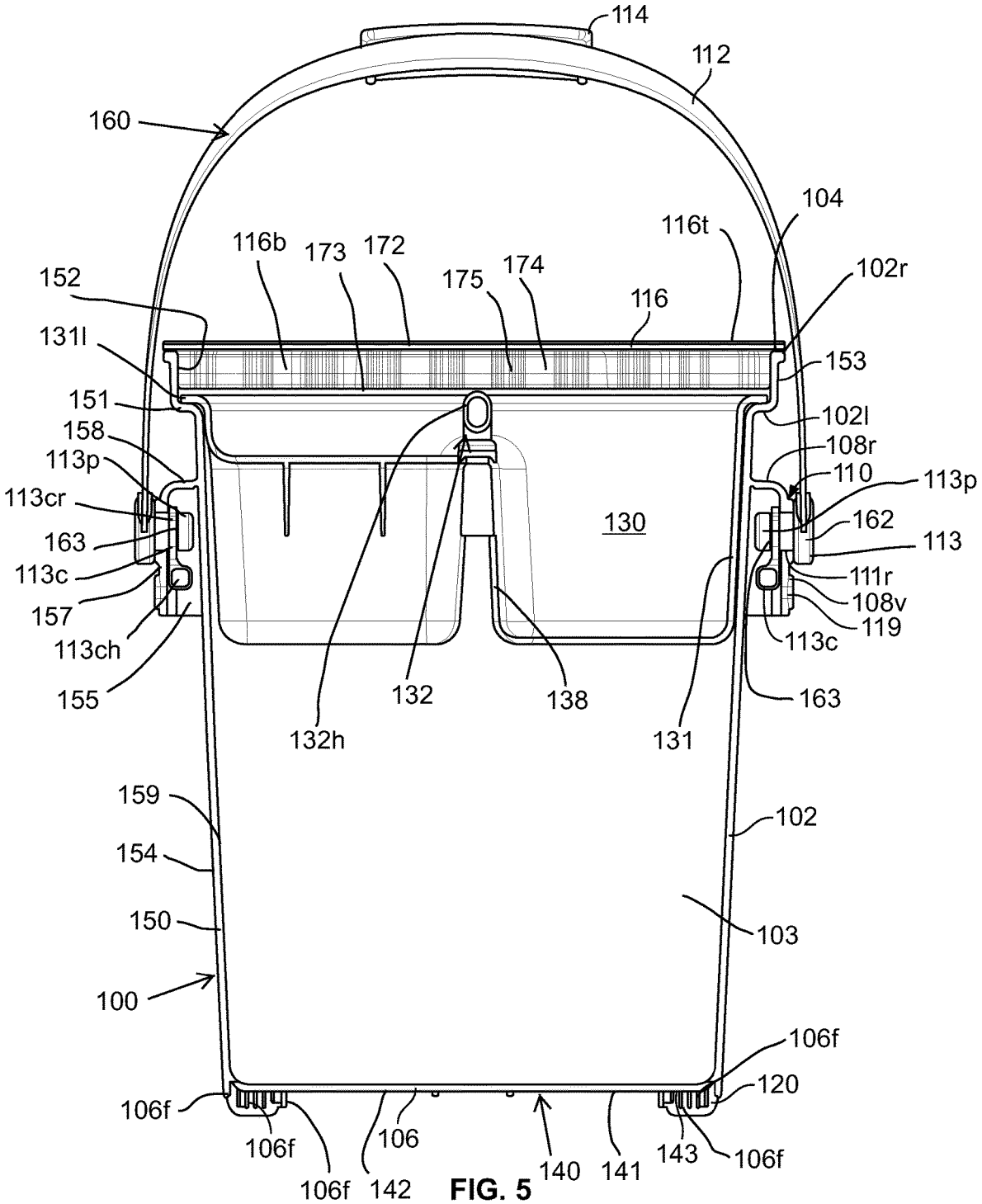
FIG. 5 is another cross-sectional side view of the assembly of FIG. 1, including one embodiment of a drop-in tray according to aspects of the disclosure with the tray having a tray handle shown in a retracted position.

The top 104 of the container 102 is open, and the top 153 of the sidewall 150 has an outer rim **102*r* extending outwardly in one embodiment, as shown in FIGS. 1-10. Also included in the embodiment of the container assembly 100 shown in FIGS. 1-10 are a skirt 108 attached to the outer surface 154 of the sidewall 150, a lid 116, a handle assembly 160 that includes a handle 112 and two connection members 113, and two handle mounts 110 attached to the sidewall 150. In one example, the base 141, the sidewall 150, the handle mounts 110, and the skirt 108 are integrally molded as a single piece. In another embodiment, various features of the container assembly 100 may be insulated, such as by using structures shown and described in U.S. Pat. No. 8,910,819, issued Dec. 16, 2014, and U.S. patent application Ser. No. 14/665,494, filed on Mar. 23, 2015, which are both incorporated herein by reference. For example, in one embodiment, at least the base 141, the sidewall 150, and the lid 116 are insulated. The container 102 may also include a drop-in tray 130, as shown in FIG. 5, which may be supported within the cavity 103 by engaging one or more internal structures of the container 102**.

In the embodiment of FIGS. 1-10, the skirt 108 includes a horizontal and/or radially projecting portion **108*r* and a vertical portion 108*v* extending downward from the periphery of the horizontal portion 108*r*. The vertical skirt portion 108*v* is spaced from the outer surface 154 of the sidewall 150, such that a gap 155 is defined between the vertical skirt portion 108***v* and the outer surface 154 of the sidewall 150. The skirt 108 may also include open ports or slots 109 configured for connection to external components, for example, for use as tie down, or anchoring, ports for securing the container 102 or securing an external component or accessory to the container. The skirt 108 in the embodiment of FIGS. 1-10 has ports 109 defined in the horizontal skirt portion 108*r* and distributed around the periphery of the container 102. As described below, the handle mounts 110 (which may be integral with the skirt 108) may also include additional ports 119. As shown in FIG. 3, the skirt 108 may further include support elements 108*s* to provide radial support for the skirt 108. These support elements 108*s* extend between the outer surface 154 of the sidewall 150 and the vertical skirt portion 108*v* to maintain rigidity and prevent deformation during use. The support elements 108*s* may also be connected to the horizontal skirt portion 108*r* to provide strength to the horizontal skirt portion 108*r* as well.

The container 102 includes one or more handle mounts 110 connected to the outer surface 154 of the sidewall 150, and the embodiment of FIGS. 1-10 includes two handle mounts 110 positioned on opposed sides of the container 102. Each handle mount 110 includes a receptacle 111*r* configured to receive a portion of the handle assembly 160 to connect the handle assembly 160 to the container 102. The receptacles 111*r* are in the form of apertures in one embodiment, but may be formed as a partially-open notch or other suitable structure in other embodiments. Each handle mount 110 in this embodiment has a vertical connecting portion 157 with a receptacle 111*r* defined therein, with the vertical connecting portion 157 being spaced from the sidewall 150 to define a gap 155 between the vertical connecting portion 157 and the outer surface 154 of the sidewall 150. The vertical connecting portion 157 of each handle mount 110 in the embodiment of FIGS. 1-10 has a port 119 therein for connection to external components, as described above. Each mount 110 also has a transverse portion 158 connected to the outer surface 154 of the sidewall 150 in the embodiment of FIGS. 1-5, such that the vertical connecting portion 157 depends from the transverse portion 158. In the embodiment of FIGS. 1-5, the mounts 110 are integrally formed with the skirt 108, such that the transverse portion 158 of each of the mounts 110 is continuous with the horizontal skirt portion 108*r* and the vertical connecting portion 157 of each of the mounts 110 is continuous with the vertical skirt portion 108*v*. The transverse portion 158 in the embodiment of FIGS. 1-10 has an arched shape that arcs upward from the horizontal skirt portion 108*r* on both sides of the mount 110. In this configuration, the gap 155 extends continuously between the skirt 108 and the sidewall 150 and between the mounting portions 110 and the sidewall 150.

The bottom 106 of the container 102 may include a pad 120 as described above, which can be used to provide a limited slip surface or slip-resistant surface. In one embodiment, the pad 120 may be formed of a flexible and/or low durometer material (e.g., rubber or silicone) that is overmolded, or injection molded, onto the base 141. As shown in FIGS. 3 and 5, the pad 120 may be connected at least partially within a cavity or channel 143 formed on the bottom surface 140 of the base 141 in one embodiment. The channel 143 may extend around an outer portion of the base 141, and in the embodiment of FIGS. 1-10, is an annular channel 143 that extends around the central recess 142. The cavity/channel 143 may have a different shape in another embodiment. It is understood that the base 141 may include multiple cavities or channels 143 with pads 120 formed therein. As also illustrated in FIGS. 4-5, the base 141 may include one or more downwardly projecting ribs 106*f* formed on the bottom surface 140 and within the channel 143 (if present). At least some of the rib(s) 106*f* penetrate the material of the pad 120 and are covered by the material forming the pad 120 when the pad 120 is overmolded onto the base 141. The rib(s) 106*f* may provide additional surface area and structure to which the molding material of the pad 120 can bind itself to retain and enhance the connection between the base 141 and the pad 120, as shown in FIG. 4. In one embodiment, as illustrated in FIGS. 4-5, the base 141 includes as one or more ribs 106*f* that penetrate the pad 120 and are completely covered by the pad 120, as well as other ribs 106*f* that define the inner and outer bounds of the channel 143, which may be partially covered by the pad 120. The rib(s) 106*f* defining the channel 143 in FIGS. 4-5 have ridged or textured surfaces 146 facing into the channel 143 to engage and more securely retain the pad 120, and the penetrating rib(s) 106*f* may include such surfaces 146 on one or both sides as well in other embodiments. The rib(s) 106*f* that penetrate the pad 120 in FIGS. 4-5 may be formed to correspond to the shapes of the cavity/channel 143 and/or the pad 120. For example, the rib(s) 106*f* in the embodiment of FIGS. 1-10 may be arranged in an annular arrangement, such as a single annular rib 106*f* or multiple ribs 106*f* arranged in arcs to form an annular or substantially annular structure. The container 102 as shown in FIG. 4 has one or more ribs 106*f* penetrating the material of the pad 120 in an single annular arrangement that extends around the entire channel 143, while the portion of the container 102 in FIG. 5 has additional ribs 106*f* penetrating the material of the pad 120, some or all of which may be arranged in intermittent concentric annular arrangements. Further arrangements of ribs 106*f* may be incorporated into other embodiments.

The handle assembly 160 in the embodiment of FIGS. 1-10 includes a handle 112 and a handle connection structure for removably connecting the handle 112 to the container 102, including one or more handle connection members 113 configured for connection to the handle mounts 110 and fastening members 113*c* configured for connecting the connection members 113 to the handle mounts 110. In one embodiment, the handle 112 may be elongated and flexible, and may include, as an accessory, a removable sliding grip 114. The grip 114 can include a longitudinal gap, or slot, 115 allowing the grip 114 to be removed and replaced, as desired, as well as to enable a user to slide the grip 114 along the length of the handle 112. The handle 112 can, in certain examples, be fabricated from high tensile polyester webbing, but can be in other forms or formed of other materials, such as nylon in the form of a rope-like handle or metal. In one embodiment, the handle 112 is made from a flexible textile material, such as a woven or braided structure or other structure made from interconnected fibers, for example, a polyester or nylon woven textile.

The handle connection members 113 illustrated in FIGS. 1-10 each include a plug 113*p* that is inserted into the receptacles 111*r* on the handle mounts 110. The structure of the handle connection members 113 in this embodiment includes a base body 162 that is connected to one of the ends of the handle 112, with the plug 113*p* extending outwardly from the base body 162. Each plug 113*p* in the embodiment of FIGS. 1-6 has a notch or recess 163 configured for connection to the fastening members 113*c*, as described elsewhere herein. The recess 163 as illustrated in FIGS. 1-6 extends around the entire periphery of the plug 113*p*. It is understood that the handle connection members 113 may have different structures in other embodiments, and may have structures that are complementary with the structures of the handle mounts 110 to facilitate connection.

In one embodiment, the handle connection members 113 may be connected to the handle 112 by overmolding the handle connection members 113 to the ends of the handle 112. The handle connection members 113 in FIGS. 1-10 are each formed of a single molded piece, such that the base body 162 is integrally formed with the plug 113*p*. Such a single-piece handle connection member 113 may be molded onto the end of the handle 112 such that the end of the handle 112 is positioned inside the base body 162. In another embodiment, where the plug 113*p* may be a separate piece connected to the base body 162, the handle connection members 113 may be connected to the handle 112 by overmolding the base body 162 of each handle connection member 113 to the handle 112 and later connecting the plug 113*p* to the base body 162. As described herein, the handle 112 in one embodiment may be made of a textile material, and in this embodiment, the overmolded material forming the handle connection member 113 infiltrates and penetrates between the fibers of the textile material of the handle 112. This overmolded connection structure creates an extremely strong and durable bond without the use of additional fastening components or materials, which add further expense and weight. In other embodiments, the handle connection members 113 may be connected to the handle 112 using a different technique.

The handle connection members 113 are configured for removable connection to the handle mounts 110 on the container 102 to connect the handle 112 and the handle assembly 160 to the container 102. In the configuration illustrated in FIGS. 1-10, the plug 113*p* of the handle connection member 113 is inserted into the receptacle 111*r* of the handle mount 110 on the container. A fastening member 113*c* may be engaged with the plug 113*p* to secure the plug 113*p* in connection with the handle mount 110 and prevent lateral forces on the handle 112 (e.g., during lifting or carrying) from causing the plug 113*p* to be pulled from the receptacle 111*r*. More specifically, the fastening members 113*c* may be connected to the plugs 113*p* of the handle connection members 113 at a location that is beneath the overhang of the handle mount 110 and within the gap 155 between the handle mount 110 and the outer surface 154 of the sidewall 150. This configuration provides protection for the fastening members 113*c*, to resist inadvertent contact that may cause the fastening members 113*c* to become disconnected.

The fastening member 113*c* is illustrated in FIG. 5, and in this embodiment, the fastening member 113*c* is in the form of a retainer clip. The fastening member 113*c* as illustrated in FIG. 5 includes a handle portion or grip portion 113*ch* and two legs 113*cr* extending from the grip portion 113*ch*, where a slot is defined between the legs 113*cr* to facilitate sliding the fastening member 113*c* over the plug 113*p*, such that the legs 113*cr* fit within or otherwise engage the recess 163 on the plug 113*p*. The fastening member 113*c* may be differently configured in other embodiments.

The container assembly 100 can also include a lid 116 removably connected to the top 104 of the container 102 to at least partially cover the opening 152. The lid 116 is illustrated in FIGS. 1 and 5. Referring to FIG. 5, the lid 116 includes a top or upper portion 116*t*, and a bottom or lower portion 116*b* that is at least partially received within the opening 152 when the lid 116 is connected to the container 102. The lower portion 116*b* in the embodiment of FIGS. 1 and 5 includes a seal or gasket 117 that engages the inner surface 159 of the container 102 to provide a seal (e.g., against moisture, external contamination, etc.) between the interior of the container 102 and the external environment when the lid 116 is press-fitted into the opening 152 of the container 102. The gasket 117 also provides a frictional retaining function to retain the lid 116 in place on the container 102.

The lid 116 in the embodiment of FIGS. 1 and 5 has a stepped configuration, such that the peripheral dimension (e.g., diameter) of the upper portion 116*t* is larger than that of the lower portion 116*b*. In this configuration, the lower portion 116*b* fits within the container opening 152, while the upper portion 116*t* is substantially flush with the outer surface 154 of the sidewall 150 at the top 153 of the sidewall 150. In the embodiment of FIGS. 1 and 5, the upper portion 116*t* is substantially flush with the outer surface 154 at the rim 102*r*. It is understood that the upper portion 116*t* may be considered to be flush or substantially flush with the outer surface 154 of the sidewall 150 even if the components are not flush around the entire outer periphery of the container 102. For example, the lid 116 in FIGS. 1 and 5 has a grasping tab 171 extending outward from the edge of the lid 116, and this grasping tab 171 extends further outward of the outer surface 154 of the sidewall 150.

FIGS. 6-13 and 20-27 illustrate an example embodiment of an accessory 200 in the form of a holder or organizer configured for holding various articles, for use with a portable container such as the container 102 shown in FIGS. 1-5 and described herein. FIGS. 14-19, 28-36, and 45-56 depict alternate embodiments of the accessory 200 in the form of a holder or organizer that may also be used with the container 102 and container assembly 100 shown in FIGS. 1-5. It is understood that the accessory 200 in the configurations illustrated herein may be usable with other containers 102, and that the accessory 200 may be modified for use with other containers, such as by changing the dimensions, orientations, and other features without departing from the present disclosure. Additionally, while the accessory 200 is illustrated in the form of a holder or organizer in the embodiments illustrated in FIGS. 6-13 and 20-27, the accessory 200 may have a different configuration in other embodiments, and generally the accessory 200 includes an accessory body that is configured to be connected to a container 102.

The accessory 200 in FIGS. 6-13 includes an accessory body in the form of a jacket 210 configured to extend around at least a portion of the sidewall 150 of the container 102, one or more storage members 220 connected to the jacket 210 and configured to hold various articles, and one or more connection members 250 connected to the jacket 210 and configured for removable connection to the container 102 to support the jacket 210 in connection with the container 102. The accessory 200 may be provided in other configurations in other embodiments, including configurations that include additional components not described herein.

The jacket 210 in the embodiment of FIGS. 6-13 is in the form of a tubular wrap that is configured to extend around the entire sidewall 150 of the container 102 continuously. The jacket 210 is dimensioned similarly to the dimension of the sidewall 150, in order to fit the sidewall 150 closely, and has circular cross-section and a generally frusto-conical or tapered cylindrical shape in this embodiment. In one embodiment, the degree of tapering of the width of the jacket 210 is the same as that of the sidewall 150 of the container 102, so that the jacket 210 can fight tightly against the sidewall 150 of the container 102. In other embodiments, the jacket 210 may have a different configuration, such as a non-tapered cylindrical configuration or a polygonal cross-sectional shape that may include defined corners or defined bend areas where corners can be formed. It is understood that the jacket 210 in FIGS. 6-13 is flexible and may be conformed to different shapes, and that the shape of the jacket 210 may be designed to be complementary to the shape of a particular container 102 with which the accessory 200 is intended to be used. In this configuration, the jacket 210 has a top edge 211, a bottom edge 212, and a main body 213 having inner and outer surfaces 214, 215 and defining a passage 216 configured to receive the container 102 so that the inner surface 214 of the main body 213 confronts the sidewall 150. The main body 213 of the jacket 210 is formed of a flexible material in the embodiment of FIGS. 6-13, such as a fabric/cloth or other woven material, and the jacket 210 may include additional materials forming other components as described herein. For example, in one embodiment, the main body 213 may be formed of a coated polyester cloth material, and in another embodiment, the main body 213 may be formed of a continuous skin of an extruded elastomer material. As another example, FIG. 56 illustrates an embodiment where some or all of the jacket 210, including at least the main body 213 and potentially the storage members 220 and other components, is molded from a polymer material, such as a rubber or polyurethane material. The main body 213 in FIG. 56 may be molded in a tubular structure or molded as a flat piece and connected at the ends to form the tubular structure. In other embodiments, the main body 213 and/or other components of the jacket 210 may be made from other materials or combinations of such materials, including other flexible materials and/or semi-rigid or rigid materials. It is understood that "flexible" and "rigid" as used herein refer to flexibility under shear forces and do not necessarily imply a degree of tensile elasticity or stretchability. In fact, many flexible fabric materials may have low elasticity, while some may have high elasticity, and both low and high elasticity materials may be used in certain embodiments.

The accessory 200 in FIGS. 6-13 includes storage members 220 in the form of storage pockets or compartments 221 connected to the outer surface 215 of the main body 213 of the jacket 210. A "storage member" 220 as described herein may include any structure capable of holding another article for storage. The accessory 200 in FIGS. 6-13 includes four storage compartments 221 distributed at generally regular intervals around the jacket 210, i.e., centered at approximately 90° arcs to each other around the circular main body 213. In other embodiments, the accessory 200 may include storage members 220 of a different number, type, orientation, etc. The accessory 200 in FIGS. 6-13 also includes two sets of loops 222 at opposite sides of the jacket 210, i.e., centered at approximately 180° arcs to each other around the circular main body 213. The loops 222 are capable of holding various components that can be inserted through the loops (e.g., hammers or other tools) and/or may serve as a connection for a hitch, clip, buckle, snap, or other fastener that can be used to connect another article to the accessory 200 (e.g., a carabiner).

The storage compartments 221 may be configured with various components for specific functionality, including internal dividers 223, drain holes 233, auxiliary compartments 237, closures 238, and other such components. The storage compartments 221 in the embodiment of FIGS. 6-13 are all configured differently from each other, and the accessory 200 may be considered to have at least first, second, third, and fourth storage compartments 221*a*, 221*b*, 221*c*, 221*d*. FIGS. 20-27 illustrate the specific features of the four storage compartments 221 of this embodiment individually, and it is understood that additional configurations of storage compartments are possible. It is understood that any features or structural configurations of any of the storage compartments 221 described herein may be incorporated into any of the other storage compartments 221 according to various embodiments. All storage compartments 221 in the embodiments of FIGS. 20-27 are formed of multiple layers 230 of a fabric/cloth material that are folded and stitched to the main body 213 of the jacket 210 to form the storage compartments 221. The storage compartments 221 may be made from the same material as the main body 213 in one embodiment. Examples of materials that may be used for the storage compartments include a coated polyester cloth material, a compression molded foam, or an elastomer. All storage compartments 221 in the embodiments of FIGS. 20-27 also include inserts 231 of a more rigid material (e.g., a rigid plate made of polyethylene or other plastic) to provide shape to the compartments 221 and trim 232 around some or all of the exposed edges to protect the edges. All storage compartments 221 in the embodiments of FIGS. 20-27 further include one or more drain holes 233 extending through the layers 230 (and optionally also the insert 231) and/or extending through the portions of the main body 213 of the jacket 210 located within the compartments 221. The drain holes 233 may be defined by grommets or similar structures. The components of the storage compartments 221 may be connected to each other and/or to the jacket 210 by any suitable technique, and in one embodiment, such techniques include stitching and heat pressing. For example, the stitching of the storage compartments 221 to the main body 213, as well as other stitching connections in the embodiments of FIGS. 6-27, may be performed using woven polyester binding material. In another embodiment, some or all of the storage compartments 221 on the accessory 200 may be substantially identical to each other. In a further embodiment, the accessory 200 may include one or more storage compartments 221 with different and/or additional features.

Figure 20:
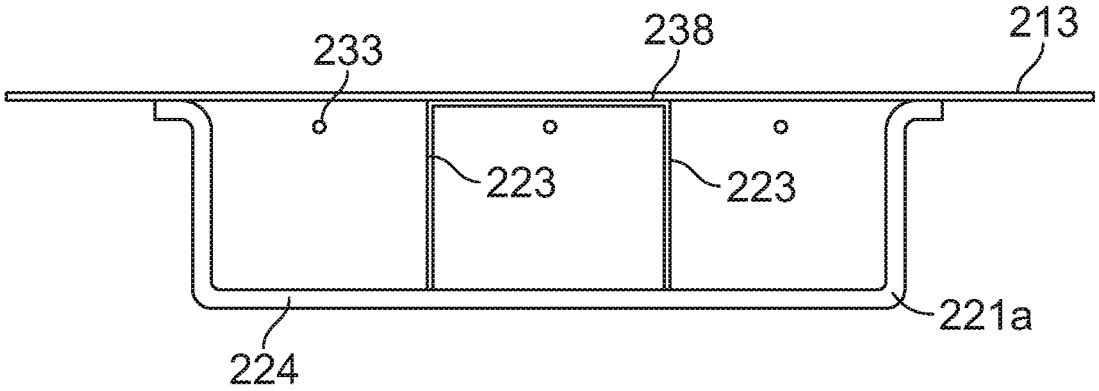
FIG. 20 is a partial top view of the accessory of FIG. 6, showing a first storage pocket of the accessory.
Figure 21:
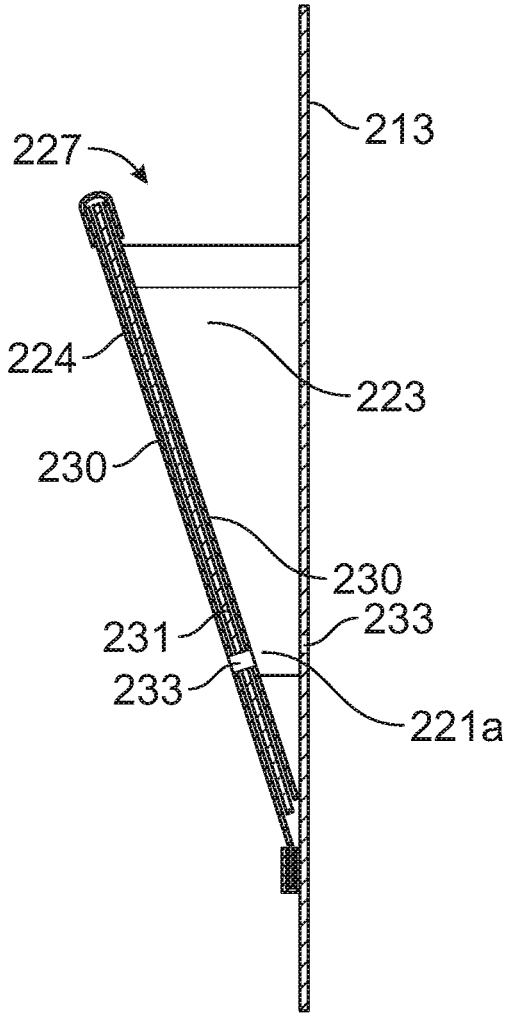
FIG. 21 is a cross-sectional view of the accessory and the first storage pocket of FIG. 20.

FIGS. 20-21 illustrate the first storage compartment 221*a*. As illustrated in FIGS. 20-21, the first storage compartment 221*a* is formed by a first multi-layer fabric member 224 that is stitched to the main body 213 at the bottom 225 and along the edges 226 of the first member 224. The first storage compartment 221*a* has an open top 227, and the compartment 221*a* is configured to open in a triangular configuration, such that the open width of the compartment approaches zero at the bottom 225 and expands in a generally angular manner toward the top 227. The first storage compartment 221*a* in this embodiment has two internal dividers 223 to create three sub-compartments, and the internal dividers 223 are formed by a single divider member 228 that is folded and connected to the walls of the compartment 221*a* to form the two dividers 223. The top of the divider member 228 is folded over and heat pressed to add durability. In another embodiment, the first compartment 221*a* (or any of the other compartments 221) may include closures such as a flap to cover the top 227 of the compartment.

Figure 22:
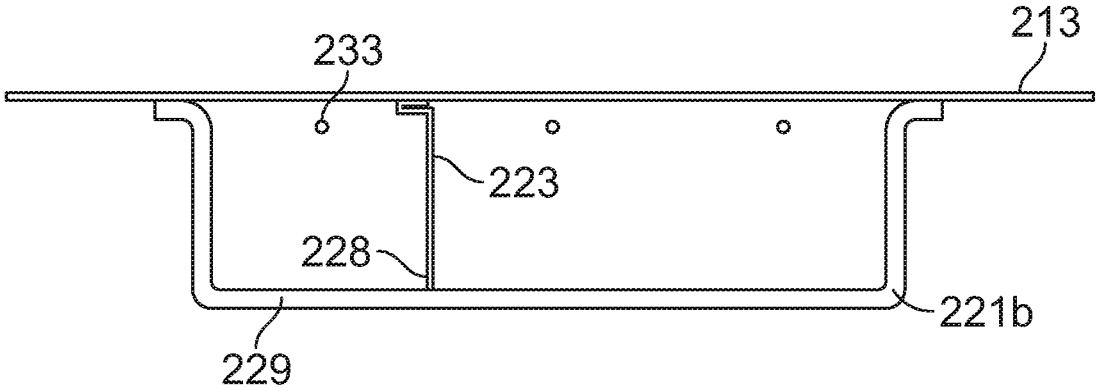
FIG. 22 is a partial top view of the accessory of FIG. 6, showing a second storage pocket of the accessory.
Figure 23:
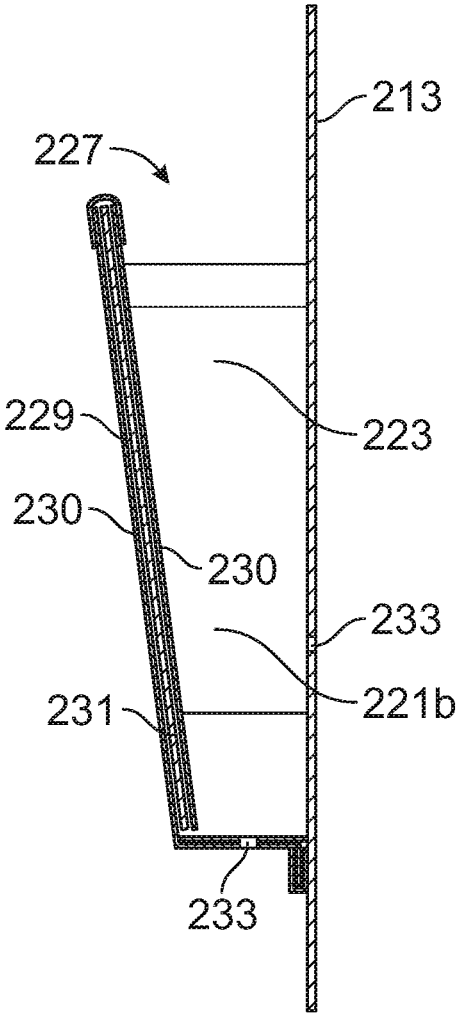
FIG. 23 is a cross-sectional view of the accessory and the second storage pocket of FIG. 22.

FIGS. 22-23 illustrate the second storage compartment 221*b*. As illustrated in FIGS. 22-23, the second storage compartment 221*b* is formed by a second multi-layer fabric member 229 that is stitched to the main body 213 at the bottom 225 and along the edges 226 of the second member 229. The second storage compartment 221*b* has an open top 227, and the compartment 221*b* is configured to open in a trapezoidal configuration, such that the bottom 225 of the compartment 221*b* extends outwardly from the jacket 210 and open width of the compartment expands in a generally angular manner toward the top 227. The second storage compartment 221*b* in this embodiment has one internal divider 223 to create two sub-compartments having different sizes, and the internal divider 223 is formed by a single divider member 228 that is folded and connected to the walls of the compartment 221*b* to form the divider 223. The top of the divider member 228 is folded over and heat pressed to add durability.

Figure 24:
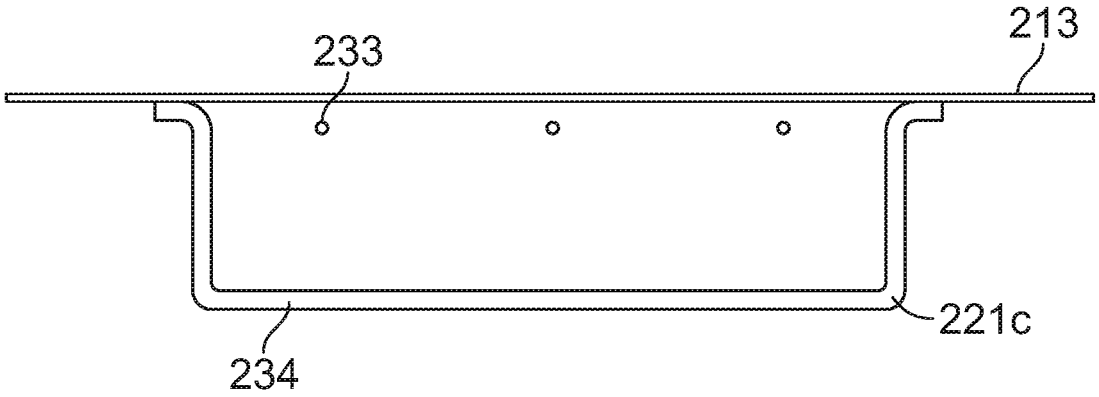
FIG. 24 is a partial top view of the accessory of FIG. 6, showing a third storage pocket of the accessory.
Figure 25:
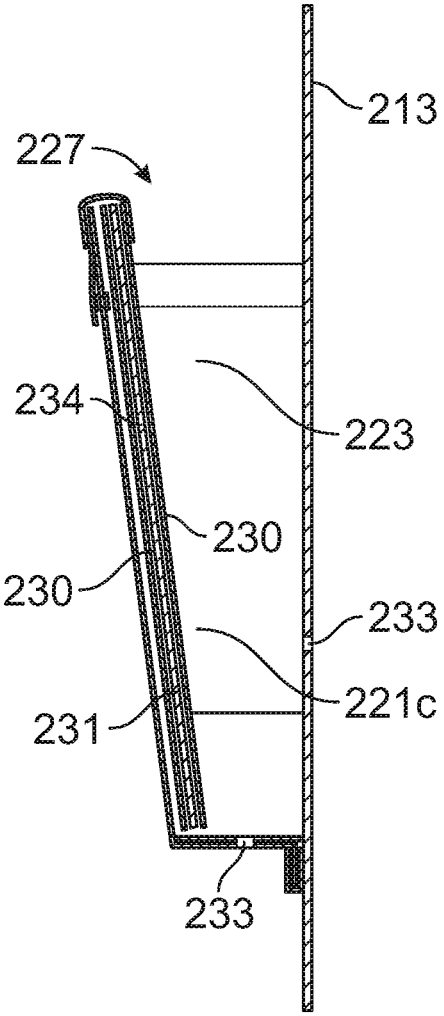
FIG. 25 is a cross-sectional view of the accessory and the third storage pocket of FIG. 24.

FIGS. 24-25 illustrate the third storage compartment 221*c*. As illustrated in FIGS. 24-25, the third storage compartment 221*c* is formed by a third multi-layer fabric member 234 that is stitched to the main body 213 at the bottom 225 and along the edges 226 of the third member 234. The third storage compartment 221*c* has an open top 227, and the compartment 221*c* is configured to open in a trapezoidal configuration, such that the bottom 225 of the compartment 221*c* extends outwardly from the jacket 210 and open width of the compartment expands in a generally angular manner toward the top 227. The third storage compartment 221*c* in this embodiment has no internal dividers, and includes an auxiliary compartment 237 defined by one or more additional layers 230 of the material on the outer side of the compartment 221*c*. The auxiliary compartment 237 is completely separate from the compartment 221*c* in the embodiment illustrated, but may be connected in another embodiment. The auxiliary compartment 237 further includes a closure 238 in the form of a zipper, with a flap 235 to cover the closure and protect the closure 238 from the elements. A different type of closure 238 may be used in another embodiment, and the flap 235 may be used without the closure 238 or vice versa.

Figure 26:
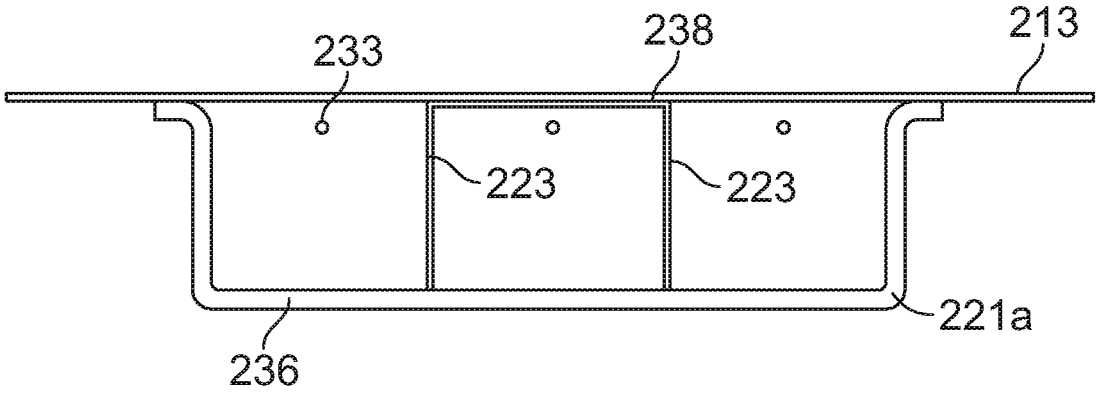
FIG. 26 is a partial top view of the accessory of FIG. 6, showing a fourth storage pocket of the accessory.
Figure 27:
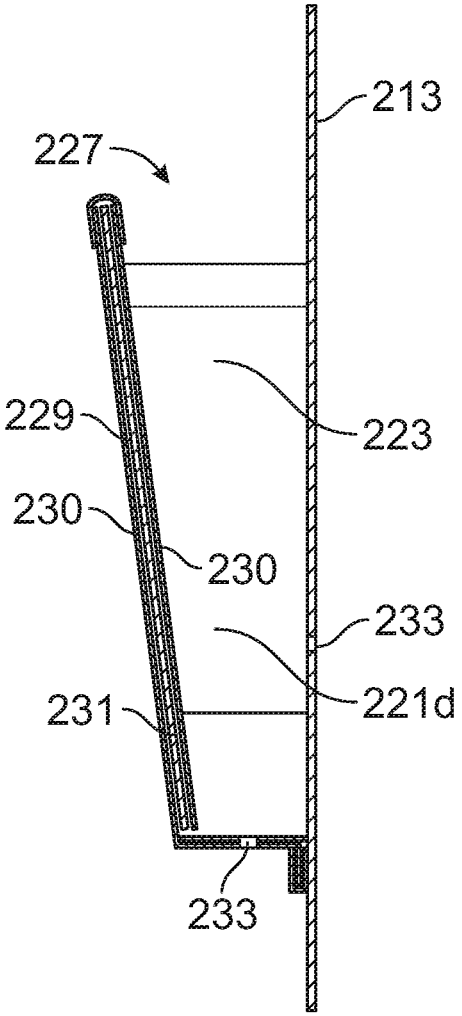
FIG. 27 is a cross-sectional view of the accessory and the fourth storage pocket of FIG. 26.

FIGS. 26-27 illustrate the fourth storage compartment 221*d*. As illustrated in FIGS. 26-27, the fourth storage compartment 221*d* is formed by a fourth multi-layer fabric member 236 that is stitched to the main body 213 at the bottom 225 and along the edges 226 of the fourth member 236. The fourth storage compartment 221*d* has an open top 227, and the compartment 221*d* is configured to open in a trapezoidal configuration, such that the bottom 225 of the compartment 221*d* extends outwardly from the jacket 210 and open width of the compartment 221*d* expands in a generally angular manner toward the top 227. The fourth storage compartment 221*d* in this embodiment has two internal dividers 223 to create three sub-compartments, and the internal dividers 223 are formed by a single divider member 228 that is folded and connected to the walls of the compartment 221*b* to form the dividers 223. The top of the divider member 228 is folded over and heat pressed to add durability.

In another embodiment, the storage compartments 221 and the dividers 223 may be connected to the main body 213 of the jacket 210 in another manner. For example, FIG. 56 illustrates an embodiment where the storage compartments 221 and the dividers 223 are molded integrally with the main body 213 of the jacket 210. In this embodiment, the main body 213 may be molded in a cylindrical or frusto-conical shape, or the main body 213 may be molded as a flat piece connected together at its ends, similar to the flat piece 240 of FIGS. 11-12. The receiving members 257 or other releasable connecting structure may be subsequently connected to the jacket 210, such as by stitching, adhesive, welding, etc. The jacket 210 in FIG. 56 is otherwise similar in construction to the jacket 210 of FIGS. 6-13, and will not otherwise be described in detail herein. As another example, a jacket 210 as shown in FIG. 56 may be manufactured by molding the main body 213 separately from the storage compartments 221 and the dividers 223 and subsequently connecting the storage compartments 221 and the dividers 223 to the main body 213, such as by welding, stitching, or adhesive. In this configuration, all of the storage compartments 221 and the dividers 223 may be formed by a single, continuous molded piece that is connected to the main body 213.

Figure 10:
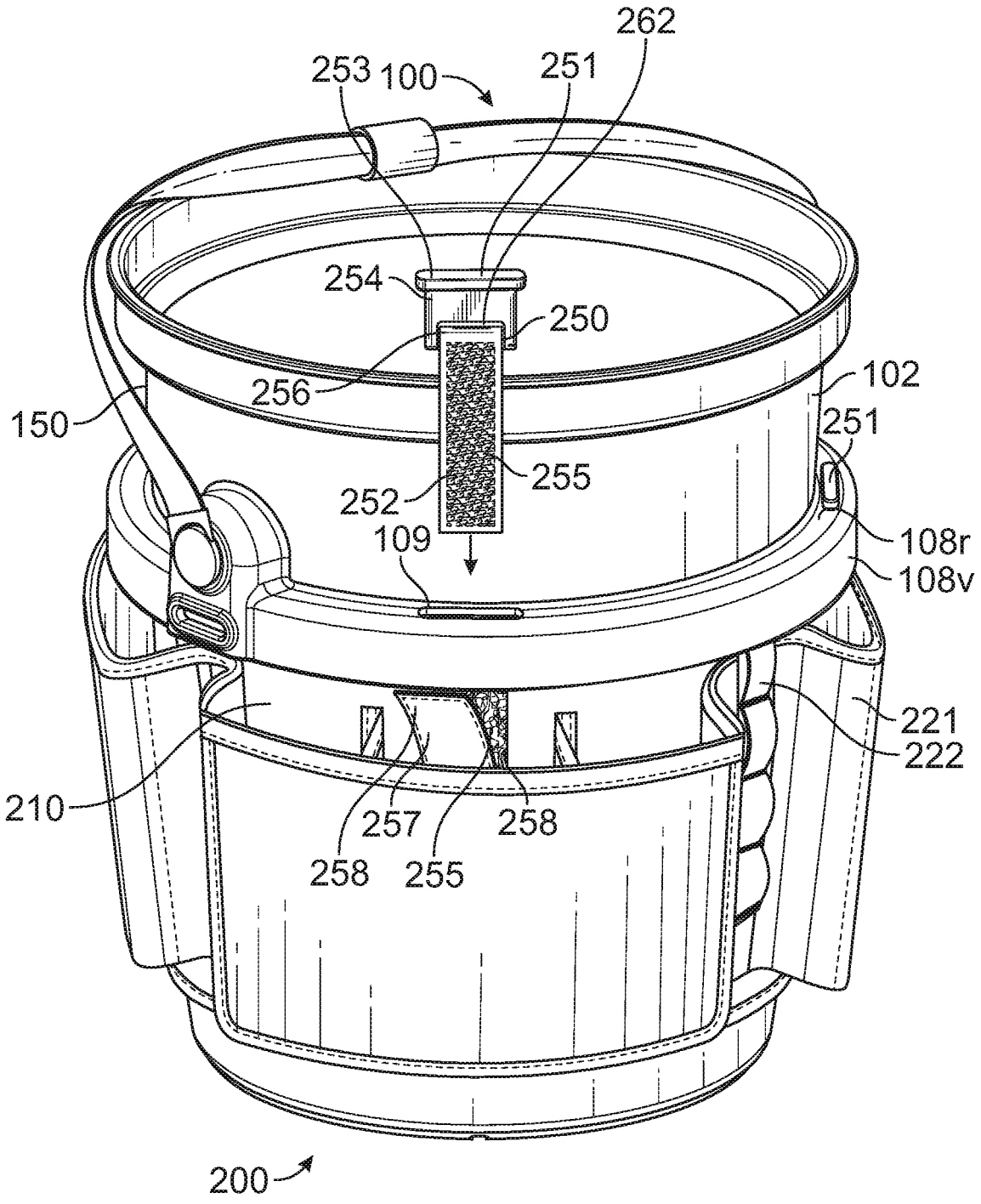
FIG. 10 is an upper perspective view of the assembly of FIG. 6, illustrating connection of a connection member to the accessory.
Figure 11:
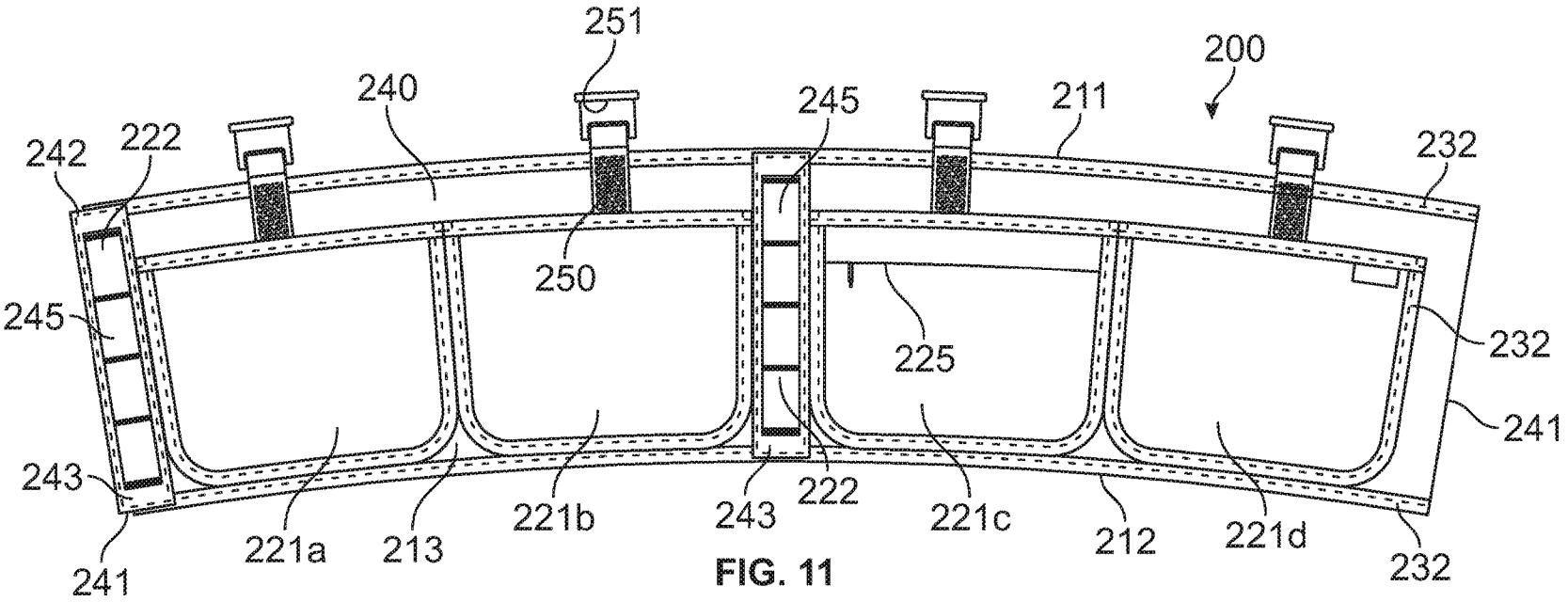
FIG. 11 is a plan view of the accessory of FIG. 6 in a partially-assembled state.

The main body member 213 of the jacket 210 in the embodiment of FIGS. 6-13 is formed from a flat piece 240 that is wrapped and connected at its ends 241 to form the tubular jacket 210. The flat piece 240 in this embodiment is illustrated in FIG. 11 and is formed of a single, integral piece of fabric material that may be a single-layer or multi-layer piece, to create a continuous wrap. In other embodiments, the main body member 213 may be made from discontinuous pieces of material, such as multiple pieces that are stitched at their edges or spaced from each other and connected around the periphery by straps or other connections (permanent or releasable). As shown in FIG. 11, the flat piece 240 has top and bottom edges 211, 212 that are have an arc configuration, so that the assembled main body member 213 and jacket 210 have a tapered width. The flat piece 240 may have a different shape in another embodiment, in order to create a jacket 210 with a desired shape. The ends 241 of the flat piece 240 are connected by stitching in one embodiment, but may be joined by other techniques in other embodiments. Once assembled, the top surface and the bottom surface of the flat piece 240 as shown in FIG. 11 form the outer surface 215 and the inner surface 214, respectively, of the main body member 213. As shown in FIG. 11, the flat piece 240 may be manufactured with all or substantially all components connected thereto prior to connecting the ends 241 to form the main body member 213. In other embodiments, some or all components may be connected to the main body member 213 after assembly of the main body member 213.

Figure 12:
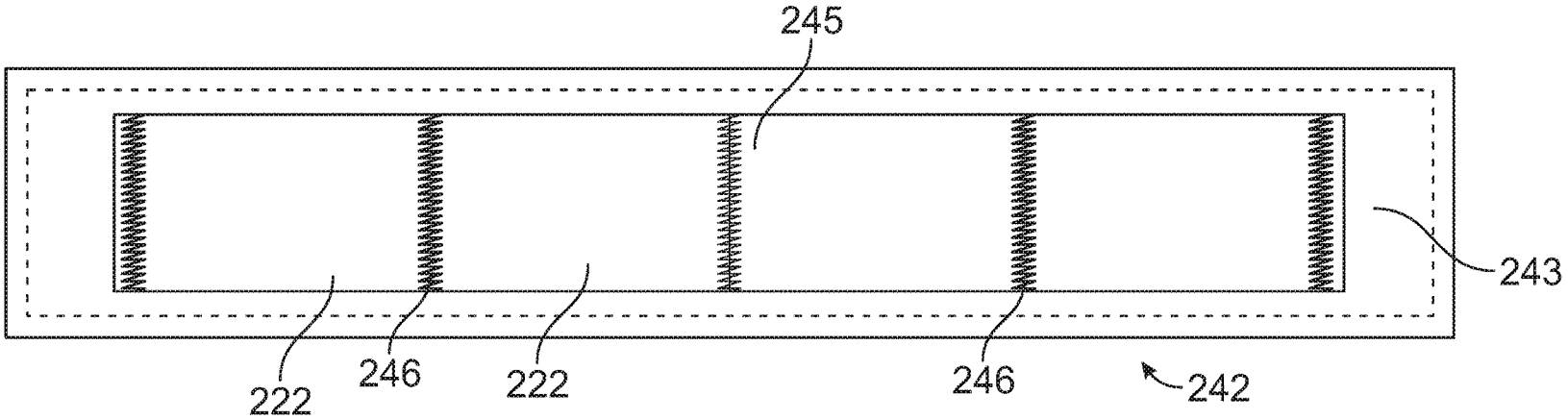
FIG. 12 is a plan view of a seam cover of the accessory of FIG. 6.

In the embodiment shown in FIGS. 6-13, the main body member 213 may have a cover 242 covering the seam or other connection between the ends 241 of the flat piece 240. One embodiment of the cover 242 is shown in FIG. 12. In this embodiment, the cover 242 is formed by a patch 243 of a tough, durable woven material to protect the connection. Additionally, in this embodiment, the cover 242 is formed as a loop assembly that includes the patch 243 as well as a loop member 245 that includes one or more loops 222 as described herein. The loop member 245 in this embodiment is provided in a MOLLE loop configuration, which is formed by a strip of a fabric material (e.g., a woven nylon material) that is sewn or otherwise connected at several binding points 246 to create the loops 222. The strip of material forming the loop member 245 may be provided as a single strip connected to the patch 243 at the binding points 246 or as a loop connected to itself at the binding points 246. As shown in FIGS. 6-13, a second loop assembly (including the cover 242 and the loop member 245) may be connected to the jacket 210 at the opposite side of the jacket 210 as the connection between the ends 241 of the flat piece 240. In another embodiment, one or more loop members 245 may be connected to the jacket 210 separately from any cover 242 or similar structure.

The accessory 200 may include one or more connection members 250 connected to the jacket 210 and configured for removable connection to the container 102 to support the accessory 200 from the container 102. The connection member(s) 250 in one embodiment may be connected to the outer surface of the sidewall 150 of the container 102 at a location spaced downwardly from the top of the sidewall 150 and/or the top of the container 102. In one embodiment, the accessory 200 includes a plurality of connection members 250. Each connection member 250 includes a connector 251 that is configured for connection to the container 102, and in the embodiment shown in FIGS. 6-13, each connector 251 is configured for connection to a port 109 on the container 102. The connector 251 in FIGS. 6-13 is configured for connection such that a portion of the connector 251 is received within the port 109, but may connect to the port 109 in a different configuration in another embodiment. The container 102 may include multiple ports 109, and the number of connection members 250 may be equal to the number of ports 109 in one embodiment. The accessory 200 in the embodiment of FIGS. 6-13 has four connection members 250 positioned at approximately equal intervals around the periphery of the jacket 210, i.e., at approximately 90° arcs to each other around the periphery of the main body 213, and the container 102 has four ports 109 positioned with approximately the same relationship around the skirt 108. The ports 109 are illustrated as being enclosed apertures extending completely through a horizontal wall (the horizontal portion 108*r* of the skirt 108), but in other embodiments, the port(s) 109 may have a different configuration. As one example, the port(s) 109 be formed in a vertical wall (e.g. the vertical portion 108*v* of the skirt 108) or a wall having a different orientation. As another example, the port(s) 109 may not extend completely through the wall, such as being a recessed cavity or similar structure. As a further example, the port(s) 109 may not be completely defined or enclosed by the structure, such as an aperture or cavity with a slot such that a portion of the connector 251 may slide into and/or engage with the slot.

Figure 6:
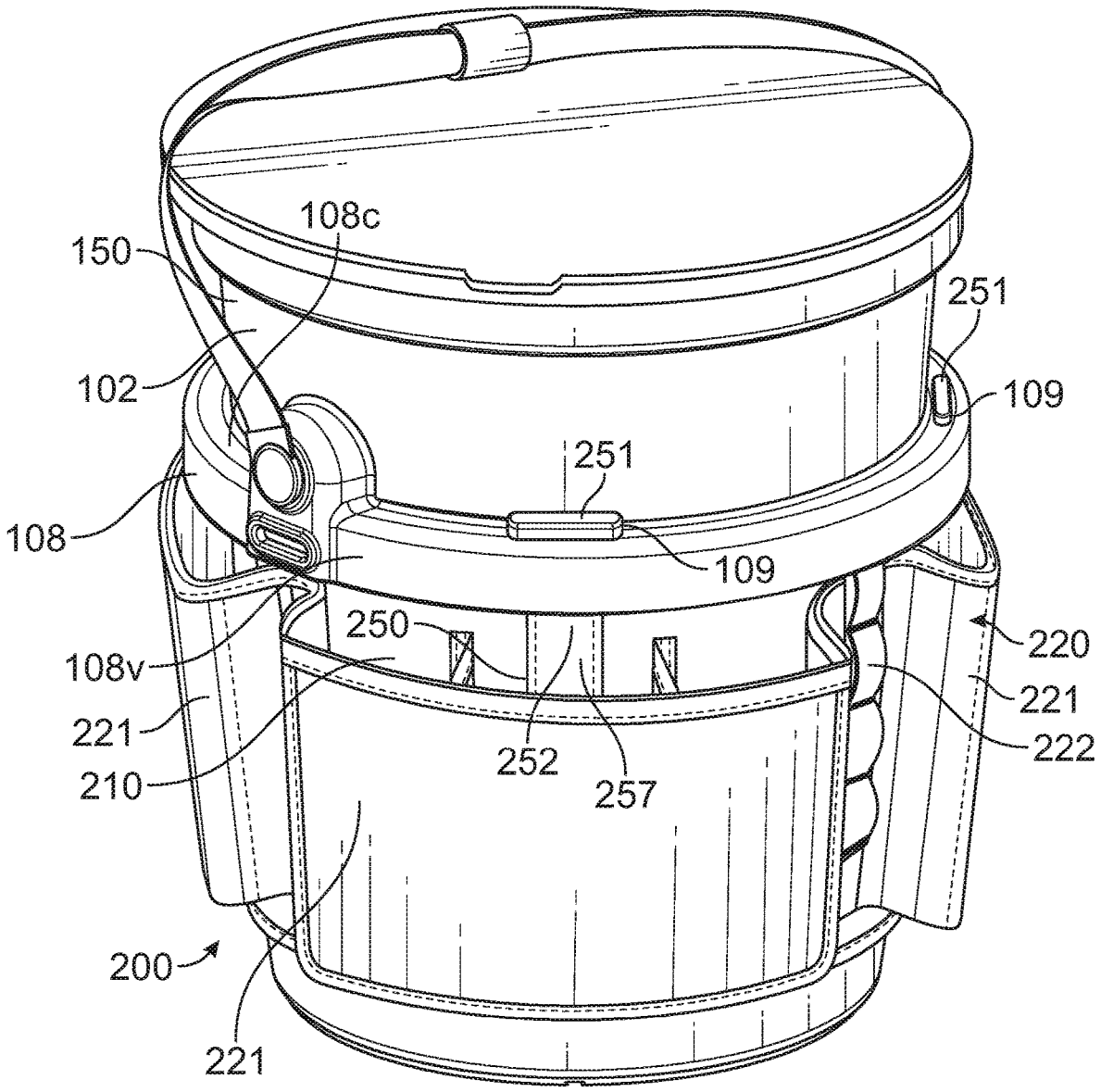
FIG. 6 is an upper perspective view of the assembly of FIG. 1 with one embodiment of an accessory connected to the container in accordance with aspects of the disclosure.
Figure 7:
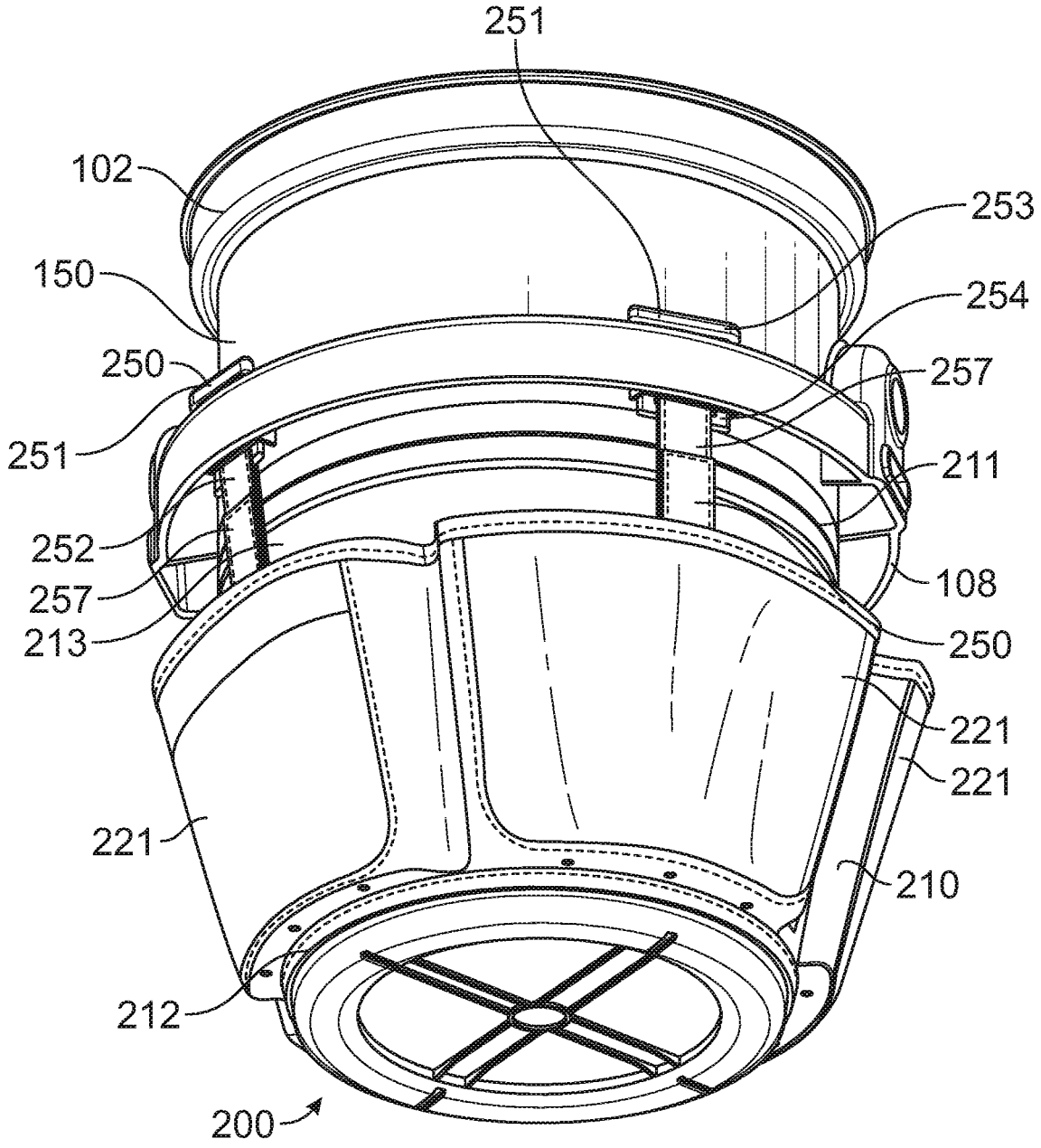
FIG. 7 is a lower perspective view of the assembly of FIG. 6.

The connector 251 in the embodiment of FIGS. 6-13 is formed in a generally T-shaped configuration, with an enlarged head 253 and a narrower stem 254 depending from the head 253. In one embodiment, the head 253 is enlarged with respect to the stem 254 in both lateral dimensions (i.e., length and width), as shown in FIGS. 6, 7, and 10. Additionally, the head 253 may be enlarged with respect to the port 109 in one or both lateral dimensions so the head 253 cannot fit through the port 109. In this configuration, the head 253 of the connector 251 sits on top of the port 109, and the stem 254 extends downward through the port 109. The head 253 of the connector 251 may be engaged with the structure on which the port 109 is located, i.e., the top surface of the horizontal portion 108*r* of the skirt 108 in the embodiment of FIGS. 6-13. The connector 251 may be formed of any suitable material, and in one embodiment, the connector may be formed of molded polyoxymethylene (PMO), also known as acetal, but may be made from other materials in other embodiments, including other polymer materials using a variety of techniques such as milling, molding/casting, stamping, or other method. The connector 251 may be provided in different configurations in other embodiments, including different configurations configured for engagement with the ports 109 as shown in FIGS. 1-10 and/or configured for engagement with other ports 109. FIGS. 14-19 illustrate examples of different configurations of connectors 251, as described elsewhere herein. It is understood that the connector 251 may be configured to have structure that is complementary to the port 109 with which the connector 251 is engaged.

Each connection member 250 in the embodiment of FIGS. 6-13 is removably connected to the jacket 210. In one embodiment, each connection member 250 includes a strap 252 connected to the connector 251 and removably connected to the jacket 210. The strap 252 is connected to the stem 254 of the connector 251 in one embodiment, and the strap 252 may further be removably connected to the connector 251 if desired. The strap 252 is connected to the jacket 210 at one end and has a loop 256 at the other end that is connected to the connector 251 by extending through a slot 262 in the stem 254 in the embodiment shown in FIGS. 8 and 13. As shown in FIGS. 6-8 and 10, when the connector(s) 251 are connected to the container 102 in this embodiment, the jacket 210 hangs from the straps 252 such that the accessory 200 is supported by the straps 252. Each connector 251 may be connected to the respective port 109 in this embodiment by removing the strap 252, threading the strap 252 and a portion of the stem 254 of the connector 251 downward through the port 109, and then reconnecting the strap 252 to the jacket 210.

Figure 8:
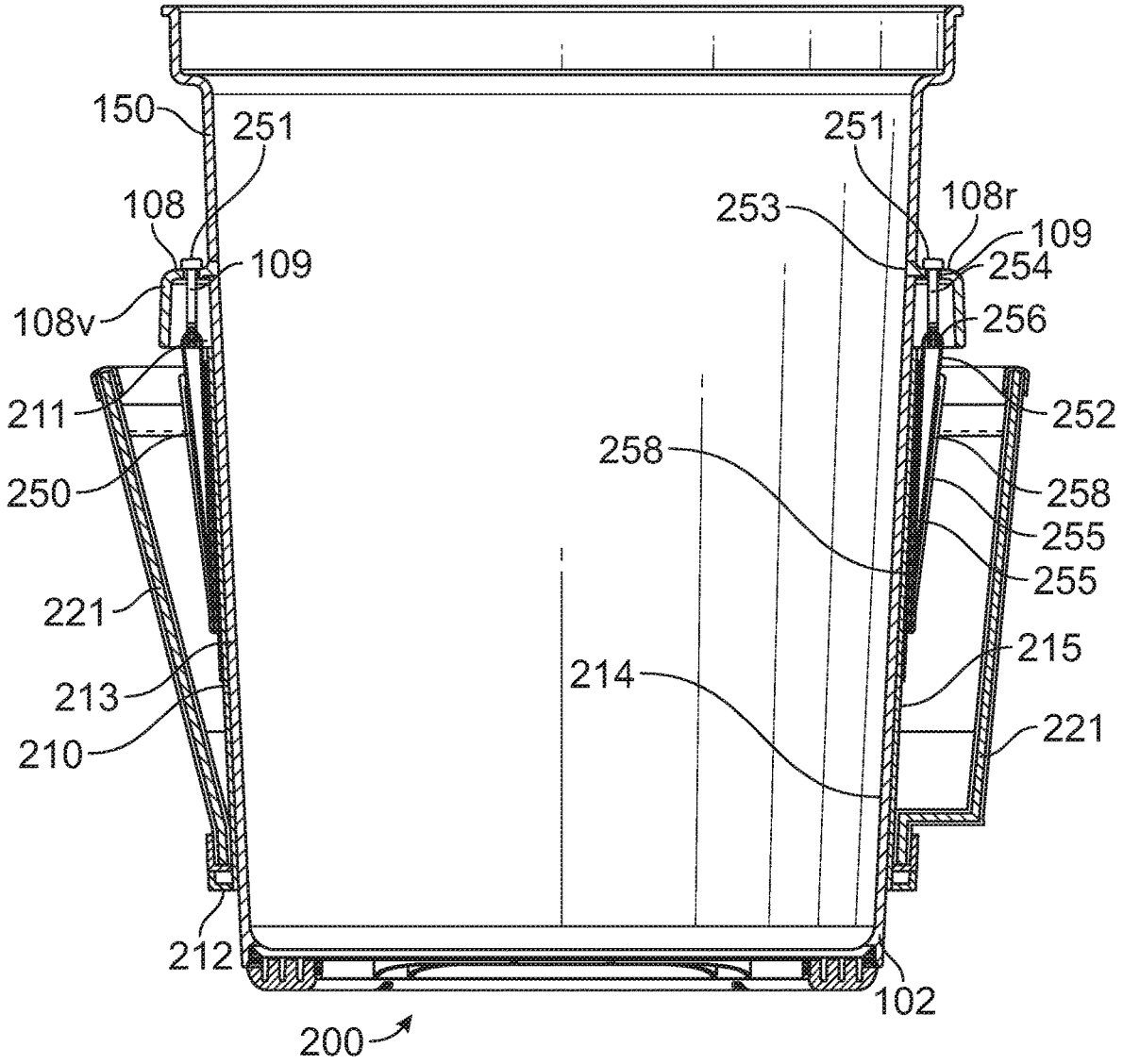
FIG. 8 is a cross-sectional view of the assembly of FIG. 6.
Figure 9:
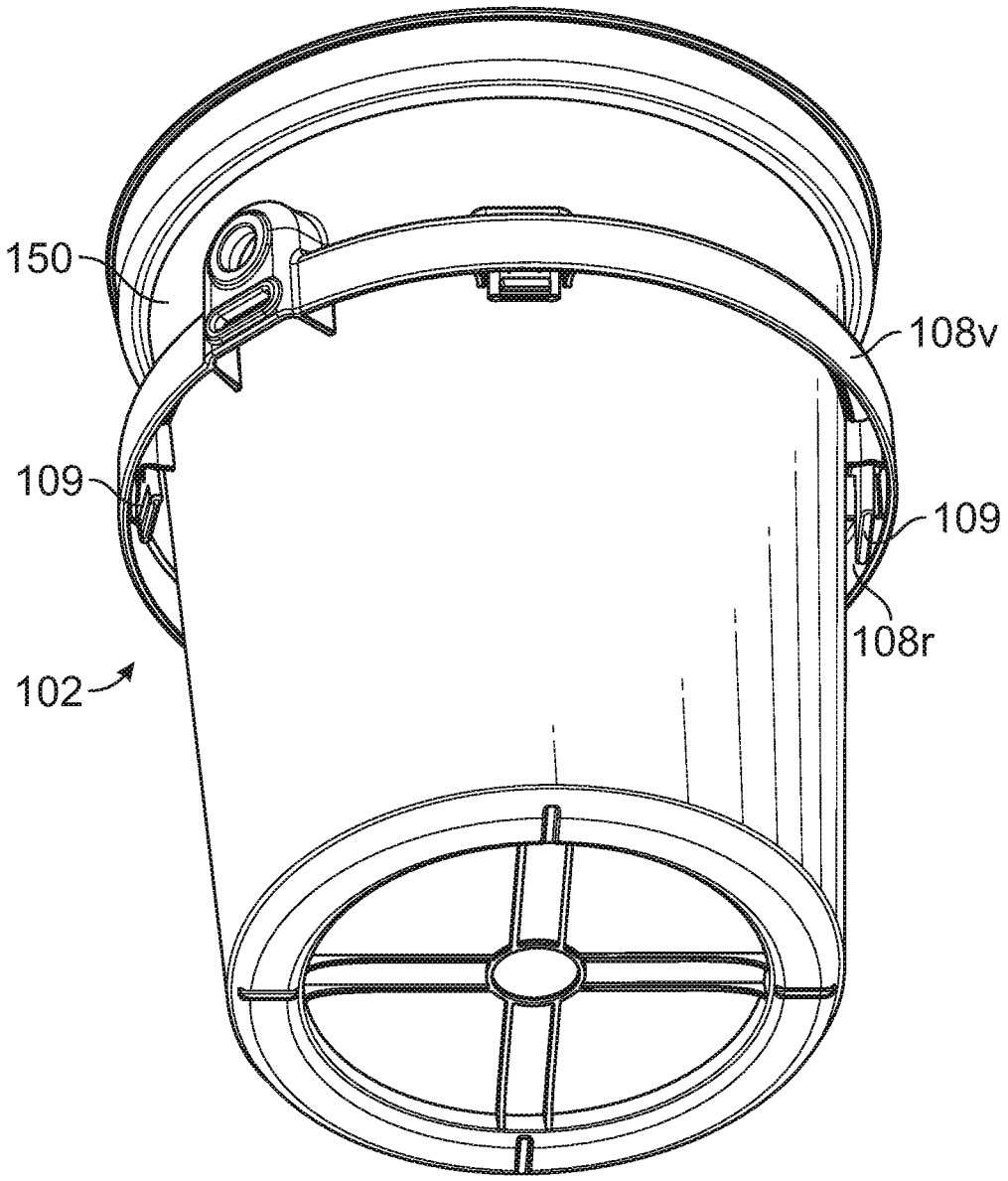
FIG. 9 is a lower perspective view of the container of the assembly of FIG. 1.
Figure 13:
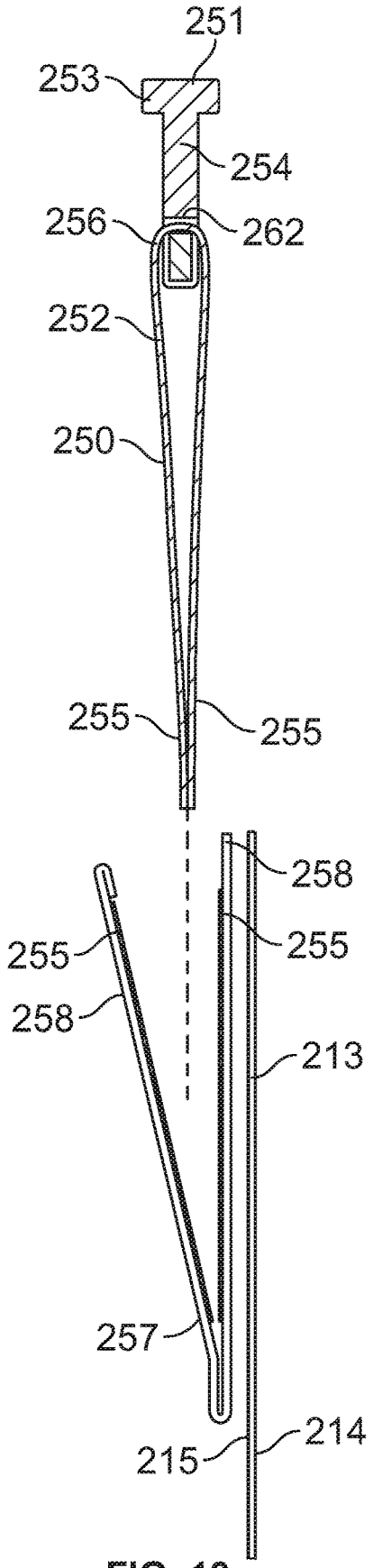
FIG. 13 is a partial cross-sectional view of the accessory of FIG. 6, illustrating connection of the connection member to the accessory.

In the embodiment of FIGS. 6-13, the strap 252 removably connects to the jacket 210 by a releasable connecting structure in the form of hook-and-loop connecting structures 255. As shown in FIGS. 10 and 13, the strap 252 and the jacket 210 have complementary hook-and-loop connecting structures 255. The hook-and-loop connecting structure 255 of the strap 252 is provided on both opposed outer surfaces of the strap 252 and the hook-and-loop connecting structure 255 of the jacket 210 is provided within a receiving member 257 that is connected to the jacket 210, as shown in FIGS. 8, 10, and 13. The receiving member 257 in this embodiment is a v-shaped structure that has two separable arms 258, with the hook-and-loop connecting structure 255 connected to both confronting interior faces of the v-shaped structure. As illustrated in FIGS. 10 and 13, the strap 252 can be connected to the receiving member 257 by pulling one arm 258 away to open up the v-shaped receiving member 257, inserting the end of the strap 252 so that the complementary hook-and-loop connecting structures 255 engage each other, then pressing the arm 258 back toward the other arm 258 to close the receiving member 257 and establish the connection. The configuration of the strap 252 and the receiving member 257 is such that a desired portion of the length of the strap 252 can be inserted in the receiving member 257, thereby permitting the position of the connector 251 relative to the jacket 210 to be adjusted. In one embodiment, the straps 252 may be inserted into the receiving members 257 at a length such that the jacket 210 is pulled tightly against the container 102. In this configuration, the connection members 250 and the jacket 210 exert opposite forces on each other, so that the jacket 210 does not move with respect to the container 102 in any orientation of the container 102. It is noted that the receiving members 257 in the embodiment of FIGS. 6-13 are connected to the jacket 210 such that some or all of each receiving member 257 is positioned within one of the storage compartments 221. This configuration maximizes the available vertical space for the connection, allowing a large/long contact area between the strap 252 and the receiving member 257 without requiring the jacket 210 to hang excessively below from the port 109. Other releasable connecting structures for removably connecting the connection member 250 and/or the strap 252 thereof to the jacket 210 may differ in other embodiments may be used in other embodiments, including various different fasteners such as hooks, loops, buckles, tabs, hitches, clips, snaps, etc.

Figure 14:
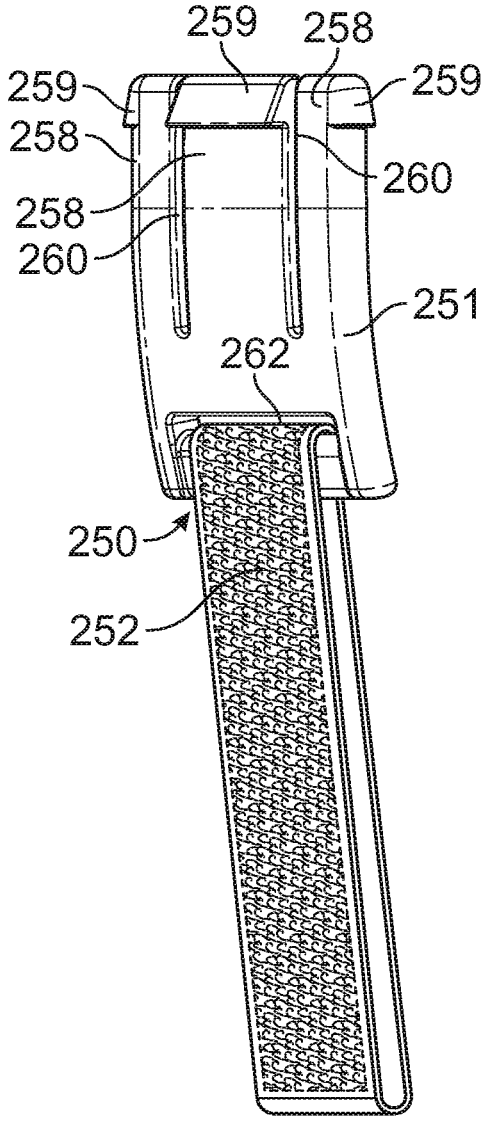
FIG. 14 is a perspective view of another embodiment of a connection member in accordance with aspects of the disclosure.
Figure 15:
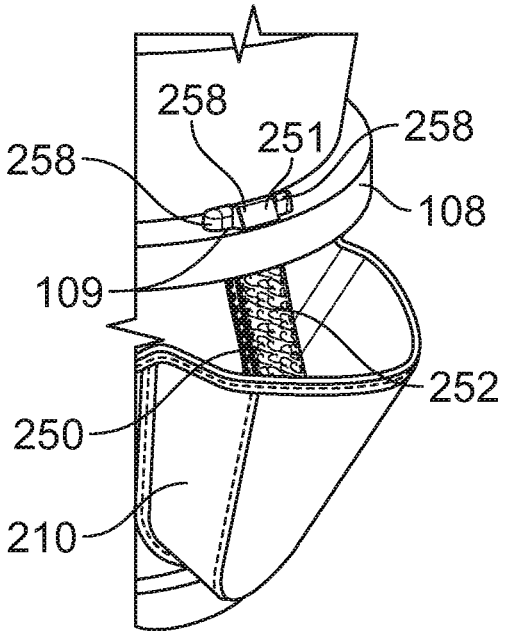
FIG. 15 is a partial upper perspective view of the assembly of FIG. 6 including the connection member of FIG. 14.
Figure 16:
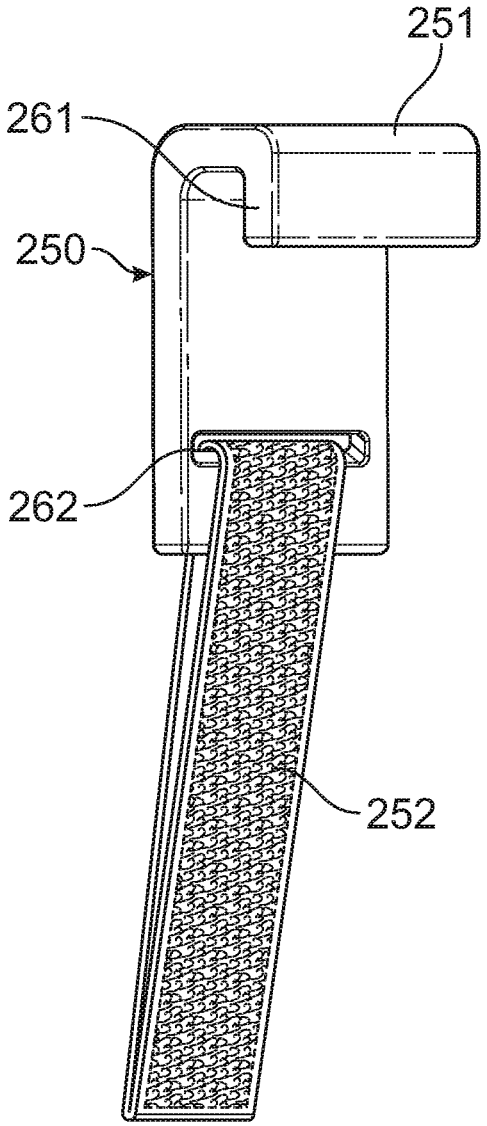
FIG. 16 is a perspective view of another embodiment of a connection member in accordance with aspects of the disclosure.
Figure 17:
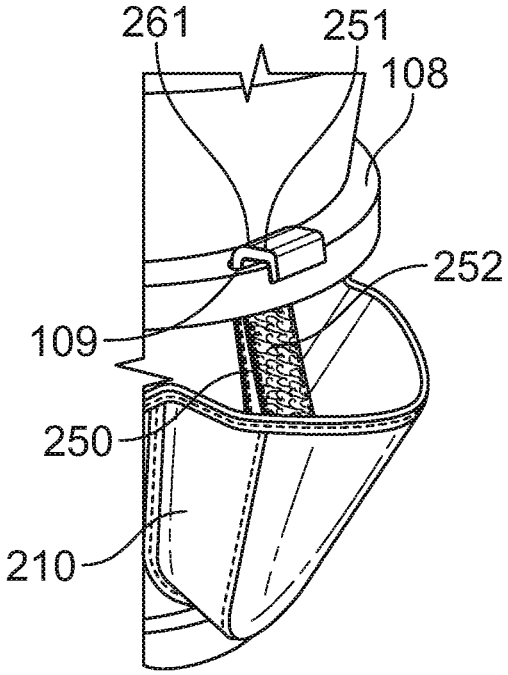
FIG. 17 is a partial upper perspective view of the assembly of FIG. 6 including the connection member of FIG. 16.
Figure 18:
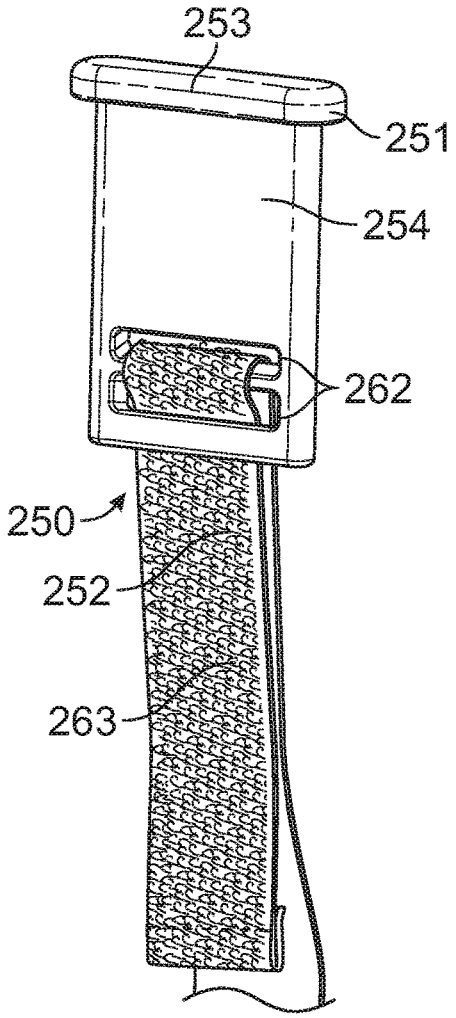
FIG. 18 is a perspective view of another embodiment of a connection member in accordance with aspects of the disclosure.
Figure 19:
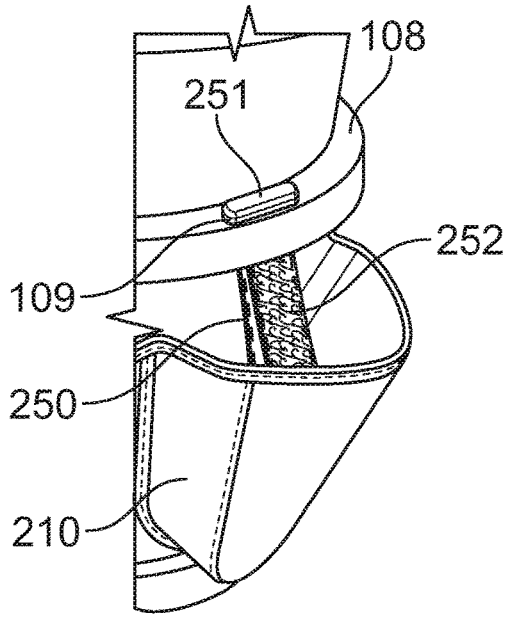
FIG. 19 is a partial upper perspective view of the assembly of FIG. 6 including the connection member of FIG. 18.

FIGS. 14-19 illustrate additional embodiments of connectors 251 that are usable with the connection member 250 and the port 109 shown in FIGS. 6-13. FIGS. 14-15 illustrate an embodiment of a connector 251 that includes one or more flexible tabs 258 that are configured to permit upward insertion into the port 109. The tabs 258 have ramp surfaces 259 that engage a portion of the port 109 to force the tabs 258 to flex when inserted into the port 109 and gaps 260 between the tabs 258 that permit the tabs 258 room to flex. In this configuration, the tabs 258 are configured to retain the connector 251 within the port 109. FIGS. 16-17 illustrate an embodiment of a connector 251 that includes a hook member 261 that is configured to permit upward insertion into the port 109. The hook member 261 is inserted into the port 109 and rotated to engage the hook member 261 with the skirt 108 to support the accessory 200. The strap 252 can be connected to the connector 251 in FIGS. 14-15 and the connector 251 in FIGS. 16-17 in the same manner as illustrated in FIGS. 6-13. FIGS. 18-19 illustrate an embodiment of a connector 251 that is configured with an enlarged head 253 and a stem 254 as described herein with respect to FIGS. 6-13, where the stem 254 is longer than the stem 254 illustrated in FIGS. 6-13, and the stem 254 has two slots 262. The strap 252 in this embodiment has a loose tag end 263, and the use of two slots 262 permits the length of the strap 252 to be adjusted by sliding the connector 251 along the length of the strap 252, while a tension locking arrangement prevents undesired sliding of the strap 252 with respect to the connector 251 when the strap 252 is in tension. The strap 252 can also be disconnected from the connector 251 using this same mechanism in one embodiment, but may contain a thickened portion at the tag end 263 to prevent the tag end 263 from being pulled through the slots 262 in another embodiment. The connectors 251 in FIGS. 14-19 permit the straps 252 to be permanently connected to the jacket 210 if so desired. In a further embodiment, the connectors 251 of FIGS. 6-13 or FIGS. 18-19 may be configured for upward insertion through the port 109 to permit the straps 252 to be permanently connected to the jacket 210, such as by being made of a material that is sufficiently flexible to permit upward insertion into the port 109 while being sufficiently strong to support the weight of the accessory 200 and any articles supported by the accessory 200. It is further noted that the example embodiments of the connector 251 illustrated herein are formed as a separate piece from the strap 252, but that in other embodiments, a portion of the strap 252 may serve as the connector 251, such as a releasable loop fastened by a button, hook, tab, hook-and-loop structure, or other releasable connection.

Figure 47:
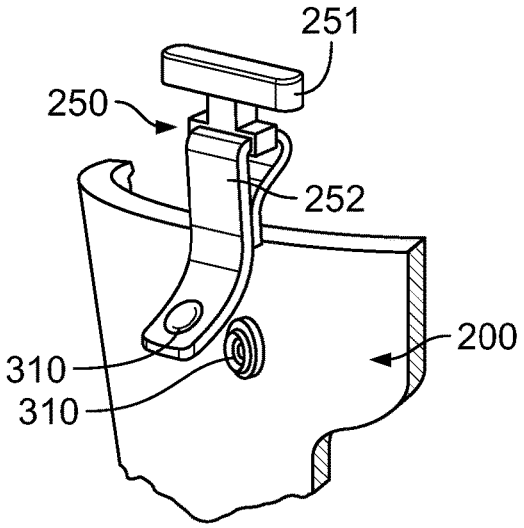
FIG. 47 is a perspective view of another embodiment of a connection member in accordance with aspects of the disclosure, with a portion of a container sidewall configured for connection to the connection member.
Figure 48:
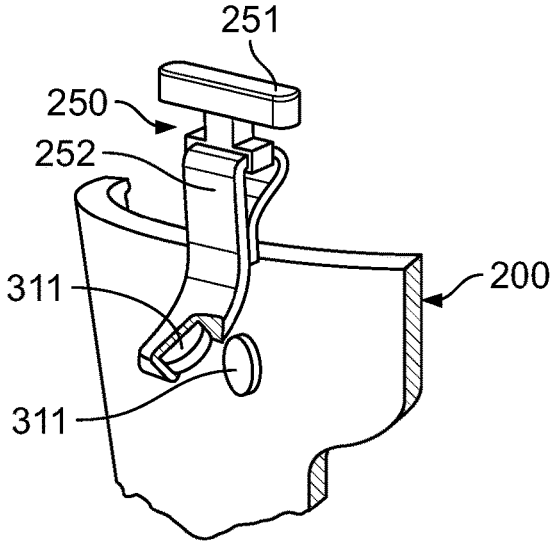
FIG. 48 is a perspective view of another embodiment of a connection member in accordance with aspects of the disclosure, with a portion of a container sidewall configured for connection to the connection member.
Figure 49:
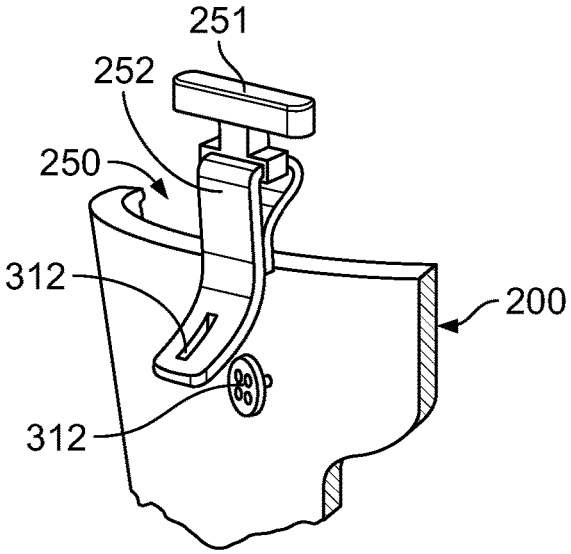
FIG. 49 is a perspective view of another embodiment of a connection member in accordance with aspects of the disclosure, with a portion of a container sidewall configured for connection to the connection member.
Figure 50:
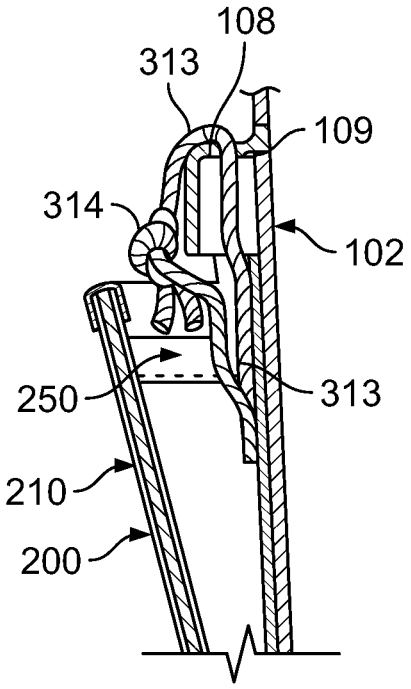
FIG. 50 is a perspective view of an accessory and another embodiment of a connection member in accordance with aspects of the disclosure, with the connection member connecting the accessory to the container of FIG. 1.
Figure 51:
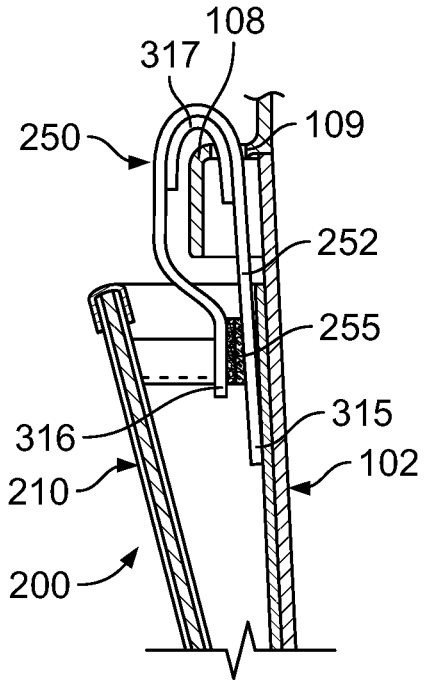
FIG. 51 is a perspective view of an accessory and another embodiment of a connection member in accordance with aspects of the disclosure, with the connection member connecting the accessory to the container of FIG. 1.
Figure 52:
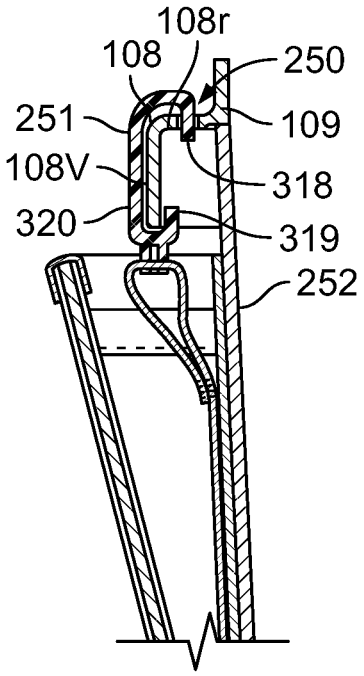
FIG. 52 is a perspective view of an accessory and another embodiment of a connection member in accordance with aspects of the disclosure, with the connection member connecting the accessory to the container of FIG. 1.
Figure 53:
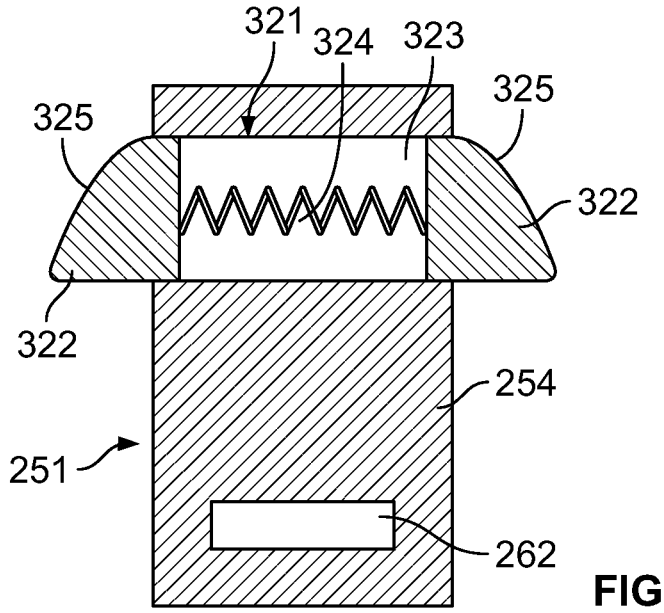
FIG. 53 is a cross-section view of another embodiment of a connection member in accordance with aspects of the disclosure, with the connection member shown in a locked position.
Figure 54:
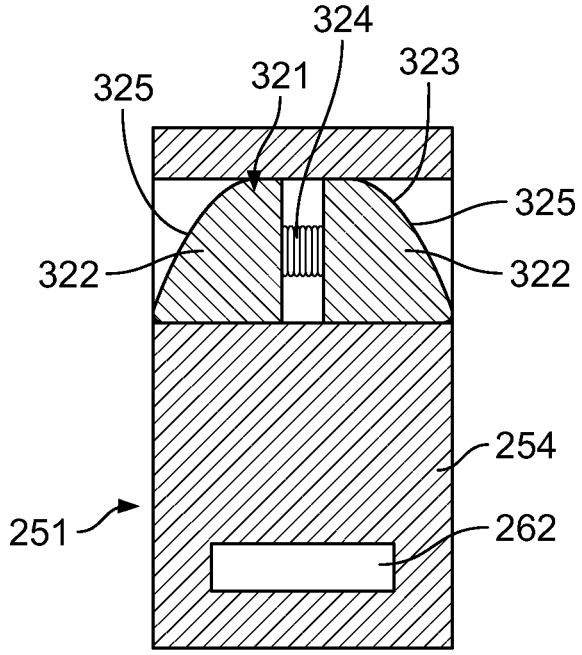
FIG. 54 is a cross-section view of the connection member of FIG. 53, with the connection member shown in a released position.
Figure 55:
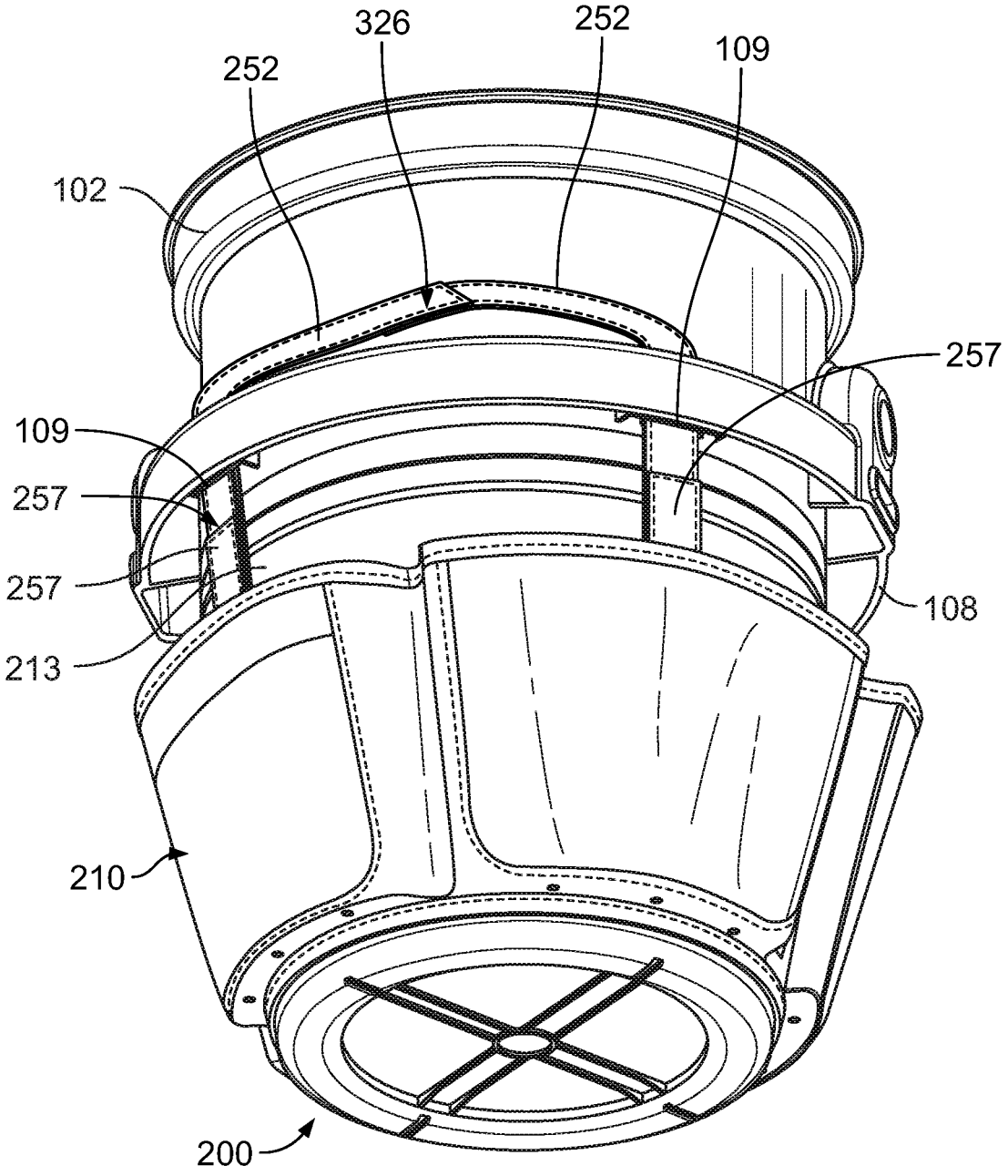
FIG. 55 is a bottom perspective view of the container and the accessory of FIG. 6 with another embodiment of a connection member in accordance with aspects of the disclosure connecting the accessory to the container.

FIGS. 47-55 illustrate additional releasable connecting structures that may be used to connect the connecting members 250 to an accessory 200 as described herein, such as a jacket 210 as shown in FIGS. 6-13. FIG. 47 illustrates a connecting member 250 in the form of a strap 252 that connects to the accessory 200 by complementary snap connections 310. FIG. 48 illustrates a connecting member 250 in the form of a strap 252 that connects to the accessory 200 by complementary magnetic connections 311. FIG. 49 illustrates a connecting member 250 in the form of a strap 252 that connects to the accessory 200 by complementary button connections 312. FIG. 50 illustrates a connecting member 250 in the form of ropes 313 fixedly connected to the accessory 200 (in this embodiment, a jacket 210) that extend through one of the ports 109 in the container 102 and connect to each other by forming a knot 314. FIG. 51 illustrates a connecting member 250 in the form of a strap 252 that is fixedly connected at one end 315 to the accessory 200 (in this embodiment, a jacket 210), with a free end 316 that extends upward through one of the ports 109 and loops downward to fasten to itself by use of releasable connecting structure in the form of hook-and-loop connecting structure 255. The strap 252 in FIG. 51 further has a reinforcing member 317 positioned to contact the skirt 108 to provide strength and durability to the strap 252 where the strap 252 contacts the skirt 108. The reinforcing member 317 may be one or more additional layers of the material forming the strap 252, or may be a different material, such as a rubber coating. FIG. 52 illustrates a connecting member 250 in the form of a strap 252 that is fixedly connected to the accessory 200 and is also connected to a connector 251 that is releasably connected to one of the ports 109 of the container 102. In this embodiment, the connector 251 is formed as a c-shaped structure, with a first portion 318 received in the port 109, a second portion 319 that is received under the skirt 108, and a third portion 320 that is c-shaped and extends around the horizontal portion 108*r* and down along the vertical portion 108*v* of the skirt 108 to connect the first and second portions 318, 319. The bottom of the vertical portion 108*v* of the skirt 108 is received between the second and third portions 319, 320 of the connector 251 in the embodiment of FIG. 52. FIG. 55 illustrates connecting members 250 in the form of straps 252 that connect to the accessory 200 (in this embodiment, a jacket 210) using connecting structures 255 including receiving members 257 as described herein with respect to FIGS. 6-13. The connecting members 250 in this embodiment do not have connectors 251, but instead, the straps 252 extend upward through the ports 109 and connect to each other in pairs. Additional releasable connecting structures 326 are used to connect the straps 252 to each other, which may be hook-and-loop structures or other releasable connecting structures as described herein. The connected straps 252 connect the accessory 200 to the container 102 and suspend the accessory 200 from the skirt 108.

FIGS. 53-54 illustrate a connector 251 that has a moveable locking structure 321 for engaging one of the ports 109 of the container 102. The moveable locking structure 321 in this embodiment includes two moveable locking members 322 connected to a housing 323. The locking members 322 are moveable between an extended position (FIG. 53), where the locking members 322 extend out of the housing 323 and have a greater width than the port 109 to engage the skirt 108 around the port 109, and a retracted position (FIG. 54), where the locking members 322 are retracted into the housing 323, and the connector 251 can be inserted or removed through the port 109. A biasing member 324 (e.g., one or more springs) is positioned in the housing 323 to bias the locking members 322 toward the extended position. Additionally, the locking members 323 have ramped surfaces 325 configured to be engaged by the edges of the port 109 to force the locking members 323 toward the retracted positions during insertion into the port 109. The connector 251 in FIGS. 53-54 also has a stem 254 with a slot 262 that is configured to receive a strap 252, similar to the connector 251 of FIGS. 6-13. When the connector 251 of FIGS. 53-54 is inserted upward through the port 109, the stem 254 extends downwardly through the port 109 and connects to a strap 252 similar to the connection member 250 of FIGS. 6-13. Removal of the connector 251 can be accomplished by manipulating the locking members 323 to force them toward the retracted positions.

In other embodiments, the connection members 250 described herein may be used to directly connect other types of accessories to a container 102 as shown in FIGS. 1-5 or other container that has ports 109 or other structures that can be engaged by the connectors 251. In one embodiment, each individual connection member 250 may be used to connect a different accessory to the container 102. For example, the connection members 250 could be used to mount accessories such as individual storage compartments or containers, individual tools or other devices, components or accessories for the container 102 itself, and other accessories. It is understood that the connection members 250 may be modified for connection to a different accessory based on the structure of the accessory. For example, the strap 252 may have a structure configured for connection to a different type of accessory, which may contain complementary connecting structure.

FIGS. 28-36 illustrate embodiments of accessories 200 that each include an accessory body in the form of a jacket 210 configured to extend around at least a portion of the sidewall 150 of the container 102, one or more storage members 220 connected to the jacket 210 and configured to hold various articles, and one or more connection members 250 connected to the jacket 210 and configured for removable connection to the container 102 to support the jacket 210 in connection with the container 102. In each of these embodiments, the accessory 200 is configured for modular construction, using a plurality of modular sections 270 that may have different structures and functionalities, to enable creation of a wide variety of different configurations. It is understood that the accessory 200 may be provided in other configurations in other embodiments, including configurations that include additional components not described herein.

In the embodiments of FIGS. 28-34, the accessories 200 are formed by a base 264 that is connected to one or more connection members 250, with a plurality of the modular sections 270 connected to the base 264 to form the jacket 210. It is also understood that the connection members 250 may be configured and/or connected according to any embodiment described herein. The embodiments of FIGS. 35-36 do not use a base 264, and the accessory 200 is formed by connecting the modular sections 270 to each other, with the connection members 250 being connected directly to some or all of the modular segments 270. The connection members 250 are shown in FIGS. 28-36 as being identical to the connection members 250 in FIGS. 6-13, and while the connections of the connection members 250 in FIGS. 28-36 are not shown in detail, it is understood that the connection members 250 are connected to the base 264 or the modular sections 270 using the same structures illustrated for connection of the connection members 250 to the jacket 210 in FIGS. 6-13. In other words, each connection member 250 includes a connector 251 received in one of the ports 109 of the container 102 and a strap 252 connected to the connector 251, and the base 264 includes receiving members 257 (not shown in this embodiment) with two separable arms 258 and a hook-and-loop connecting structure 255 for receiving and connecting to the strap 252, as shown and described elsewhere herein. It is also understood that the connection members 250 and their connections to the container 102 and/or the accessory 200 may be configured according to any other embodiment described herein, and that the container 102 and/or the accessory 200 may include structures that are complementary to the structure of the connection members 250.

The modular sections 270 may be provided with different structures and functionalities, including different functional attachments, to permit a customized construction for a specific purpose. A large number and variety of modular sections 270 may be provided, and the desired modular sections 270 may be selected from the larger number of modular sections 270 to achieve the desired configuration of the jacket 210. The modular sections 270 depicted in FIGS. 28-36 all include functional attachments in the form of storage members 220, and it is understood that different modular sections 270 may have storage members 220 that are differently configured in structural and/or functional ways. For example, different storage members 220 may have different structures such as different sizes, dimensions, or shapes, internal dividers 223, covers or other closures, reinforcing or protective structures, retaining members for holding tools or other devices, waterproofing, insulation, etc. The modular sections 270 may have other types of functional attachments in other embodiments, which may perform functions other than storage. For example, such functional attachments may include handles or other gripping attachments for carrying, securement points (e.g., for use during transportation), customizable points for identification (e.g., patches for identifying contents of pockets), or attachment points for connection to a different type of container or other structure/device. Such functional attachments may be connected to the modular section 270 using connections described herein, such as stitching, bonding/adhesive, hook-and-loop or other connectors, etc. Each of these embodiments is described herein primarily with respect to the differentiating features of such embodiments, and it is understood that the accessories 200 of any of the embodiments of FIGS. 28-36 may include components and features already described herein with respect to the embodiments of FIGS. 6-27, which components and features may not be described again in detail for the sake of brevity. Common reference numbers may be used to refer to such shared features and components.

Figure 28:
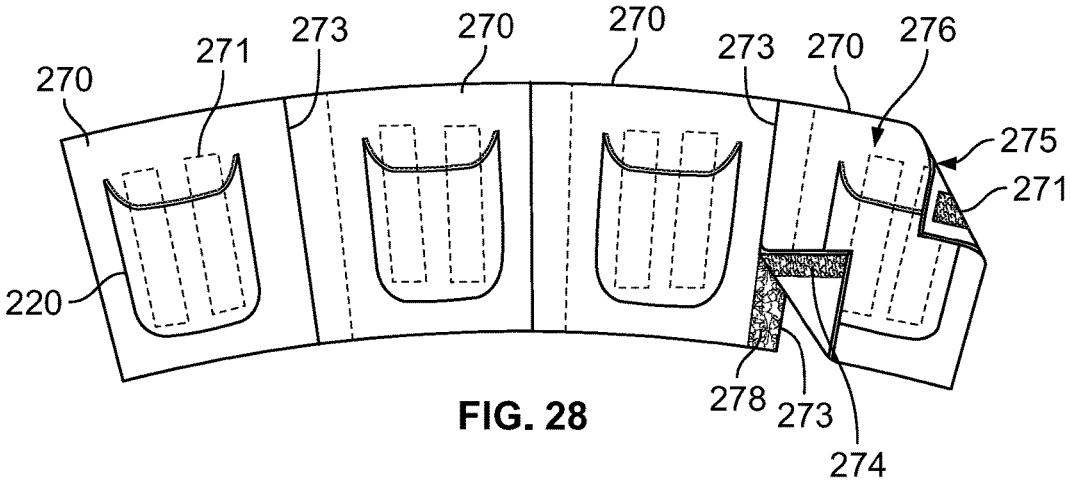
FIG. 28 is a plan view of a plurality of modular portions of another embodiment of an accessory configured to be connected to the container of FIG. 1 in accordance with aspects of the disclosure.
Figure 29:
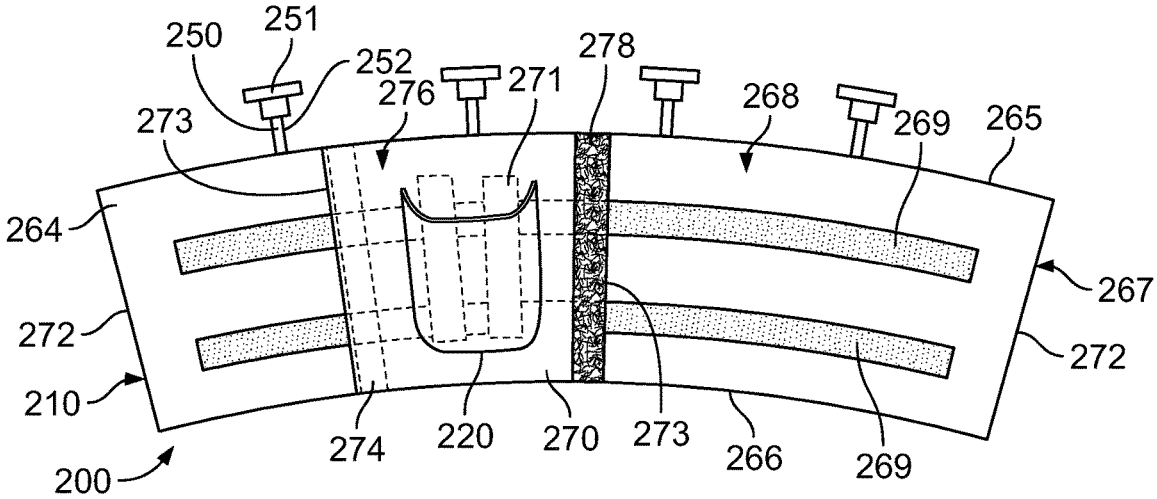
FIG. 29 is a plan view of a base portion of the accessory of FIG. 28, configured to be connected to the container of FIG. 1 in accordance with aspects of the disclosure, with one of the modular portions of FIG. 28 connected thereto.
Figure 30:
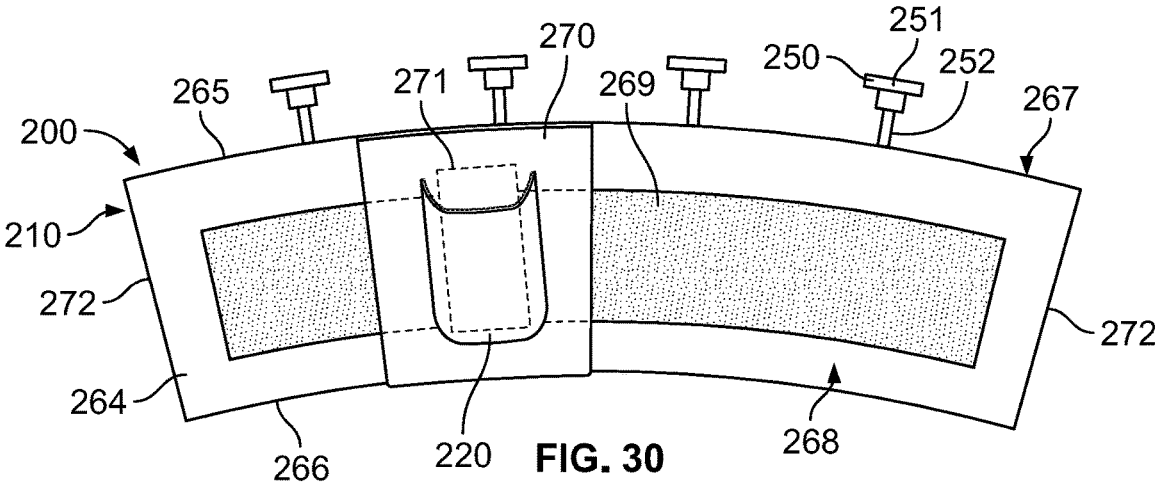
FIG. 30 is a plan view of another embodiment of an accessory configured to be connected to the container of FIG. 1 in accordance with aspects of the disclosure, including a base portion and a modular portion.

FIGS. 28-30 illustrate an embodiment of an accessory 200 where the base 264 is in the form of a tubular wrap that is configured to extend around the entire sidewall 150 of the container 102 continuously, similar to the main body 213 of the jacket 210 in FIGS. 6-13. The base 264 is dimensioned similarly to the dimension of the sidewall 150, in order to fit the sidewall 150 closely, and has circular cross-section and a generally frusto-conical or tapered cylindrical shape in this embodiment, as described herein. In this configuration, the base 264 has a top edge 265, a bottom edge 266, such that the base 264 extends continuously between the top and bottom edges 265, 266, and the base 264 further has inner and outer surfaces 267, 268, such that the inner surface 267 of the base 264 confronts the sidewall 150. FIGS. 28-30 depict the base 264 lying flat, prior to full assembly, which can be accomplished by connecting the two ends 272 of the base 264 together to form the tubular structure. These ends 272 can be connected by stitching, welding, adhesives, fasteners, hook-and-loop connections, or other permanent or releasable connecting structures. The base 264 is connected to the connection members 250, and in one embodiment, includes receiving members (not shown) similar to the receiving members 257 in FIGS. 6-13 for connection to the connection members 250. The receiving members in this embodiment are positioned on the inner surface 267 of the base 264, but may alternately be positioned on the outer surface 268.

The base 264 also includes a releasable connecting structure on the outer surface 268 for connection to the modular sections 270, which in the embodiment of FIGS. 28-30 are in the form of hook-and-loop connecting structure 269. The modular sections 270 in this embodiment have a complementary releasable connecting structure on the inner surfaces 275 thereof in the form of hook-and-loop connecting structure 271 for connection to the connecting structures 269 of the base 264. In FIGS. 28-29, the connecting structure 269 of the base 264 is in the form of two parallel, spaced strips of hook-and-loop material that extend circumferentially around the base 264 when assembled. Additionally, in this embodiment, the connecting structure 271 of each modular section 270 is in the form of two parallel, spaced strips of hook-and-loop material that extend vertically across the modular section 270, which are perpendicular to the strips of the connecting structure 269 of the base 264 and have sufficient length to engage both strips of the connecting structure 269. In FIG. 30, the connecting structure 269 of the base 264 is in the form of a single elongated patch of hook-and-loop material that extends circumferentially around the base 264 when assembled, and the connecting structure 271 of each modular section 270 is in the form of a single elongated patch of hook-and-loop material that extends vertically across the modular section 270. In other embodiments, different combinations of the connecting structures 269, 271 in FIGS. 28-30 may be used, or other connecting structures 269, 271 having further different configurations may be used. The modular sections 270 in FIGS. 28-30 have substantially the same height as the base 264 (measured between the top and bottom edges 265, 266), such that the edges of the modular sections 270 are all contiguous with each other when installed and are approximately aligned with the top and bottom edges 265, 266 of the base 264. In another embodiment, all of the modular sections 270 may have heights that are equal to or smaller than the height of the base 264.

In the embodiments of FIGS. 28-30, the modular sections 270 are configured to overlap at the edges 273, and the modular sections 270 include additional connecting structures 274, 278 along the edges 273 to connect adjacent modular sections 270 together. For example, as shown in FIG. 28, each modular section 270 has a releasable connecting structure 274 on the inner surface 275 (i.e., facing the container 102) along the left edge 273 and a complementary releasable connecting structure 278 on the outer surface 276 (i.e., facing away from the container 102) along the right edge 273. In this configuration, the left edge 273 of each modular section 270 overlaps the right edge 273 of the adjacent section 270, and the releasable connecting structures 274, 278 of the adjacent modular sections 270 connect to each other. FIG. 28 illustrates four modular sections 270 connected together in position to be connected to the base 264 in FIG. 29, and it is understood that the left edge 273 of the left-most modular section 270 would overlap the right edge 273 of the right-most modular section 270 when the modular sections 270 are positioned on the assembled (i.e., tubular) base 264. In the embodiment of FIG. 30, the edges 273 of adjacent modular sections 270 may not overlap and may instead be positioned side-by-side or spaced from each other (e.g., similar to the configuration shown in FIG. 34).

Figure 31:
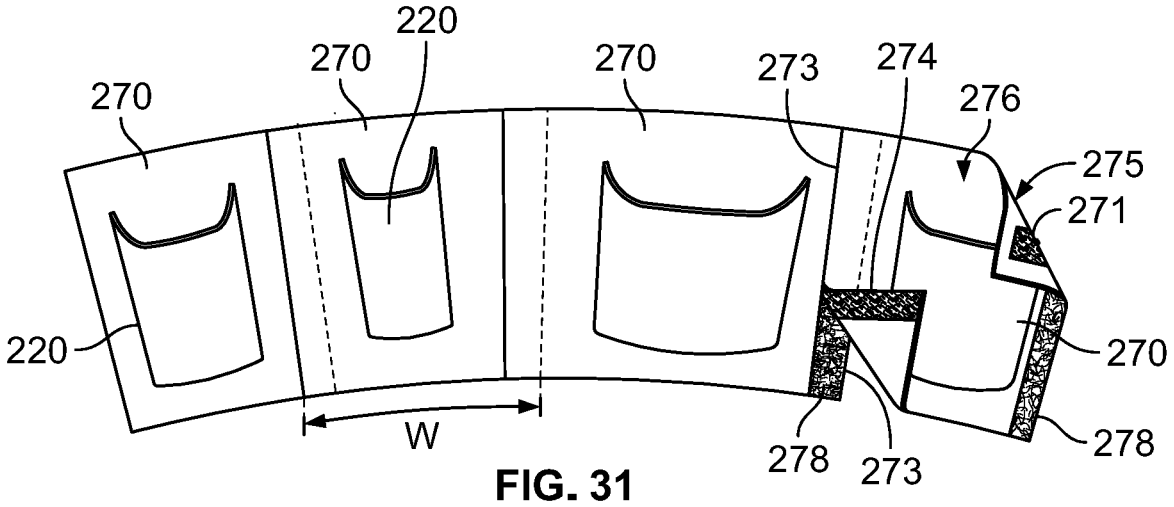
FIG. 31 is a plan view of another embodiment of a plurality of modular portions that are usable with the base portions of FIGS. 29 and 30 in accordance with aspects of the disclosure.
Figure 32:
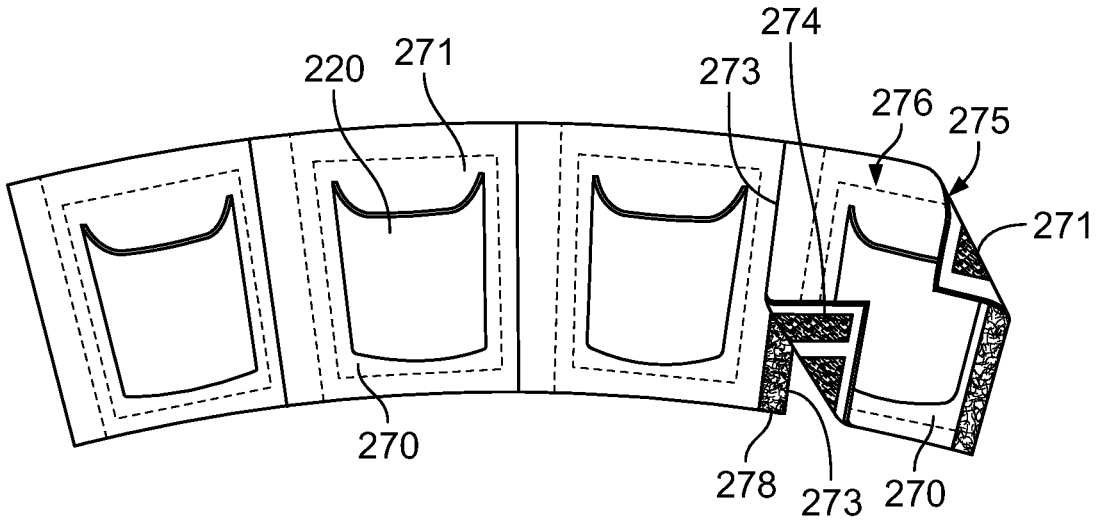
FIG. 32 is a plan view of a plurality of modular portions of another embodiment of an accessory configured to be connected to the container of FIG. 1 in accordance with aspects of the disclosure.
Figure 33:
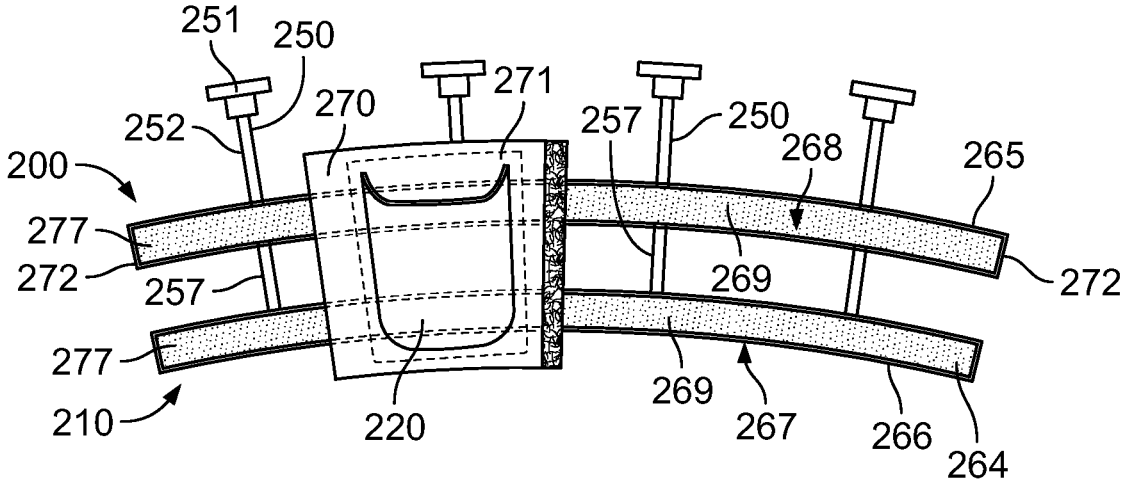
FIG. 33 is a plan view of a base portion of the accessory of FIG. 32, configured to be connected to the container of FIG. 1 in accordance with aspects of the disclosure, with one of the modular portions of FIG. 32 connected thereto.

FIG. 31 illustrates another embodiment of a plurality of modular sections 270 that are configured for use with the bases 264 of FIGS. 28-30 and could also be used in connection with the base 264 of FIG. 33. The modular sections 270 in FIG. 31 have different circumferential widths W, and can be assembled in a variety of desired combinations in order to create a customized configuration for the accessory 200. In this configuration, narrower modular sections 270 (e.g., with smaller storage members 220) and wider modular sections 270 (e.g., with larger storage members 220) can be assembled together as desired to create the accessory. For example, a larger number of narrower modular sections 270, a smaller number of wider modular sections 270, or a combination of modular 270 sections having different widths can be created in assembling the accessory 200. In one embodiment, the modular sections 270 may be provided in a finite number of selected widths with proportional widths that enable the assembled modular sections 270 to have the same collective circumferential width as the base 264. As an example, the modular sections 270 may be provided having three different circumferential widths, such as large (⅓ the circumferential width of the base 264), medium (¼), and small (⅙). Additionally, the modular sections 270 in FIG. 31 have overlapping edges 273 and connecting structures 274, 278 as similarly described above with respect to FIGS. 28-29. Modular sections 270 similar to the modular sections 270 in FIG. 31, using similar concepts, may be used in connection with FIGS. 32-36, with appropriate structural modifications.

FIGS. 32-33 illustrate an embodiment of an accessory 200 where the base 264 is in the form of a pair of spaced annular bands 277 that are configured to extend around the entire sidewall 150 of the container 102 continuously. The base 264 generally include a plurality of bands 277, and may include more than two bands 277 in another embodiment. The base 264 is dimensioned similarly to the dimension of the sidewall 150, in order to fit the sidewall 150 closely, and the upper band 277 may have a slightly greater length (flat) and diameter (assembled) than the lower band 277, to conform to the generally frusto-conical shape of the container sidewall 150. Each of the bands 277 of the base 264 has inner and outer surfaces 267, 268, such that the inner surface 267 of the base 264 confronts the sidewall 150. FIG. 32 depicts the base 264 lying flat, prior to full assembly, which can be accomplished by connecting the two ends 272 of each respective band 277 together to form an annular structure, using any connecting technique described herein. The base 264 is connected to the connection members 250 such that all/both of the bands 277 are connected to and supported by the connection members 250. In one embodiment, the base 264 includes receiving members 257 similar to the receiving members 257 in FIGS. 6-13 for connection to the connection members 250, and these receiving members 257 are fixedly connected to both/all of the bands 277 and extend across the spaces between the bands 277. The receiving members 257 in this embodiment are connected to and positioned on the inner surfaces 267 of the bands 277, but may alternately be positioned on the outer surface 268.

The base 264 in FIGS. 32-33 also includes a releasable connecting structure on the outer surface 268 for connection to the modular sections 270, which in the embodiment of FIGS. 32-33 are in the form of hook-and-loop connecting structure 269. The modular sections 270 in this embodiment have a complementary releasable connecting structure on the inner surfaces 275 thereof in the form of hook-and-loop connecting structure 271 for connection to the connecting structures 269 of the base 264. In FIG. 33, each of the bands 277 of the base 264 has a releasable connecting structure 269 in the form of a strip of hook-and-loop material that extends circumferentially around the band 277 when assembled and has approximately the same height and circumferential width as the band 277. Additionally, in this embodiment, the connecting structure 271 of each modular section 270 is in the form of a patch of hook-and-loop material that has sufficient height to span to cover both of the bands 277 and engage both strips of the connecting structure 269. It is understood that the connecting structures 269, 271 of the base 264 and the modular sections 270 may have other configurations as described herein. Additionally, the modular sections 270 in FIGS. 32-33 have overlapping edges 273 and connecting structures 274, 278 as similarly described above with respect to FIGS. 28-29.

Figure 34:
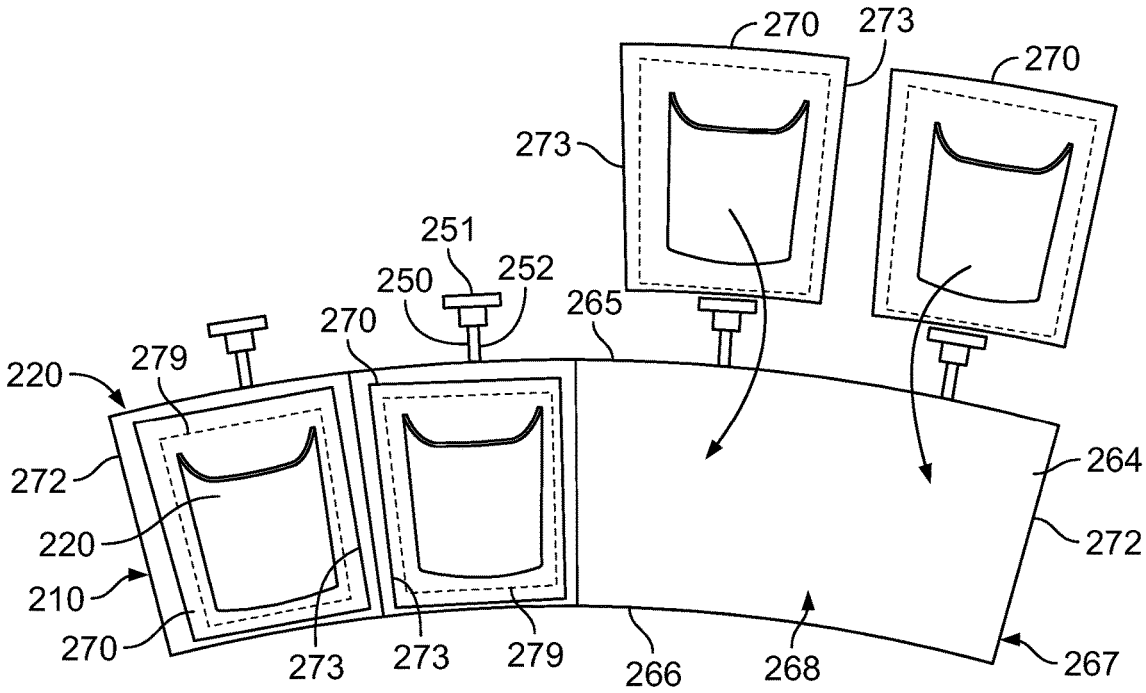
FIG. 34 is a plan view of another embodiment of an accessory configured to be connected to the container of FIG. 1 in accordance with aspects of the disclosure, including a base portion and a plurality of modular portions.

FIG. 34 illustrates an embodiment of an accessory 200 where the base 264 is in the form of a tubular wrap that is configured to extend around the entire sidewall 150 of the container 102 continuously, similar to the bases 264 in FIGS. 28-30. In the embodiment of FIG. 34, the modular sections 270 are connected to the base 264 by non-releasable connecting structures, such as stitching, bonding (e.g., adhesives or welding), or a combination thereof. In FIG. 34, the stitching 279 extends around the periphery of the modular section 270. Additionally, in the embodiment of FIG. 34, the modular sections 270 do not overlap each other, and the edges 273 of adjacent sections 270 are positioned adjacent to and slightly spaced from each other, but the edges 273 may be positioned immediately adjacent to each other if desired. In another embodiment, the edges 273 of adjacent modular sections 270 overlap, and the stitching 279 extends through both sections 270 and the base 264 at the overlapping portions. In a further embodiment, the non-overlapping configuration of FIG. 34 may be used in connection with a releasable connecting structure, such as in FIGS. 28-30.

Figure 35:
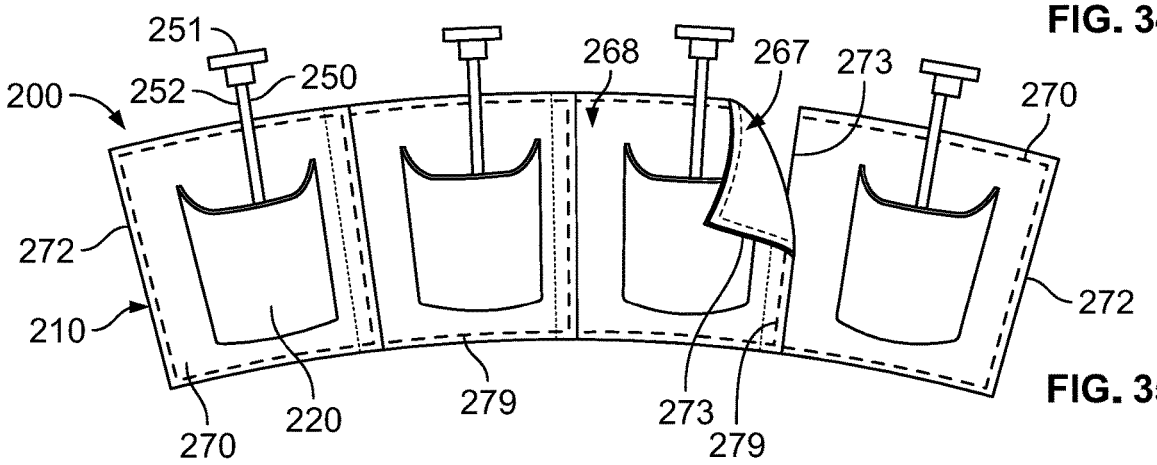
FIG. 35 is a plan view of another embodiment of an accessory configured to be connected to the container of FIG. 1 in accordance with aspects of the disclosure, including a base portion and a modular portion.
Figure 36:
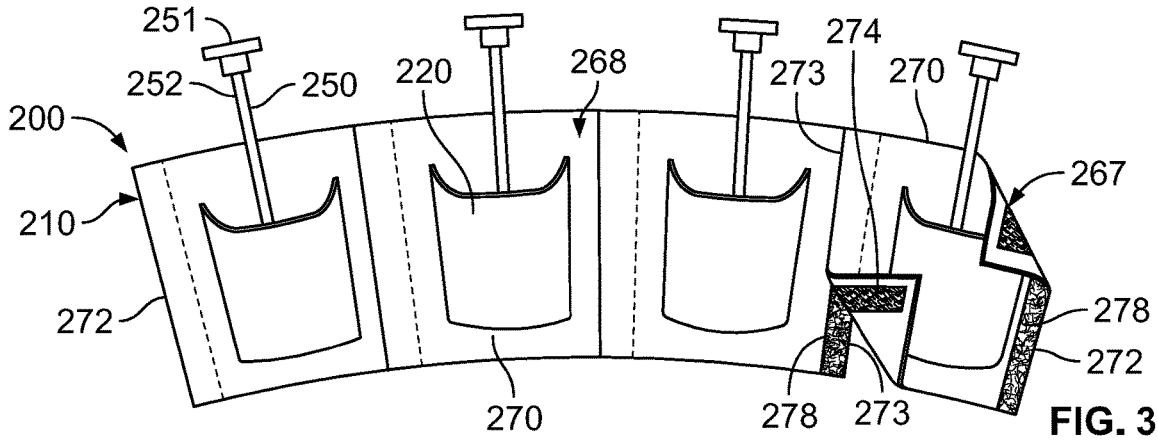
FIG. 36 is a plan view of another embodiment of an accessory configured to be connected to the container of FIG. 1 in accordance with aspects of the disclosure, including a plurality of modular portions.

FIGS. 35-36 illustrate embodiments of an accessory 200 where a plurality of modular sections 270 are connected to each other to form a jacket 210 in the form of a tubular wrap configured to extend around the entire sidewall 150 of the container 102 continuously, similar to the main body 213 of the jacket 210 in FIGS. 6-13. The jacket 210 is dimensioned similarly to the dimension of the sidewall 150, in order to fit the sidewall 150 closely, and has circular cross-section and a generally frusto-conical or tapered cylindrical shape in this embodiment, as described herein. In this configuration, the jacket 210 has inner and outer surfaces 267, 268, such that the inner surface 267 of the jacket 210 confronts the sidewall 150. FIGS. 35-36 depict the jacket 210 lying flat, prior to full assembly, which can be accomplished by connecting the two ends 272 of the jacket 210 together to form the tubular structure. These ends 272 can be connected by stitching, welding, adhesives, fasteners, hook-and-loop connections, or other permanent or releasable connecting structures, and in one embodiment, the ends 272 of the jacket 210 may be connected together in the same manner that the modular sections 270 are connected to each other. The jacket 210 is connected to the connection members 250, and in the embodiments of FIGS. 35-36, each of the modular sections 270 has a receiving member 257 similar to the receiving members 257 in FIGS. 6-13 for connection to the connection members 250. The receiving members 257 in this embodiment are connected to the outer surface 268 of the jacket 210 partially within the storage compartments 221, but may alternately be connected elsewhere, such as the inner surface 267.

The modular sections 270 in the embodiments of FIGS. 35-36 are configured to overlap at the edges 273, such that the overlapping portions are connected together to connect the modular sections 270 to each other. In the embodiment of FIG. 35, the overlapping portions at the edges 273 of the adjacent sections 270 are connected together by non-releasable connecting structures, such as stitching, bonding (e.g., adhesives or welding), or a combination thereof. The stitching 279 in this embodiment is illustrated as extending around the periphery of each modular section 270, but the stitching 279 may be present only at the locations of the overlapping portions near the edges 273 in another embodiment. In the embodiment of FIG. 36, the modular sections 270 include releasable connecting structures 274, 278 along the edges 273 to connect adjacent modular sections 270 together, as similarly described above with respect to FIGS. 28-29.

FIGS. 37-44 illustrate embodiments of accessories 200 each configured as an insulating member 280 that is selectively attachable to and removable from the container 102. The insulating members 280 in FIGS. 37-44 generally have an insulating body 281 and one or more connection members 250 connected to the insulating body 281 and configured for removable connection to the container 102 to support the insulating body 281 in connection with the container 102. The insulating body 281 for each of these embodiments may include various insulation structures, such as vacuum insulation in one embodiment. In other embodiments, the insulating body 281 may use a filler-type insulation and/or low-conductivity materials, among other insulation structures and techniques. Examples of such insulation include fiber batting, monolithic foam structures (permanent or removable), injected foam, particulate matter (e.g., insulative beads or foam pellets), among others. The insulating bodies 281 in FIGS. 37-44 each have a bottom wall 282 and a sidewall 283 extending upward to define a cavity 281*a* that receives a portion of the container 102 therein to insulate the container 102. In another embodiment, the insulating body 281 may not have a bottom wall 282, such that the sidewall 283 is formed as a tubular structure. In general, the insulating member 280 may have a thermal conductivity through the walls thereof, including the sidewall 283 and/or the bottom wall 282, that is smaller than the thermal conductivity through the walls (e.g., the sidewall 150) of the container 102. For example, the insulating member 280 may have a thermal conductivity through the walls thereof that is at least 50% lower than the conductivity through the walls of the container 102. In another embodiment, the insulating member 280 may instead be configured as a protective member without internal insulation, in which case the thermal conductivity through the walls thereof is at least 25% lower than the conductivity through the walls of the container 102.

Figure 37:
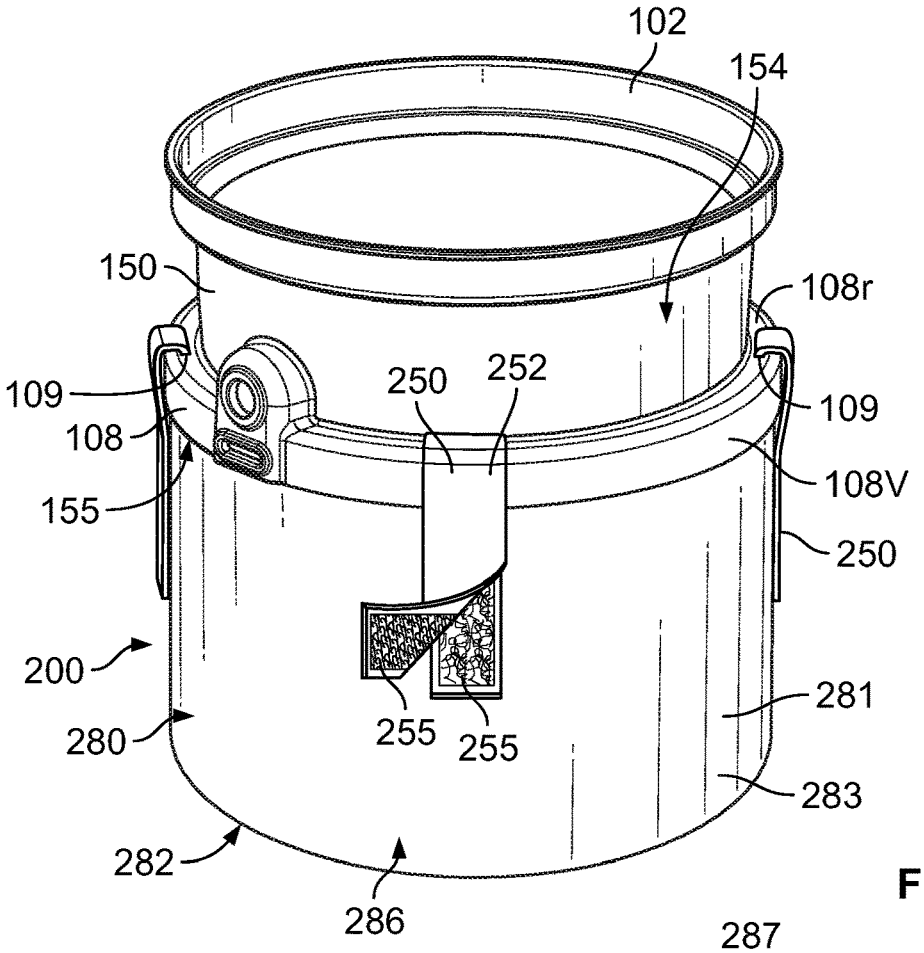
FIG. 37 is a perspective view of the container of FIG. 1 with another embodiment of an accessory connected to the container, in accordance with aspects of the disclosure.
Figure 38:
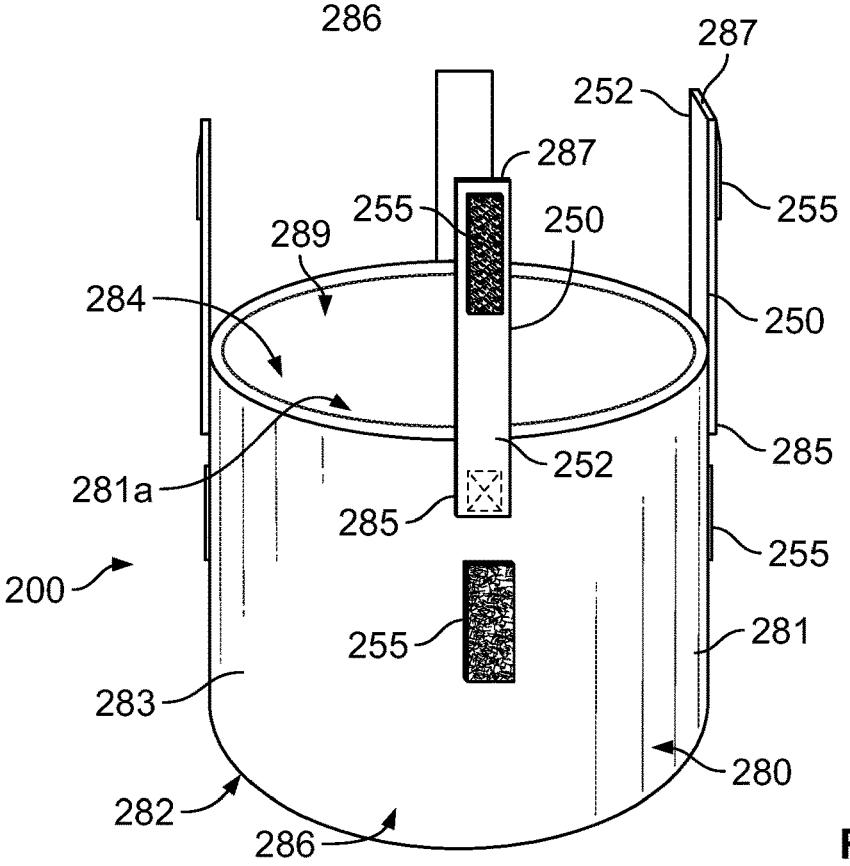
FIG. 38 is a perspective view of the accessory of FIG. 37.

FIGS. 37-38 illustrate one embodiment of an insulating member 280 that has a generally cylindrical sidewall 283 that is shaped similarly to the outer surface 154 of the sidewall 150 of the lower portion of the container 102 below the skirt 108 and receives the lower portion of the container sidewall 150. The insulating body 281 has an open top 284 that is configured to sit beneath the skirt 108, and in one embodiment, the top 284 of the insulating body 281 is received within the gap 155 defined by the skirt 108. The connection members 250 in this embodiment are in the form of straps 252 connected at a first end or portion 285 to the outer surface 286 of the sidewall 283 of the insulating body 281, such as by a removable connecting structure (e.g., snaps or hook-and-loop structures) or a permanent or semi-permanent connecting structure (e.g., adhesive or other bonding material). The first end or portion 285 may be connected to another portion of the insulating body 281, such as the inner surface of the sidewall 283, in another embodiment. The connection members 250 also have a second end or portion 287 that is removably connected to the outer surface 286 of the sidewall 283 by complementary releasable connections, e.g., hook and loop connecting structures 255 on the connection member 250 and the insulating body 281. To connect the insulating member 280 to the container 102, the second portion 287 of each connection member 250 is inserted upward through one of the ports 109 on the skirt 108 of the container 102 and wrapped downward around the skirt 108 and along the sidewall 283 of the insulating body 281 to connect to the connecting structures 255 on the insulating body 281. The connecting structures 255 on the insulating body 281 may be provided as a receiving member 257 as described with respect to other embodiments herein, or another releasable connecting structure. It is understood that other embodiments of connection members 250 may also be used in connection with this embodiment, including other configurations of connection members 250 described herein.

Figure 39:
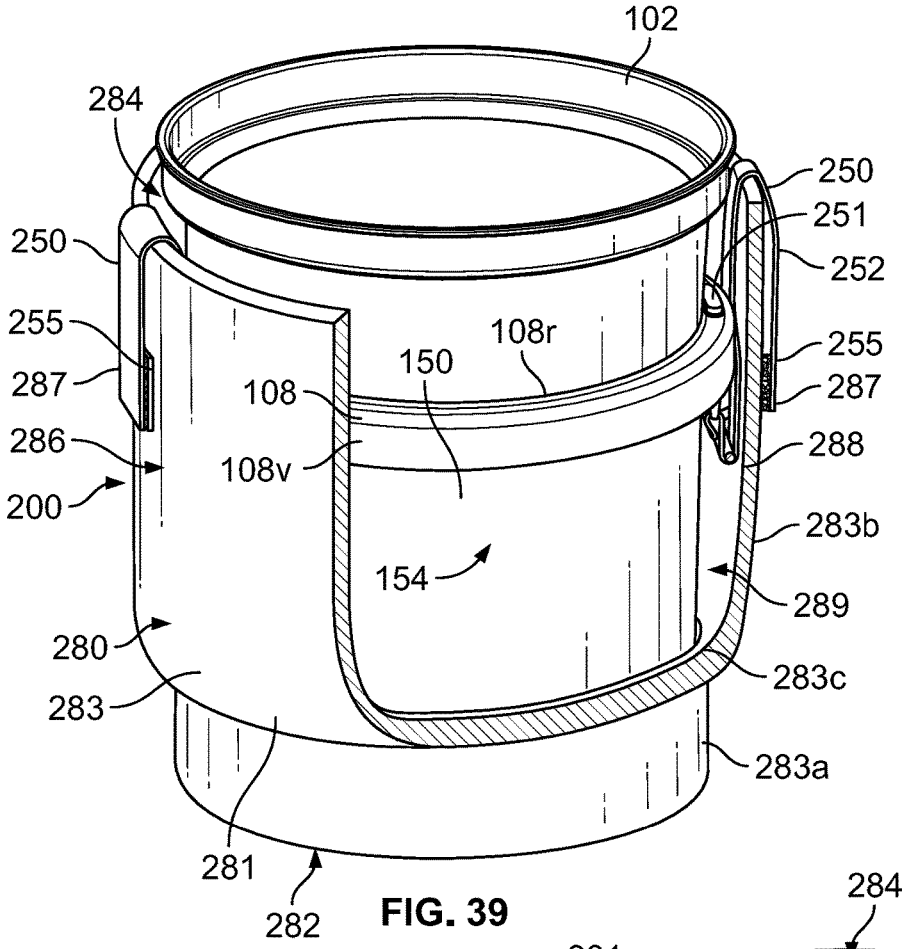
FIG. 39 is a perspective view of the container of FIG. 1 with another embodiment of an accessory connected to the container, in accordance with aspects of the disclosure.
Figure 40:
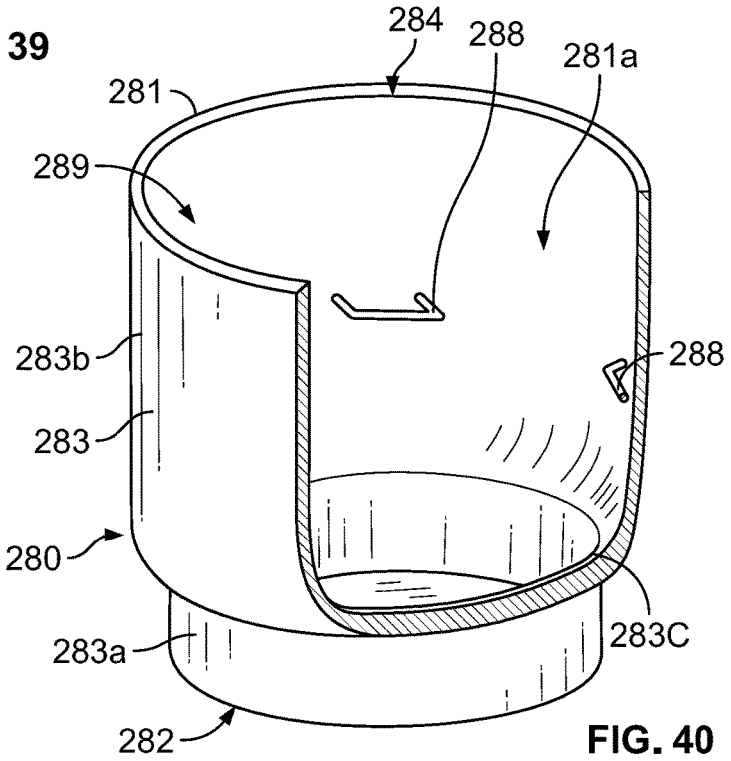
FIG. 40 is a perspective view of the accessory of FIG. 39.

FIGS. 39-40 illustrate another embodiment of an insulating member 280 that has a sidewall 283 that includes a lower sidewall portion 283*a*, an upper sidewall portion 283*b* that has a larger width/diameter than the lower sidewall portion 283*a*, and a shoulder portion 283*c* that extends outward between the lower sidewall portion 283*a* and the upper sidewall portion 283*b* to increase the width/diameter of the sidewall 283. The lower sidewall portion 283*a* is shaped similarly to the outer surface 154 of the sidewall 150 of the lower portion of the container 102 (below the skirt 108) and receives part the lower portion of the container sidewall 150. The upper sidewall portion 283*b* has a width or diameter that is larger than the width/diameter of the skirt 108 such that the skirt 108 can be received through the open top 284 of the insulating body 281. Each connection member 250 in this embodiment includes a strap 252 with a connector 251 as shown in FIGS. 6-13 for connection to one of the ports 109 of the container 102. The connection members 250 in this embodiment also have a distal end or portion 287 that is removably connected to the outer surface 286 of the sidewall 283 by complementary releasable connections, e.g., hook and loop connecting structures 255 on the connection member 250 and the insulating body 281. The insulating member 280 also has brackets 288 distributed around the inner surface 289 of the upper sidewall portion 283*b*, such that each of the straps 252 passes through one of the brackets 288. To connect the insulating member 280 to the container 102, the second portion 287 of each connection member 250 is inserted downward through the respective port 109 to engage the connector 251 with the port 109, and then upward through the respective bracket 288. The straps 252 are then extended over the top 284 and pulled tight to snug the bottom 106 of the container 102 with the bottom wall 282 of the insulating body 281, and then the connection members 250 are connected to the insulating body 281 by the releasable connecting structures 255. The connecting structures 255 on the insulating body 281 may be provided as a receiving member 257 as described with respect to other embodiments herein, or another releasable connecting structure. It is understood that other embodiments of connection members 250 may also be used in connection with this embodiment, including other configurations of connection members 250 described herein.

Figure 41:
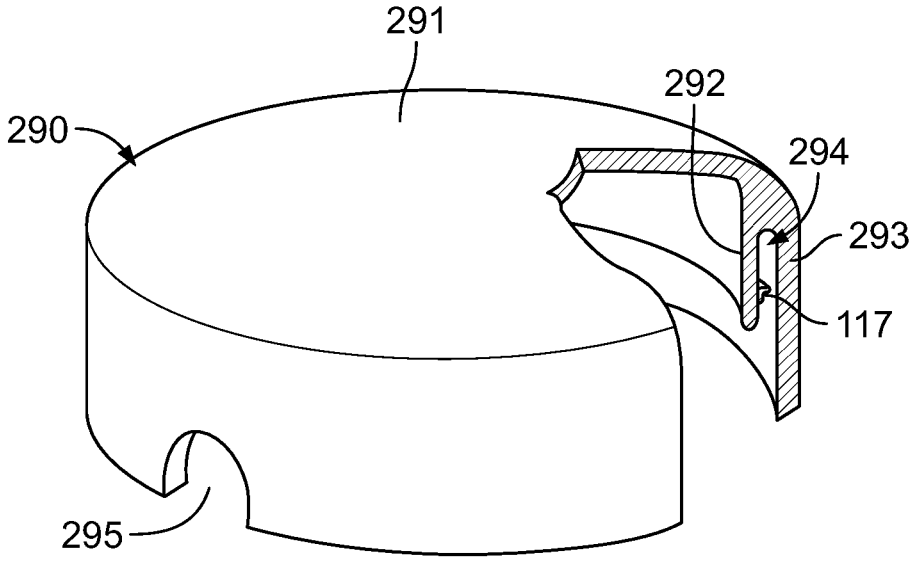
FIG. 41 is a perspective view of another embodiment of a lid for a container in accordance with aspects of the disclosure.
Figure 42:
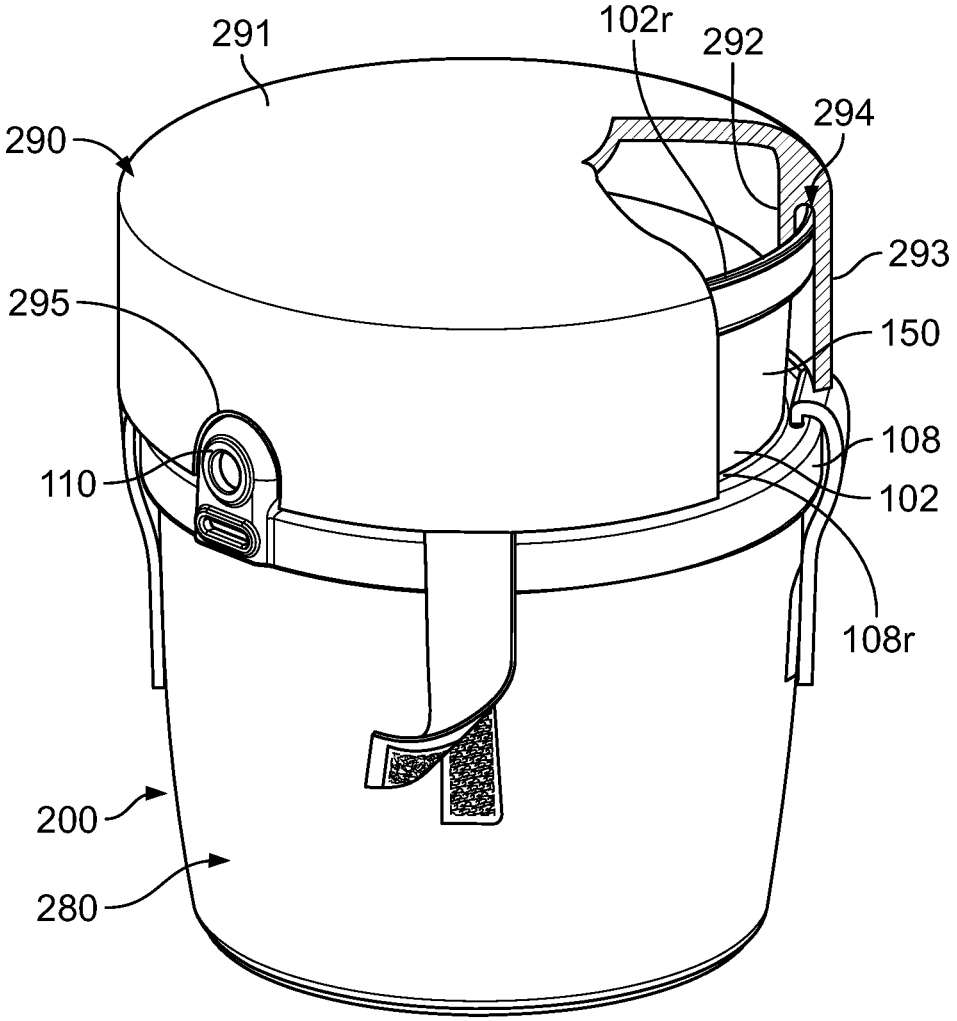
FIG. 42 is a perspective view of the container of FIG. 1 with the lid of FIG. 41 and the accessory of FIGS. 37-38 connected to the container.

FIGS. 41-44 illustrate additional insulating accessories for use in connection with the container 102, which are shown connected to the container 102 along with the insulating member 280 of FIGS. 37-38. FIGS. 41-42 illustrate an insulated lid 290 that includes a closed top wall 291, an inner wall 292 that extends downward from the top wall 291 and inside the top 104 of the container 102, an outer wall 293 that also extends downward from the top wall 291 and outside the container 102 to cover the upper portion of the sidewall 150 and fit over the rim 102*r*. The rim 102*r* is received within a channel 294 between the inner and outer walls 292, 293, and a gasket or other seal 117 is connected to the inner wall 292 within the channel 294 to engage the container 102. The outer wall 293 includes cut-outs 295 that receive the handle mounts 110 so the bottom of the lid 290 can extend downward proximate to or engaging the skirt 108. The insulated lid 290 may be insulated using various insulating structures, including any insulating structures described herein. The insulated lid 290 in combination with the insulating member 280 of FIGS. 37-38 (as shown in FIGS. 41-42) creates a configuration where substantially all of the container 102 is thermally insulated. It is understood that the insulated lid 290 may be modified for use with a different insulating member 280, including for use with the insulating member 280 in FIGS. 39-40. It is also understood that a non-insulated lid may be constructed with a similar structure in another embodiment.

Figure 43:
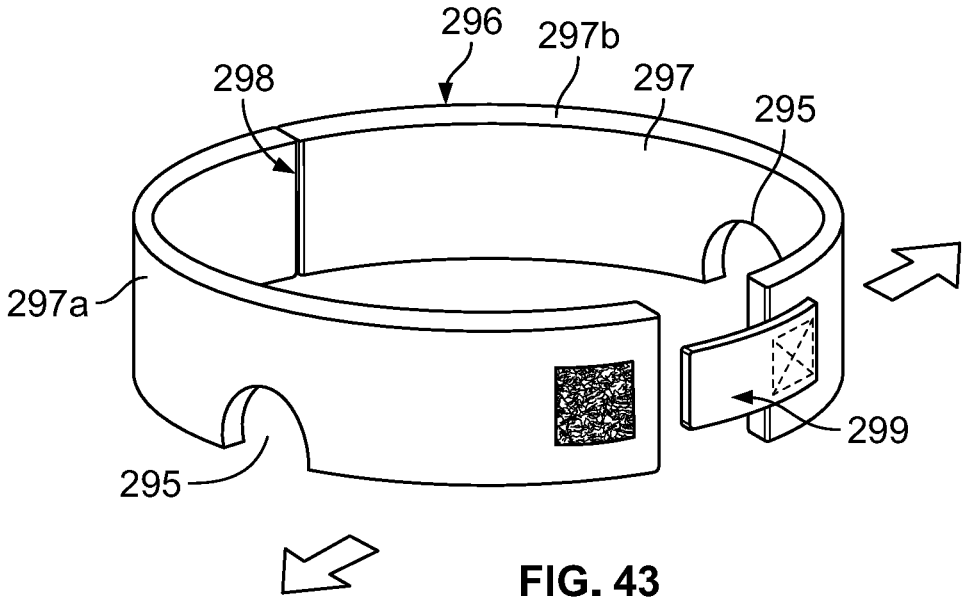
FIG. 43 is a perspective view of another embodiment of an accessory for a container in accordance with aspects of the disclosure, with the accessory shown in an open position.
Figure 44:
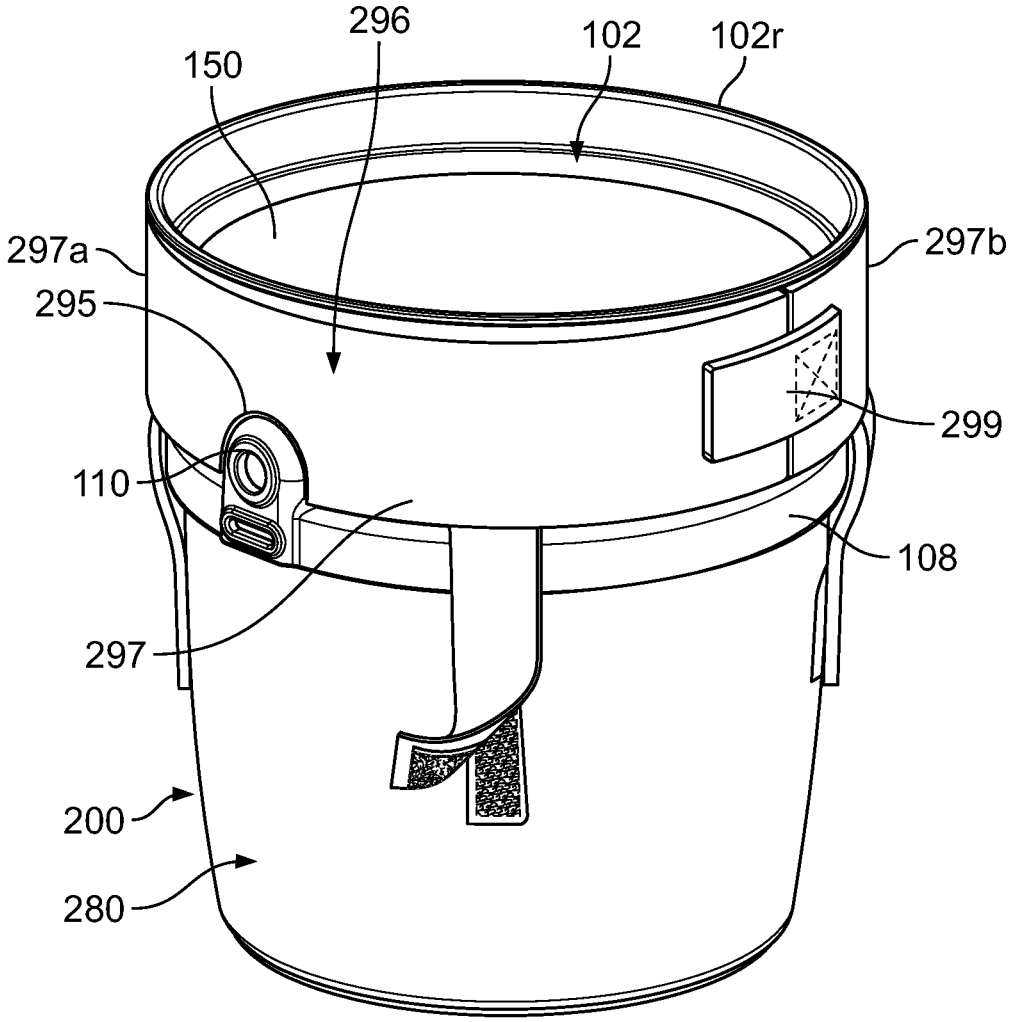
FIG. 44 is a perspective view of the container of FIG. 1 with the accessory of FIG. 41 and the accessory of FIGS. 37-38 connected to the container, and with the accessory of FIG. 41 shown in a closed position.

FIGS. 43-44 illustrate an insulated collar 296 that includes an expandable insulating body 297 that wraps around an upper portion of the sidewall 150 of the container 102. The insulated collar 296 in this embodiment uses a joint 298 and a releasable fastener 299 to create an expandable configuration so the collar 296 can fit snugly with the upper portion of the sidewall 150 beneath the rim 102*r*. The joint 298 may be configured as a hinge with a pin in one embodiment, but may have different configurations in other embodiments, including any structure that would allow expansion of the width of the insulating body 297 pivoting or flexing at the joint 298. Multiple joints 298 may also be used. In this embodiment, the insulating body 297 includes first and second body portions 297*a*, 297*b* that are joined at the joint 298, such that the body portions 297*a*, 297*b* can move away from each other by flexing or pivoting at the joint 298 to fit over the rim 102*r*, as shown in FIG. 43. The body portions 297*a*, 297*b* can then be releasably connected to each other using the fastener 299 which may be a hook-and-loop connection or other releasable fastener described herein. Each body portion 297*a*, 297*b* of the insulating body 297 also includes cut-outs 295 that receive the handle mounts 110 so the bottom of the collar 296 can rest on the skirt 108 and the handle mounts 110. The insulated collar 296 may be insulated using various insulating structures, including any insulating structures described herein. The collar 296 may also use various other expansion structures, including having an elastically expandable structure or multiple rigid pieces connected by elastically expandable portions. The insulated collar 296 in combination with the insulating member 280 of FIGS. 37-38 (as shown in FIGS. 43-44) creates a configuration where substantially all of the container 102 is thermally insulated. It is understood that the insulated collar 296 may be modified for use with a different insulating member 280, including for use with the insulating member 280 in FIGS. 39-40. It is also understood that a non-insulated collar may be constructed with a similar structure in another embodiment.

Figure 45:
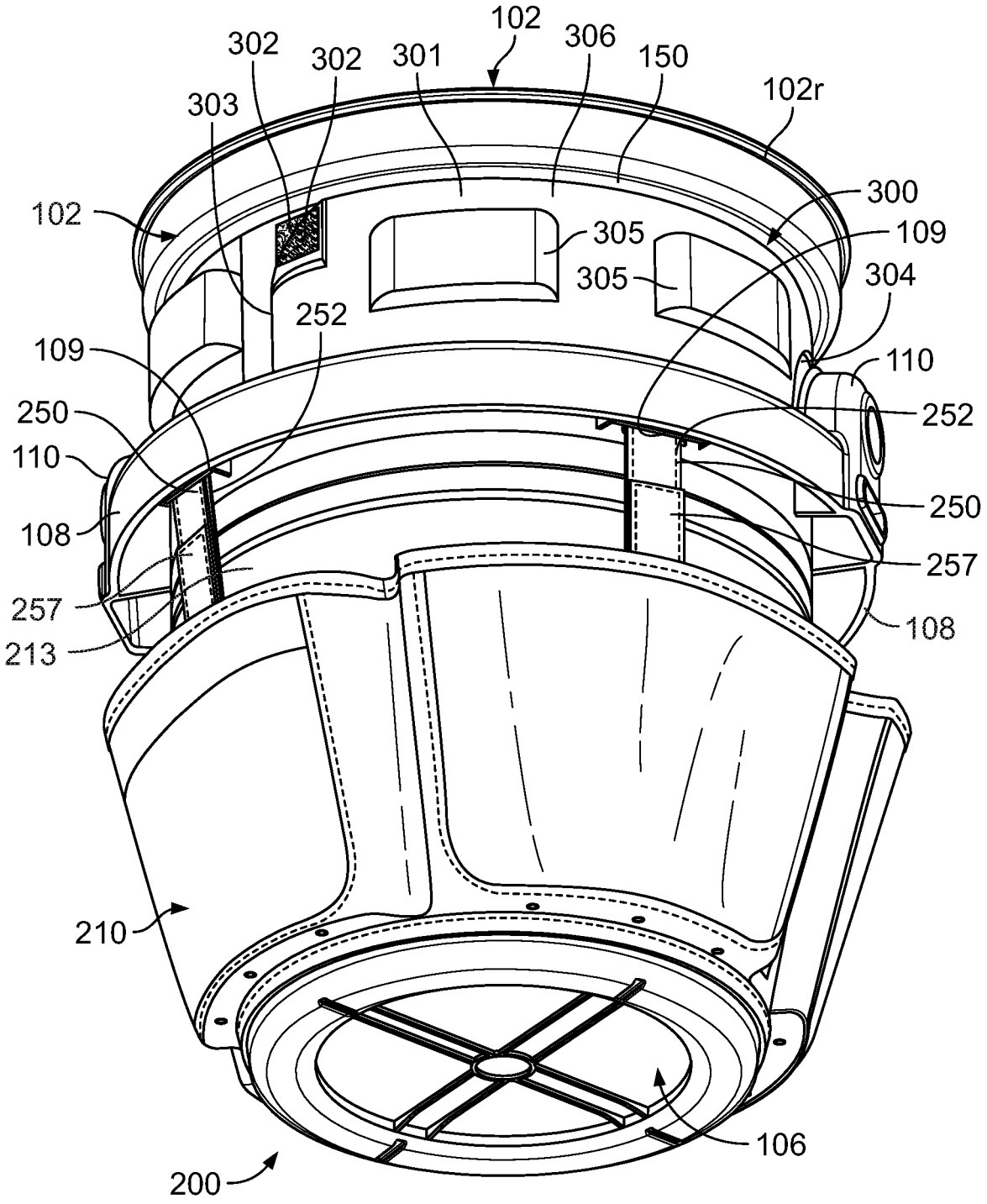
FIG. 45 is a perspective view of the container of FIG. 1 with another embodiment of an accessory connected to the container, in accordance with aspects of the disclosure.
Figure 46:
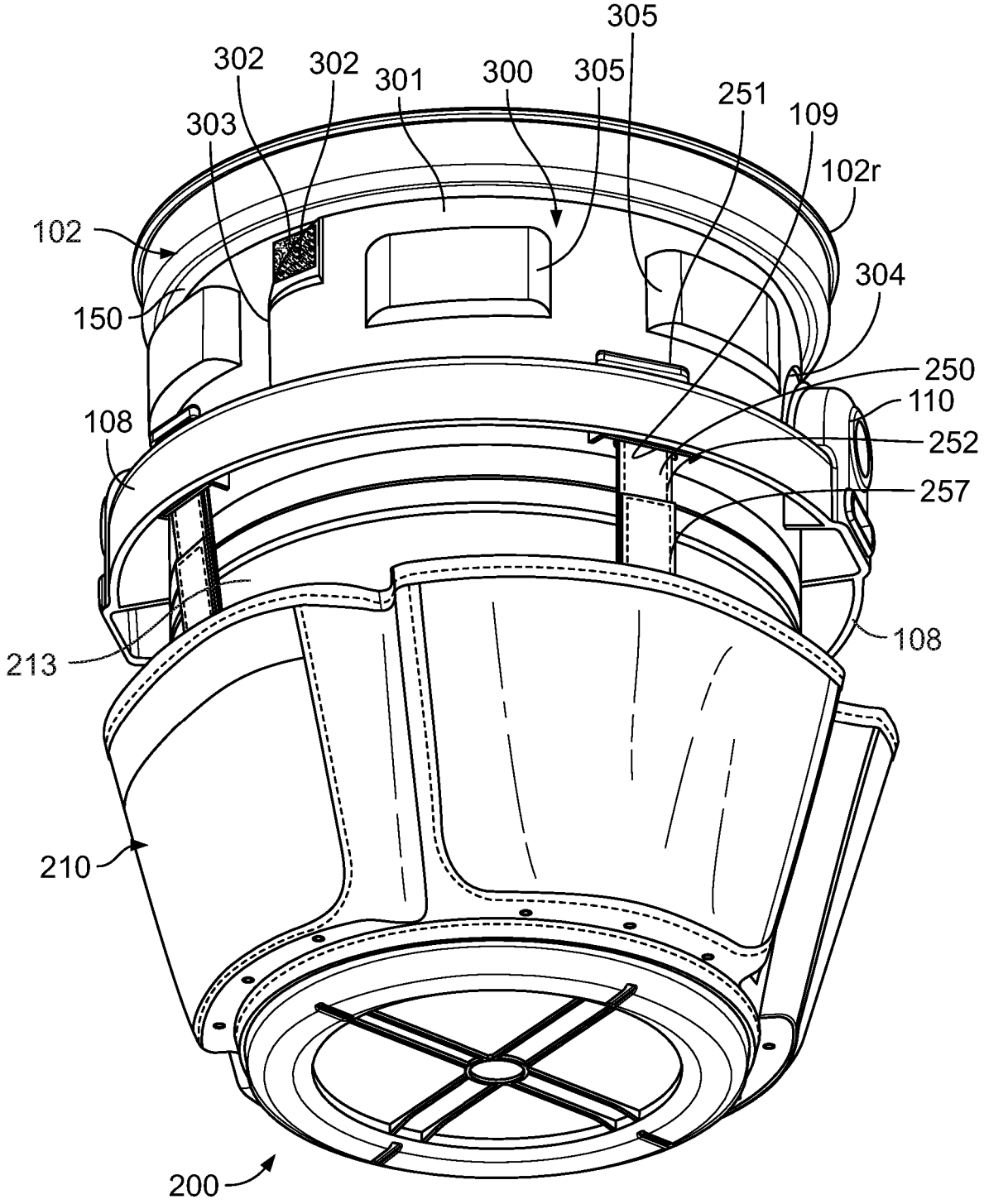
FIG. 46 is a perspective view of the container of FIG. 1 with the accessory of FIG. 6 and another embodiment of an accessory connected to the container, in accordance with aspects of the disclosure.

FIGS. 45-46 illustrate another embodiment of an accessory for connection to a container 102 as described herein, in the form of a non-insulated collar 300 that is configured to wrap around the upper portion of the sidewall 150 of the container 102. The collar 300 includes a flexible collar body 301 that has complementary releasable fasteners 302 at or proximate opposed ends 303 of the collar body 301 that connect to each other to fasten the collar 300 to the container 102. The collar body 301 has cut-outs 304 that receive the handle mounts 110 so the bottom of the collar 300 can rest on the skirt 108 and the handle mounts 110. The collar 300 in FIGS. 45-46 also has storage pockets or compartments 305 connected to the outer surface 306 of the collar body 301, to provide additional storage capacity. The collar 300 in FIG. 46 is illustrated to be mounted to the container 102 along with the jacket 210 of FIGS. 6-13. The collar 300 in FIG. 45 is configured to support the jacket 210 via a plurality of connection members 250 in the form of straps 252 that are connected to the collar 300 and extend downward from the collar 300 to support the jacket 210. In the embodiment of FIG. 45, the straps 252 are fixedly connected to the inner surface of the collar 300 (e.g., by stitching and/or adhesive) and removably connected to the jacket 210, using releasable connecting structure in the form of hook-and-loop connecting structures 255 including receiving members 257 connected to the jacket 210 as shown in FIGS. 6-13. The collar 300 rests on the skirt 108 and the handle mounts 110, and the straps 252 extend downward from the collar 300 and through the ports 109 to connect to the jacket 210. In other embodiments, different types of connection members 250 may be used to connect the collar 300 to the jacket 210. For example, in another embodiment, the connection members 250 may be releasably connected to the collar 300, and may be either releasably or fixedly connected to the jacket 210.

FIGS. 57-59 illustrate another embodiment of an accessory 200 configured as a rod holder 330 that is selectively attachable to and removable from the container 102, e.g., for holding a fishing rod. The rod holder 330 includes a rod holder body 331 that is configured to hold an elongated rod-shaped article (not shown) such as a fishing rod, and a mounting structure 332 connected to the rod holder body 331 and configured to removably mount the rod holder 330 on the container 102. The rod holder body 331 in FIGS. 57-59 is specially configured to hold a fishing rod with an attached reel but may be capable of holding other elongated articles, or the rod holder body 331 may be differently configured for holding a different elongated article. In this embodiment, the rod holder body 331 has a generally cylindrical sidewall 333 defining a cavity 334 configured to receive the elongated article, with a first end 335 that is open and a second end 336 opposite the first end 335. The second end 336 is open in the embodiment of FIGS. 57-59, but may alternately be closed. The first end 335 is also flared in order to ease insertion of the elongated article. An elongated slot 337 extends along a portion of the height of the sidewall 333 and is configured for receiving a portion of the elongated article that extends outwardly and/or transversely from the direction of elongation of the article, such as a fishing reel mount. In the case of a fishing rod, the reel mount is received in the slot 337 such that the reel itself is positioned outside the cavity 334, and the rod is substantially fixed against downward movement and rotation within the cavity 334. The rod can be easily removed by pulling upward out of the rod holder body 331.

The mounting structure 332 includes at least one mount base 338 fixed to the rod holder body 331 and an engaging member 339 connected to the mount base 338. In the embodiment of FIGS. 57-59, the mounting structure 332 includes two mount bases 338 that are spaced vertically or longitudinally along the sidewall 333, and the mount bases 338 may be integrally formed with the rod holder body 331, such as by molding. The mounting structure 332 further includes support structure 340 connecting the engaging member 339 to the mount bases 338 to support the engaging member 339. The support structure 340 in FIGS. 57-59 includes two mounting plates 341 that are configured for connection to the mount bases 338, such as by fasteners 342, and a span 343 that extends between the mounting plates 341, where the engaging member 339 is connected to the span 343.

As shown in FIGS. 57-59, the engaging member 339 extends outward and then downward from the span 343, to define a receiver 344 between the span 343 and the engaging member 339. The rod holder 330 is connected to the container 102 by inserting the engaging member 339 into the opening 152 of the container 102, such that the top 153 of the sidewall 150 and the rim **102*r* are received within the receiver 344. In this configuration, the engaging member 339 engages the inner surface 159 of the container 102, and the span 343 engages the rim 102*r* and the skirt 108 to provide at least three separate points of contact for stability. The engaging member 339 includes an inwardly curved or otherwise convex portion 345 that forms a contact point 346 for engaging the inner surface 159 of the container 102, and the distal end 347 of the engaging member 339 extends outward from the contact point 346 to assist in insertion of the rim 102*r* into the receiver 344. The receiver 344 in this configuration includes an upper portion 348, a narrowed middle portion 349 defined by the convex portion 345 of the engaging member 339, and a lower portion 350 that is open for insertion of the rim 102*r*. The middle portion 349 has a smaller maximum width than the upper portion 348 and the lower portion 350, with the smallest width occurring at the contact point 346. The width of the lower portion 350 increases continuously from the contact point 346 to the distal end 347 of the engaging member 339**.

In the embodiment of FIGS. 57-59, the engaging member 339 and the span 343 are formed together of a single piece of heavy-gauge wire that is bent to form the engaging member 339 and the span 343 in the configuration described herein. The mounting plates 341 are connected to the portion of the wire forming the span 343 by welding or other bonding technique, but other connection structures may be used in other embodiments.

It is understood that a mounting structure 332 as described herein may be connected to a structure other than a rod holder body 331, such as to support other functional components on the rim **102*r* of a container 102. For example, the accessory 200 may be configured with a different type of holder for holding a different type of article, or may be configured with a completely functionally different component connected to the mounting structure 332. The mounting structure 332 may therefore be considered to be configured for connection to a functional component, for mounting the functional component on the container 102. Additionally, the rod holder 330 may be configured with a rod holder body 331 that has a different type of mounting structure 332, including a mounting structure that is configured to connect to a different portion of the container, such as the skirt 108 or a port 109** thereon.

Various embodiments of accessories and container assemblies have been described herein, which include various components and features. In other embodiments, the accessories and container assemblies may be provided with any combination of such components and features. It is also understood that in other embodiments, the various devices, components, and features of the accessories and container assemblies described herein may be constructed with similar structural and functional elements having different configurations, including different ornamental appearances.

The embodiments of accessories and container assemblies including such accessories described herein present advantages compared to existing accessories for use with portable containers, including existing bags and organizers. For example, the accessory can be mounted securely on a container without concern for slippage or disconnection due to the configurations of the various connecting members 250 described herein. As another example, the accessory can be mounted on a container without occupying any interior space of the container. As another example, the accessory can be mounted on a container while also permitting a lid to be placed on the top of the container, and in particular, a lid with a tight-fitting seal (e.g., a gasket-based seal). As a further example, the jacket 210 can be fitted tightly with the container 102, so that the jacket 210 does not move with respect to the container 102 in any orientation of the container 102. As another example, the various modular jackets 210 described herein can provide a great deal of customizability for desired functionality, appearance, and structure. As another example, the insulating members 280, 300 described herein can be used to provide effective insulation to a non-insulated container 102 and permit conversion of a container 102 between insulated and non-insulated configurations as desired for functionality. As a further example, the rod holder 330 described herein provides for quick and reliable mounting on a container 102 for supporting a fishing rod or other elongated article. Other various embodiments of accessories described herein provide similarly advantageous functionality, as well as versatility of use of the container 102. Still further advantages are recognizable to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative purposes only and do not limit the embodiments in any way. In particular, these terms do not imply any order or position of the components modified by such terms. Additionally, the term "plurality," as used herein, indicates any number greater than one, either disjunctively or conjunctively, as necessary, up to an infinite number. Further, as used herein, "horizontal" and "vertical" are general relative terms. The definition of "vertical" is not limited to structures that are precisely perpendicular to the ground, the definition of "horizontal" is not limited to structures that are precisely parallel to the ground, and reference to different components as being "horizontal" and "vertical" does not imply that these components are precisely perpendicular to each other. Accordingly, while specific embodiments have been illustrated and described, numerous modifications come to mind without significantly departing from the spirit of the invention.

What is claimed is:

1. A container assembly comprising:

a portable container having a bottom and a sidewall extending upward from the bottom to define an internal cavity with a top opening, the portable container including a skirt having a horizontal portion extending outward from the sidewall around a periphery of the sidewall;

an insulating member connected to the portable container, the insulating member comprising:

an insulating body having a bottom wall and an insulating sidewall defining a cavity, wherein the portable container is received within the cavity of the insulating body such that the bottom of the portable container confronts the bottom wall of the insulating body, and the sidewall of the portable container confronts the insulating sidewall of the insulating body, and wherein the insulating body has a thermal conductivity through the insulating sidewall that is lower than a thermal conductivity through the sidewall of the portable container;

a connection member connected to the insulating body supporting the insulating body in connection with the portable container; and an insulated lid that includes a top wall and an outer wall that extends downward from the top wall, wherein the insulated lid fits over an outer rim of the sidewall of the portable container; and wherein a bottom surface of the outer wall faces a top surface of the horizontal portion of the skirt.

2. The container assembly of claim 1, wherein the insulating body is positioned beneath the horizontal portion of the skirt, and wherein a port is positioned on the skirt.

3. The container assembly of claim 1, wherein the connection member comprises a strap with a first end connected to an outer surface of the insulating body and wherein the strap extends through a port positioned on the horizontal portion of the skirt.

4. The container assembly of claim 1, wherein the insulated lid includes an inner wall extending downward from the top wall such that a channel is formed between the inner wall and the outer wall.

5. The container assembly of claim 4, wherein the outer rim of the sidewall of the portable container is received within the channel formed between the inner wall and the outer wall.

6. The container assembly of claim 1, wherein the outer wall includes cut-outs that receive handle mounts located on the portable container.

7. A container assembly comprising:

a portable container having a bottom and a sidewall extending upward from the bottom to define an internal cavity with a top opening, the portable container including a skirt having a horizontal portion extending outward from the sidewall around a periphery of the sidewall and a port; and an insulating member connected to the portable container, the insulating member comprising:

an insulating body having an insulating sidewall, wherein the portable container is received within a cavity of the insulating body and the sidewall of the portable container confronts the insulating sidewall of the insulating body, and wherein the insulating body has a thermal conductivity through the insulating sidewall that is lower than a thermal conductivity through the sidewall of the portable container; and a connection member comprising a strap with a first end connected to an outer surface of the insulating body and the strap extending through the port, and wherein the connection member is connected to the insulating body and supports the insulating body in connection with the portable container; and an insulated lid that includes a top wall and an outer wall that extends downward from the top wall, wherein the insulated lid fits over an outer rim of the sidewall of the portable container; and wherein a bottom surface of the outer wall faces a top surface of the horizontal portion of the skirt.

8. The container assembly of claim 7, wherein the insulating body is positioned beneath the horizontal portion of the skirt, and wherein the port is positioned on the skirt.

9. The container assembly of claim 7, wherein the insulated lid includes an inner wall extending downward from the top wall such that a channel is formed between the inner wall and the outer wall.

10. The container assembly of claim 9, wherein an outer rim of the sidewall of the portable container is received within the channel formed between the inner wall and the outer wall.

11. A container assembly comprising:

a portable container having a bottom and a sidewall extending upward from the bottom to define an internal cavity with a top opening, the portable container comprising a skirt having a horizontal portion extending outward from the sidewall around a periphery of the sidewall and a port positioned on the skirt; and an insulating member connected to the portable container, the insulating member comprising:

an insulating body having a bottom wall and an insulating sidewall defining a cavity, wherein the portable container is received within the cavity of the insulating body such that the bottom of the portable container confronts the bottom wall of the insulating body, and the sidewall of the portable container confronts the insulating sidewall of the insulating body, and wherein the insulating body is positioned beneath the horizontal portion of the skirt;

wherein the insulating body has a thermal conductivity through the insulating sidewall that is lower than a thermal conductivity through the sidewall of the portable container; and a connection member comprising a strap with a first end connected to an outer surface of the insulating body and the strap extending through the port, and wherein the connection member is connected to the insulating body and supports the insulating body in connection with the portable container; and an insulated lid that includes a top wall and an outer wall that extends downward from the top wall, wherein the insulated lid fits over an outer rim of the sidewall of the portable container; and wherein the insulated lid is positioned above the skirt.

12. The container assembly of claim 11, wherein the insulated lid further comprises an inner wall extending downward from the top wall such that a channel is formed between the inner wall and the outer wall, and wherein an outer rim of the sidewall of the portable container is received within the channel formed between the inner wall and the outer wall.

13. The container assembly of claim 11, wherein the strap has a second end opposite the first end that is removably connected to the outer surface of the insulated body.

* * * * *